US010811022B2

(12) United States Patent
Choo et al.

(10) Patent No.: US 10,811,022 B2
(45) Date of Patent: Oct. 20, 2020

(54) APPARATUS AND METHOD FOR ENCODING/DECODING FOR HIGH FREQUENCY BANDWIDTH EXTENSION

(71) Applicant: SAMSUNG ELECTRONICS CO., LTD., Suwon-si (KR)

(72) Inventors: Ki-hyun Choo, Seoul (KR); Eun-mi Oh, Seoul (KR); Ho-sang Sung, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/657,631

(22) Filed: Oct. 18, 2019

(65) Prior Publication Data

US 2020/0051579 A1 Feb. 13, 2020

Related U.S. Application Data

(63) Continuation of application No. 16/215,079, filed on Dec. 10, 2018, now Pat. No. 10,453,466, which is a (Continued)

(30) Foreign Application Priority Data

Dec. 29, 2010 (KR) ..... 10-2010-0138045

(51) Int. Cl.
*G10L 19/12* (2013.01)
*G10L 19/24* (2013.01)

(Continued)

(52) U.S. Cl.
CPC ..... *G10L 19/12* (2013.01); *G10L 19/038* (2013.01); *G10L 19/24* (2013.01); *G10L 21/038* (2013.01); *G10L 19/00* (2013.01)

(58) Field of Classification Search
CPC ..... G10L 19/18; G10L 19/20; G10L 19/22; G10L 19/24; G10L 21/038; G10L 21/0388

(Continued)

(56) References Cited

U.S. PATENT DOCUMENTS 5,950,155 A 9/1999 Nishiguchi
6,246,979 B1 6/2001 Carl (Continued)

FOREIGN PATENT DOCUMENTS

CN 1141684 A 1/1997
CN 1318189 A 10/2001

(Continued)

OTHER PUBLICATIONS

Communication dated Aug. 27, 2019 issued by the Japanese Patent Office in counterpart Japanese Application No. 2017-213145.

(Continued)

*Primary Examiner* — Michael N Opsasnick
(74) *Attorney, Agent, or Firm* — Sughrue Mion, PLLC

(57) ABSTRACT

A method and apparatus for performing coding and decoding for high-frequency bandwidth extension. The decoding apparatus may include: a mode checking unit to check mode information of each of frames included in a bitstream; a first core decoding unit to perform code excited linear prediction (CELP) decoding on a CELP coded frame, when a core coding mode of a low-frequency signal indicates a CELP coding mode; a first extension decoding unit to generate a decoded signal of a high-frequency band by using at least one of a result of the performing the CELP decoding and an excitation signal of the low-frequency signal; a second core decoding unit to perform audio decoding on an audio coded frame, when the core coding mode indicates an audio coding mode; and a second extension decoding unit to generate a (Continued)

decoded signal of the high-frequency band by performing frequency-domain (FD) extension decoding.

10 Claims, 29 Drawing Sheets

Related U.S. Application Data continuation of application No. 13/977,906, filed as application No. PCT/KR2011/010258 on Dec. 28, 2011, now Pat. No. 10,152,983.

(60) Provisional application No. 61/495,017, filed on Jun. 9, 2011.

(51) Int. Cl.
*G10L 19/038* (2013.01)
*G10L 21/038* (2013.01)
*G10L 19/00* (2013.01)

(58) Field of Classification Search
USPC ..... 704/500–504
See application file for complete search history.

(56) References Cited

U.S. PATENT DOCUMENTS 6,377,915 B1 4/2002 Sasaki
6,947,888 B1 9/2005 Huang
7,146,311 B1 12/2006 Uvliden et al.
7,222,069 B2 5/2007 Suzuki et al.
7,372,375 B2 5/2008 Tsutsui et al.
7,454,330 B1 11/2008 Nishiguchi et al.
7,587,314 B2 9/2009 Vasilache et al.
7,668,711 B2 2/2010 Chong et al.
7,801,733 B2 9/2010 Lee et al.
7,873,514 B2 1/2011 Ramprashad
8,108,222 B2 1/2012 Tsushima et al.
8,121,831 B2 2/2012 Oh et al.
8,271,292 B2 9/2012 Osada et al.
8,422,569 B2 4/2013 Yamanashi et al.
8,442,382 B2 5/2013 Toma et al.
9,159,333 B2 10/2015 Son et al.
9,355,647 B2 5/2016 Geiger et al.
10,115,407 B2 * 10/2018 Choo ..... G10L 19/0208
10,366,696 B2 7/2019 Tsujino et al.
10,453,466 B2 * 10/2019 Choo ..... G10L 19/12
2005/0004793 A1 * 1/2005 Ojala ..... G10L 21/038 704/219
2007/0016417 A1 * 1/2007 Sung ..... G10L 19/035 704/230
2007/0033031 A1 2/2007 Zakarauskas
2007/0055509 A1 * 3/2007 Vasilache ..... G10L 19/24 704/229
2007/0225971 A1 * 9/2007 Bessette ..... G10L 19/0208 704/203
2007/0282599 A1 * 12/2007 Choo ..... G10L 21/038 704/205
2007/0299656 A1 * 12/2007 Son ..... G10L 21/038 704/205
2008/0010062 A1 1/2008 Son et al.
2008/0120117 A1 * 5/2008 Choo ..... G10L 21/038 704/500
2008/0172223 A1 7/2008 Oh et al.
2008/0195383 A1 * 8/2008 Shlomot ..... G10L 19/012 704/205
2008/0262835 A1 * 10/2008 Oshikiri ..... G10L 21/038 704/205
2009/0063140 A1 3/2009 Villemoes et al.
2009/0110208 A1 4/2009 Choo
2009/0234645 A1 9/2009 Bruhn
2009/0299757 A1 * 12/2009 Guo ..... G10L 19/022 704/500
2010/0010809 A1 1/2010 Oh et al.
2010/0017204 A1 1/2010 Oshikiri
2010/0070272 A1 * 3/2010 Lee ..... G10L 19/20 704/219
2010/0088091 A1 * 4/2010 Lee ..... G10L 19/12 704/219
2010/0111074 A1 * 5/2010 El-Hennawey ..... H04L 12/1827 370/352
2010/0114568 A1 * 5/2010 Yoon ..... G10L 19/18 704/223
2010/0114583 A1 * 5/2010 Lee ..... G10L 19/025 704/500
2010/0121646 A1 * 5/2010 Ragot ..... G10L 19/0204 704/500
2010/0138218 A1 * 6/2010 Geiger ..... G10L 19/02 704/205
2010/0211400 A1 8/2010 Oh et al.
2010/0217607 A1 * 8/2010 Neuendorf ..... G10L 19/20 704/500
2010/0274557 A1 10/2010 Oh et al.
2010/0305956 A1 12/2010 Oh et al.
2011/0004479 A1 * 1/2011 Ekstrand ..... G10L 19/022 704/500
2011/0046966 A1 * 2/2011 Dalimba ..... G10L 19/035 704/503
2011/0145003 A1 * 6/2011 Bessette ..... G10L 19/0212 704/500
2011/0257980 A1 10/2011 Gao
2012/0253797 A1 10/2012 Geiger
2012/0316887 A1 12/2012 Oh et al.
2013/0226595 A1 8/2013 Liu

FOREIGN PATENT DOCUMENTS

CN 1302459 C 2/2007
CN 101174412 A 5/2008
CN 101236745 A 8/2008
CN 101430880 A 5/2009
CN 101542596 A 9/2009
EP 1037197 A2 9/2000
EP 2062255 A1 5/2009
EP 2105020 A1 9/2009
EP 2144230 A1 1/2010
EP 2259254 A2 12/2010
ES 2188679 T3 7/2003
JP 08-263098 A 10/1996
JP 2000-0132199 A 5/2000
JP 2003-304238 A 10/2003
JP 2006-189836 A 7/2006
JP 2008-219887 A 9/2008
JP 2009-506368 A 2/2009
JP 2009-116371 A 5/2009
JP 2009-541790 A 11/2009
JP 2010-500819 A 1/2010
JP 2010-512550 A 4/2010
JP 2010-197862 A 9/2010
JP 2011-34046 A 2/2011
KR 10-2007-0026939 A 3/2007
KR 10-2008-0066473 A 7/2008
KR 10-2010-0095585 A 8/2010
RU 2127912 C1 3/1999
RU 2383943 C2 3/2010
RU 2 407 069 C2 12/2010
WO 99/03094 A1 1/1999
WO 2005/104094 A1 11/2005
WO 2008/031458 A1 3/2008
WO 2008/084924 A1 7/2008
WO 2009093466 A1 7/2009
WO 2010003564 A1 1/2010

OTHER PUBLICATIONS

Communication dated Feb. 11, 2019, issued by the Korean Intellectual Property Office in counterpart Korean Patent Application No. 10-2012-0062356.

(56) References Cited

OTHER PUBLICATIONS

Communication dated Mar. 14, 2019, issued by the State Intellectual Property Office of P.R. China in counterpart Chinese Application No. 201610903714.2.
Communication dated Mar. 25, 2019, issued by the State Intellectual Property Office of P.R. China in counterpart Chinese Application No. 201610903549.0.
Max Neuendorf, "Coding of Moving Pictures and Audio", International Organization for Standardization, Apr. 26, 2010, pp. 6-148 (148 pages total).
Ulrich Kornagel, "Techniques for artificial bandwidth extension of telephone speech", Signal Processing, Jun. 1, 2006, vol. 86, No. 6, pp. 1296-1306 (11 pages total).
Communication dated Apr. 13, 2018, issued by the Intellectual Property Corporation of Malaysia in counterpart Malaysia application No. PI 2013002326.
Communication dated Jul. 13, 2017, issued by the Mexican Institute of Industrial Property in counterpart Mexican Patent Application No. MX/a/2015/015946.
Communication dated Apr. 13, 2017 by the Australian Intellectual Property Office in counterpart Australian Patent Application No. 2016222488.
Communication dated Apr. 18, 2017 by the Federal Service on Intellectual Property in counterpart Russian Patent Application No. 2015156885.
Communication dated Jan. 12, 2017, issued by the Mexican Patent Office dated in counterpart Mexican application No. MX/a/2015/015946.
Communication dated Jan. 24, 2017, issued by the Japanese Patent Office in counterpart Japanese application No. 2015-242633.
Communication dated Aug. 30, 2016, issued by the Japanese Patent Office in counterpart Japanese Patent Application No. 2013-547347.
Communication dated Jun. 10, 2016, issued by the Mexican Institute of Industrial Property in counterpart Mexican Patent Application No. MX/a/2015/015946.
Communication dated Feb. 29, 2016, issued by the European Patent Office in counterpart European Patent Application No. 15199906.7.
Communication dated Mar. 17, 2016, issued by the Australian Patent Office in counterpart Australian Patent Application No. 2015202393.
Communication dated Aug. 27, 2015 issued by Russian Intellectual Property Office in counterpart Russian Patent Application No. 2013135005.
Communication dated Jun. 4, 2015, issued by the Mexican Institute of Industrial Property in counterpart Mexican Patent Application No. MX/a/2015/000089.
Communication dated Jun. 18, 2015, issued by the State Intellectual Property Office of the People's Republic of China. in counterpart Chinese Patent Application No. 201180068757.9.
Communication dated Aug. 11, 2015, issued by the Japanese Patent Office in counterpart Japanese Patent Application No. 2013-547347.
Communication dated Jan. 28, 2015, issued by the Canadian Intellectual Property Office in counterpart Canadian Application No. 2823175.
Communication dated Sep. 18, 2014 issued by the State Intellectual Property Office of the People's Republic of China in counterpart Chinese application No. 201180068757.9 (14 pages including translation).
Communication dated Jul. 8, 2014 issued by Japanese Patent Office in counterpart Japanese application No. 2013-547347 (8 pages including translation).
Mittal et al., "Low Complexity Factorial Pulse Coding of MDCT Coefficients using Approximation of Combinatiorial Functions", IEEE National Conference on Acoustics, Speech and Signal Processing, 2007, 5 pages total, vol. 1, IEEE, USA.
International Search Report (PCT/ISA/210) dated Apr. 26, 2012, issued in International Application No. PCT/KR2011/010258.
Written Opinion (PCT/ISA/237) dated Apr. 26, 2012, issued in International Application No. PCT/KR2011/010258.
3GPP2 C.S0014-D v2.0, "Enhanced Variable Rate Codec, Speech Service Options 3, 68, 70, and 73 for Wideband Spread Spectrum Digital Systems", Jan. 25, 2010.
Neuendorf et al., "A Novel Scheme for Low Bitrate Unified Speech and Audio Coding—MPEG RMO", May 7, 2009, Audio Engineering Society, 126 convention.
Itu-T, "G.729-based embedded variable bit-rate coder: An 8-32 kbit/s scalable wideband coder bitstream interoperable with G.729", May 2006, International Telecommunication Union.
Communication dated Sep. 4, 2019 issued by the Brazil Patent Office in counterpart Brazilian Application No. BR1120130164387.
Communication dated May 27, 2020 issued by the Malaysian Intellectual Property Office in counterpart Malaysian Application No. PI 2017000646.

* cited by examiner

APPARATUS AND METHOD FOR ENCODING/DECODING FOR HIGH FREQUENCY BANDWIDTH EXTENSION

CROSS-REFERENCE TO RELATED APPLICATION

This application is a Continuation Application of U.S. application Ser. No. 16/215,079, filed on Dec. 10, 2018, now U.S. Pat. No. 10,453,466, issued on Oct. 22, 2019, which is a Continuation Application of U.S. patent application Ser. No. 13/977,906, filed on Jul. 1, 2013, now U.S. Pat. No. 10,152,983, issued Dec. 11, 2018, which is a National Stage of International Application No. PCT/KR2011/010258, filed Dec. 28, 2011, and claims priority from Korean Patent Application No. 10-2010-0138045, filed on Dec. 29, 2010, and from U.S. Provisional Application No. 61/495,017, filed on Jun. 9, 2011, the disclosures of which are incorporated herein in their entirety by reference.

BACKGROUND

1. Field

Exemplary Embodiments relate to a method and apparatus for coding and decoding an audio signal, e.g., a speech signal or a music signal, and more particularly, to a method and apparatus for coding and decoding a signal corresponding to a high-frequency band of an audio signal.

2. Description of the Related Art

A signal corresponding to a high-frequency band is less sensitive to a fine structure of frequency than a signal corresponding to a low-frequency band. Thus, when coding efficiency is increased to eliminate restrictions in relation to bits available to code an audio signal, a large number of bits are assigned to the signal corresponding to the low-frequency band and a relatively small number of bits are assigned to the signal corresponding to the high-frequency band.

A technology employing the above method is spectral band replication (SBR). In SBR, coding efficiency is increased by expressing a high-frequency signal with an envelope and synthesizing the envelope during a decoding process. SBR is based on hearing characteristics of humans and has a relatively low resolution with regard to a high-frequency signal.

SUMMARY

Exemplary Embodiments provide methods of extending a bandwidth of a high-frequency band, based on SBR.

According to an aspect of an exemplary embodiment, there is provided a coding apparatus including a down-sampler configured to down-sample an input signal; a core coder configured to perform core coding on the down-sampled input signal; a frequency transformer configured to perform frequency transformation on the input signal; and an extension coder configured to perform bandwidth extension coding by using a base signal of the input signal in a frequency domain.

The extension coder may include a base signal generator configured to generate the base signal of the input signal in the frequency domain from a frequency spectrum of the input signal in the frequency domain; a factor estimator configured to estimate an energy control factor by using the base signal; an energy extractor configured to extract energy from the input signal in the frequency domain; an energy controller configured to control the extracted energy by using the energy control factor; and an energy quantizer configured to quantize the controlled energy.

The base signal generator may include an artificial signal generator configured to generate an artificial signal corresponding to a high-frequency band by copying and folding a low-frequency band of the input signal in the frequency domain; an envelope estimator configured to estimate an envelope of the base signal by using a window; and an envelope application unit configured to apply the estimated envelope to the artificial signal.

A peak of the window may correspond to a frequency index for estimating the envelope of the base signal, and the envelope estimator may be further configured to estimate the envelope of the base signal by selecting a window of a plurality of windows according to a comparison of a tonality or correlation of the high-frequency band with a tonality or correlation of each of the plurality of windows.

The envelope estimator may be further configured to estimate an average of frequency magnitudes of each of a plurality of whitening bands as an envelope of a frequency belonging to each of the plurality of whitening bands.

The envelope estimator may be further configured to estimate the envelope of the base signal by controlling a number of frequency spectrums belonging to each of the plurality of whitening bands according to a core coding mode.

The factor estimator may further include a first tonality calculator configured to calculate a tonality of a high-frequency band of the input signal in the frequency domain; a second tonality calculator configured to calculate a tonality of the base signal; and a factor calculator configured to calculate the energy control factor by using the tonality of the high-frequency band of the input signal and the tonality of the base signal.

If the energy control factor is less than a predetermined threshold energy control factor, the energy controller may be further configured to control energy of the input signal.

The energy quantizer may be further configured to select and quantize a first plurality of sub vectors, and configured to quantize a second plurality of sub vectors different from the first plurality of sub vectors by using an interpolation error.

The energy quantizer may be further configured to select the first plurality of sub vectors at a same time interval.

The energy quantizer may be further configured to select candidates of the first plurality of sub vectors and configured to perform multi-stage vector quantization using at least two stages.

The energy quantizer may be further configured to generate an index set to satisfy mean square errors (MSEs) or weighted mean square errors (WMSEs) for each of candidates of the first plurality of sub vectors in each of a plurality of stages, and configured to select a candidate of the first plurality of sub vectors having a least sum of MSEs or WMSECs in all the stages of the plurality of stages from among the candidates.

The energy quantizer may be further configured to generate an index set to minimize mean square errors (MSEs) or weighted mean square errors (WMSEs) for each of candidates of the first plurality of sub vectors in each of a plurality of stages, configured to reconstruct an energy vector through inverse quantization, and configured to select a candidate of the first plurality of sub vectors to minimize MSE or WMSEC between the reconstructed energy vector and the original energy vector from among the candidates.

According to an aspect of another exemplary embodiment, there is provided an apparatus including a down-sampler configured to down-sample an input signal; a core coder configured to perform core coding on the down-sampled input signal; a frequency transformer configured to perform frequency transformation on the input signal; and an extension coder configured to perform bandwidth extension coding by using characteristics of the input signal and a base signal of the input signal in a frequency domain.

The extension coder may further include a base signal generator configured to generate the base signal of the input signal in the frequency domain by using a frequency spectrum of the input signal in the frequency domain; a factor estimator configured to estimate an energy control factor by using the characteristics of the input signal and the base signal; an energy extractor configured to extract energy from the input signal in the frequency domain; an energy controller configured to control the extracted energy by using the energy control factor; and an energy quantizer configured to quantize the controlled energy.

The extension coder may further include a signal classification unit configured to classify the input signal in the frequency domain according to characteristics of this input signal by using the frequency spectrum of the input signal in the frequency domain, and wherein the factor estimator may be further configured to estimate the energy control factor by using the characteristics of the input signal which are determined by the signal classification unit.

The factor estimator may be further configured to estimate the energy control factor by using characteristics of the input signal, which are determined by the core coder.

The base signal generator may further include an artificial signal generator configured to generate an artificial signal corresponding to a high-frequency band by copying and folding a low-frequency band of the input signal in the frequency domain; an envelope estimator configured to estimate an envelope of the base signal by using a window; and an envelope application unit configured to apply the estimated envelope to the artificial signal.

A peak of the window may correspond to a frequency index for estimating the envelope of the base signal, and the envelope estimator may be further configured to estimate the envelope of the base signal by selecting the window from a plurality of windows according to a comparison of a tonality or correlation of the high-frequency band with a tonality or correlation of each of the plurality of windows.

The envelope estimator may be further configured to estimate an average of frequency magnitudes of each of a plurality of whitening bands as an envelope of a frequency belonging to each of the plurality of whitening bands.

The envelope estimator may be further configured to estimate the envelope of the base signal by controlling a number of frequency spectrums belonging to each of the plurality of whitening bands according to a core coding mode.

The factor estimator may further include a first tonality calculator configured to calculate a tonality of a high-frequency band of the input signal in the frequency domain; a second tonality calculator configured to calculate a tonality of the base signal; and a factor calculator configured to calculate the energy control factor by using the tonality of the high-frequency band of the input signal in the frequency domain and the tonality of the base signal.

If the energy control factor is less than a predetermined threshold energy control factor, the energy controller may be further configured to control energy of the input signal.

The energy quantizer may be further configured to select and quantize a first plurality of sub vectors, and configured to quantize a second plurality of sub vectors different from the first plurality of sub vectors by using an interpolation error.

The energy quantizer may be further configured to select the first plurality of sub vectors at a same time interval.

The energy quantizer may be further configured to select candidates of the first plurality of sub vectors and configured to perform multi-stage vector quantization using at least two stages.

According to an aspect of another exemplary embodiment, there is provided apparatus including an energy extractor configured to extract energy from an input signal in a frequency domain, based on a coding mode; an energy controller configured to control energy, based on the coding mode; and an energy quantizer configured to quantize the energy, based on the coding mode.

According to an aspect of another exemplary embodiment, there is provided a coding apparatus including a coding mode selector configured to select a coding mode of bandwidth extension coding, based on an input signal in a frequency domain and an input signal in a time domain; and an extension coder configured to perform bandwidth extension coding by using the input signal in the frequency domain and the coding mode.

The coding mode selector may be further configured to classify the input signal in the frequency domain by using the input signal in the frequency domain and the input signal in the time domain, configured to determine a coding mode of bandwidth extension coding according to classified information, and configured to determine a number of frequency bands according to the coding mode.

The extension coder may further include an energy extractor configured to extract energy from the input signal in the frequency domain, based on the coding mode; an energy controller configured to control the extracted energy by using the energy control factor, based on the coding mode; and an energy quantizer configured to quantize the controlled energy, based on the coding mode.

The energy extractor may be further configured to extract energy corresponding to a frequency band, based on the coding mode.

The energy controller may be further configured to control energy by using an energy control factor estimated according to a base signal of the input signal in the frequency domain.

The energy quantizer may be further configured to perform quantization to be optimized for the input signal in the frequency domain, according to the coding mode.

The energy quantizer may be further configured to quantize energy of a frequency band by using a frequency weighting method, if the coding mode is a transient mode.

The frequency weighting method may be a method for quantizing energy by assigning a weight to a low-frequency band of high perceptual importance.

If the coding mode is one of a normal mode and a harmonic mode, the energy quantizer may be further configured to quantize energy of a frequency band by using an unequal bit allocation method.

The unequal bit allocation method may be a method for quantizing energy by assigning a larger number of bits to a low-frequency band of high perceptual importance than to a high-frequency band.

The energy quantizer may be further configured to predict a representative value of a quantization target vector including at least two elements, and configured to perform vector quantization on an error signal between the predicted representative value and the at least two elements of the quantization target vector.

According to an aspect of another exemplary embodiment, there is provided a decoding apparatus including a core decoder configured to perform core decoding on a core coded input signal included in a bitstrearm, an up-sampler configured to up-sample the core decoded input signal; a frequency transformer configured to perform frequency transformation on the up-sampled input signal; and an extension decoder configured to perform bandwidth extension decoding by using energy of the input signal included in the bitstream and an input signal in a frequency domain.

The extension decoder may further include an inverse quantizer configured to inversely quantize the energy of the input signal; a base signal generator configured to generate a base signal by using the input signal in the frequency domain; a gain calculator configured to calculate a gain to be applied to the base signal by using the inversely quantized energy and energy of the base signal; and a gain application unit configured to apply the gain to each of frequency bands.

The inverse quantizer may be further configured to select and inversely quantize a sub vector, configured to interpolate the inversely quantized sub vector, and configured to inversely quantize energy by adding an interpolation error to the interpolated sub vector.

The base signal generator may further include an artificial signal generator configured to generate an artificial signal corresponding to a high frequency band by copying and folding a low-frequency band of the input signal in the frequency domain; an envelope estimator configured to estimate an envelope of the base signal by using a window included in the bitstrearm, and an envelope application unit configured to apply the estimated envelope to the artificial signal.

Each of the frequency bands may be divided into a plurality of sub bands, and wherein the gain calculator and the gain application unit are further configured to generate energy of each of the sub bands through interpolation by setting sub band for applying energy smoothing, the gain is calculated for the each sub band.

According to an aspect of another exemplary embodiment, there is provided a coding apparatus including a signal classification unit configured to determine a coding mode of an input signal, based on characteristics of the input signal; a code excited linear prediction (CELP) coder configured to perform CELP coding on a low-frequency signal of the input signal when a coding mode of the input signal is determined to be a CELP coding mode; a time-domain (TD) extension coder configured to perform extension coding on a high-frequency signal of the input signal when CELP coding is performed on the low-frequency signal of the input signal; a frequency transformer configured to perform frequency transformation on the input signal when the coding mode of the input signal is determined to be a frequency-domain (FD) mode; and an FD coder configured to perform FD coding on the transformed input signal.

The FD coder may further include a normalization coder configured to extract energy from the transformed input signal for each frequency band and further configured to quantize the extracted energy; a factorial pulse coder configured to perform factorial pulse coding (FPC) on a value obtained by scaling the transformed input signal by using a quantized normalization value; and an additional noise information generator configured to generate additional noise information according to performing of the FPC, wherein the transformed input signal input to the FD coder is a transient frame.

The FD coder may further include a normalization coder configured to extract energy from the transformed input signal for each frequency band and further configured to quantize the extracted energy; a factorial pulse coder configured to perform factorial pulse coding (FPC) on a value obtained by scaling the transformed input signal using a quantized normalization value; an additional noise information generator configured to generate additional noise information according to performing of the FPC; and an FD extension coder configured to perform extension coding on a high-frequency signal of the transformed input signal, wherein the transformed input signal input to the FD coder is a stationary frame.

The FD extension coder may be further configured to perform energy quantization by using a same codebook at different bitrates.

A bitstream according to a result of performing the FD coding on the transformed input signal may include previous frame mode information.

According to an aspect of another exemplary embodiment, there is provided a coding apparatus including a signal classification unit configured to determine a coding mode of an input signal, based on characteristics of the input signal; a linear prediction coefficient (LPC) coder configured to extract an LPC from a low-frequency signal of the input signal, and further configured to quantize the LPC, a code excited linear prediction (CELP) coder configured to perform CELP coding on an LPC excitation signal of a low-frequency signal of the input signal extracted using the LPC when a coding mode of the input signal is determined to be a CELP coding mode; a time-domain (TD) extension coder configured to perform extension coding on a high-frequency signal of the input signal when CELP coding is performed on the LPC excitation signal; an audio coder configured to perform audio coding on the LPC excitation signal when a coding mode of the input signal is determined to be an audio mode; and an FD extension coder configured to perform extension coding on the high-frequency signal of the input signal when audio coding is performed on the LPC excitation signal.

The FD extension coder may be further configured to perform energy quantization by using a same codebook at different bitrates.

According to an aspect of another exemplary embodiment, there is provided a decoding apparatus including a mode information checking unit configured to check mode information of each of frames included in a bitstrearm, a code excited linear prediction (CELP) decoder configured to perform CELP decoding on a CELP coded frame, based on a result of the checking; a time-domain (TD) extension decoder configured to generate a decoded signal of a high-frequency band by using at least one of a result of performing the CELP decoding and an excitation signal of a low-frequency signal; a frequency-domain (FD) decoder configured to perform FD decoding on an FD coded frame, based on the result of the checking; and an inverse frequency transformer configured to perform inverse frequency transformation on a result of performing the FD decoding.

The FD decoder may further include a normalization decoder configured to perform normalization decoding, based on normalization information included in the bitstream; a factorial pulse coding (FPC) decoder configured to perform FPC decoding, based on factorial pulse coding information included in the bitstream; and a noise filling performing unit configured to perform noise filling on a result of performing the FPC decoding.

The FD decoder may further include a normalization decoder configured to perform normalization decoding, based on normalization information included in the bitstream; a factorial pulse coding (FPC) decoder configured to perform FPC decoding, based on factorial pulse coding information included in the bitstream; a noise filling performing unit configured to perform noise filling on a result of performing the FPC decoding; and an FD high-frequency extension decoder configured to perform high frequency extension decoding, based on the result of performing FPC decoding and a result of performing the noise filling.

The FD decoder may further include an FD low-frequency extension coder configured to perform extension coding on the result of performing the FPC decoding and the noise filling when an upper band value of a frequency band performing FPC decoding is less than an upper band value of a frequency band of a core signal.

The FD high-frequency extension decoder may be further configured to perform inverse quantization of energy by sharing a same codebook at different bitrates.

The FD decoder may be further configured to perform FD decoding on an FD coded frame, based on previous frame mode information included in the bitstream.

According to an aspect of another exemplary embodiment, there is provided a decoding apparatus including a mode information checking unit configured to check mode information of each of a plurality of frames included in a bitstream; a linear prediction coefficient (LPC) decoder configured to perform LPC decoding on the plurality of frames included in the bitstream; a code excited linear prediction (CELP) decoder configured to perform CELP decoding on a CELP coded frame, based on a result of the checking; a time-domain (TD) extension decoder configured to generate a decoded signal of a high-frequency band by using at least one of a result of performing the CELP decoding and an excitation signal of a low frequency signal; an audio decoder configured to perform audio decoding on an audio coded frame, based on the result of the checking; and a frequency-domain (FD) extension decoder configured to perform extension decoding by using a result of performing the audio decoding.

The FD extension decoder may be further configured to perform inverse quantization of energy by sharing a same codebook at different bitrates.

According to an aspect of another exemplary embodiment, there is provided a coding method comprising; down-sampling an input signal; performing core coding on the down-sampled input signal; performing frequency transformation on the input signal; and performing bandwidth extension coding by using a base signal of the input signal in a frequency domain.

The performing of the bandwidth extension coding may further include generating the base signal of the input signal in the frequency domain by using a frequency spectrum of the input signal in the frequency domain; estimating an energy control factor by using the base signal; extracting energy from the input signal in the frequency domain; controlling the extracted energy by using the energy control factor; and quantizing the controlled energy.

The generating of the base signal may further include generating an artificial signal corresponding to a high-frequency band by copying and folding a low-frequency band of the input signal in the frequency domain; estimating an envelope of the base signal by using a window; and applying the estimated envelope to the artificial signal.

a peak of the window may correspond to a frequency index for estimating the envelope of the base signal, and the estimating of the envelope of the base signal may include estimating the envelope of the base signal by selecting a window of a plurality of windows according to a comparison of a tonality or correlation of the high-frequency band with a tonality or correlation of each of the plurality of windows.

The estimating of the envelope of the base signal may include estimating an average of frequency magnitudes of each of a plurality of whitening bands as an envelope of a frequency belonging to each of the plurality of whitening bands.

The estimating of the envelope of the base signal may include estimating the envelope of the base signal by controlling a number of frequency spectrums belonging to each of the plurality of whitening bands according to a core coding mode.

The estimating of the energy control factor may further include calculating a tonality of a high-frequency band of the input signal in the frequency domain; calculating a tonality of the base signal; and calculating the energy control factor by using the tonality of the high-frequency band of the input signal and the tonality of the base signal.

The controlling of the extracted energy may include controlling energy of the input signal when the energy control factor is less than a predetermined threshold energy control factor.

The quantizing of the controlled energy may include selecting and quantizing a first plurality of sub vectors, and quantizing a second plurality of sub vectors different from the first plurality of sub vectors by using an interpolation error.

The quantizing of the controlled energy may include selecting the first plurality of sub vectors at a same time interval and performing quantization.

The quantizing of the controlled energy may include selecting candidates of the first plurality of sub vectors and performing multi-stage vector quantization using at least two stages.

The quantizing of the controlled energy may include generating an index set to satisfy mean square errors (MSEs) or weighted mean square errors (WMSEs) for each of the candidates of the first plurality of sub vectors in each of a plurality of stages, and selecting a candidate of the first plurality of sub vectors to minimize MSEs or WMSECs in all the stages of the plurality of stages from among the candidates.

The quantizing of the controlled energy may include generating an index set to minimize square errors (MSEs) or weighted mean square errors (WMSEs) for each of the candidates of the first plurality of sub vectors in each of a plurality of stages, reconstructing an energy vector through inverse quantization, and selecting a candidate of the first plurality of sub vectors to minimize MSE or WMSEC between the reconstructed energy vector and the original energy vector from among the candidates.

According to an aspect of another exemplary embodiment, there is provided a coding method including down-sampling an input signal; performing core coding on the down-sampled input signal; performing frequency transformation on the input signal; and performing bandwidth extension coding by using characteristics of the input signal and a base signal of the input signal in a frequency domain.

The performing of the bandwidth extension coding may further include generating the base signal of the input signal in the frequency domain by using a frequency spectrum of the input signal in the frequency domain; estimating an energy control factor, based on the characteristics of the input signal and the base signal; extracting energy from the input signal in the frequency domain; controlling the extracted energy by using the energy control factor; and quantizing the controlled energy.

The performing of the bandwidth extension coding may further include classifying the input signal in the frequency domain according to characteristics of the input signal by using the frequency spectrum of the input signal in the frequency domain, and the estimating of the energy control factor may include estimating the energy control factor by using the characteristics of the input signal which are determined in the classifying of the input signal according to the characteristics.

The estimating of the energy control factor may include estimating the energy control factor by using characteristics of the input signal, which are determined in the performing of the core coding.

The generating of the base signal may further include generating an artificial signal corresponding to a high-frequency band by copying and folding a low-frequency band of the input signal in the frequency domain; estimating an envelope of the base signal by using a window; and applying the estimated envelope to the artificial signal.

A peak of the window may correspond to a frequency index for estimating the envelope of the base signal, and the estimating of the envelope of the base signal may include estimating the envelope of the base signal by selecting the window from a plurality of windows according to a comparison of a tonality or correlation of the high-frequency band with a tonality or correlation of each of the plurality of windows.

The estimating of the envelope of the base signal may include estimating an average of frequency magnitudes of each of a plurality of whitening bands as an envelope of a frequency belonging to each of the plurality of whitening bands.

The estimating of the envelope of the base signal may include estimating the envelope of the base signal by controlling a number of frequency spectrums belonging to each of the plurality of whitening bands according to a core coding mode.

The estimating of the energy control factor may further include calculating a tonality of a high-frequency band of the input signal in the frequency domain; calculating a tonality of the base signal; and calculating the energy control factor by using the tonality of the high-frequency band of the input signal and the tonality of the base signal.

The controlling of the extracted energy may include controlling energy of the input signal when the energy control factor is less than a predetermined threshold energy control factor.

The quantizing of the controlled energy may include selecting and quantizing a first plurality of sub vectors, and quantizing a second plurality of sub vectors different from the first plurality of sub vectors by using an interpolation error.

The quantizing of the controlled energy may include selecting the first plurality of sub vectors at a same time interval.

The quantizing of the controlled energy may include selecting candidates of the first plurality of sub vectors and performing multi-stage vector quantization using at least two stages.

According to an aspect of another exemplary embodiment, there is provided a coding method including extracting energy from an input signal in a frequency domain, based on a coding mode; controlling energy, based on the coding mode; and quantizing the energy, based on the coding mode.

According to an aspect of another exemplary embodiment, there is provided a coding method including selecting a coding mode of bandwidth extension coding by using an input signal in a frequency domain and an input signal in a time domain; and performing bandwidth extension coding by using the input signal in the frequency domain and the coding mode.

The selecting of the coding mode may further include classifying the input signal in the frequency domain by using the input signal in the frequency domain and the input signal in the time domain; and determining a coding mode of bandwidth extension coding according to the classified information, and determining a number of frequency bands according to the coding mode.

The performing of the bandwidth extension coding may further include extracting energy from the input signal in the frequency domain, based on the coding mode; controlling the extracted energy, based on the coding mode; and quantizing the controlled energy, based on the coding mode.

The extracting of the energy from the input signal may include extracting energy corresponding to a frequency band, based on the coding mode.

The controlling of the extracted energy may include controlling the energy by using an energy control factor estimated according to a base signal of the input signal in the frequency domain.

The quantizing of the controlled energy may include performing quantization to be optimized for the input signal in the frequency domain, according to the coding mode.

If the coding mode is a transient mode, the quantizing of the controlled energy may include quantizing energy of a frequency band by using a frequency weighting method.

The frequency weighting method may be a method for quantizing energy by assigning a weight to a low-frequency band of high perceptual importance.

If the coding mode is one of a normal mode and a harmonic mode, the quantizing of the controlled energy may include quantizing energy of a frequency band by using an unequal bit allocation method.

The unequal bit allocation method may be a method of quantizing energy by assigning a larger number of bits to a low-frequency band of high perceptual importance than to a high-frequency band.

The quantizing of the controlled energy may include predicting a representative value of a quantization target vector including at least two elements, and performing vector quantization on an error signal between the at least two elements of the quantization target vector and the predicted representative value.

According to an aspect of another exemplary embodiment, there is provided a decoding method including performing core decoding on a core coded input signal included in a bitstream; up-sampling the core decoded input signal; performing frequency transformation on the up-sampled input signal; and performing bandwidth extension decoding by using an input signal in a frequency domain and energy of the input signal included in the bitstream.

The performing of the bandwidth extension decoding may further include inversely quantizing the energy of the input signal; generating a base signal by using the input signal in the frequency domain; calculating a gain to be applied to the base signal by using the inversely quantized energy and energy of the base signal; and applying the gain to each of frequency bands.

The inverse quantizer selects and inversely quantizes a sub vector, interpolates the inversely quantized sub vector, and inversely quantizes the energy by adding an interpolation error to the interpolated sub vector.

The generating of the base signal may further include generating an artificial signal corresponding to a high-frequency band by copying and folding a low-frequency band of the input signal in the frequency domain; estimating an envelope of the base signal by using a window included in the bitstrearm, and applying the estimated envelope to the artificial signal.

The calculating of the gain to be applied to the base signal may include generating energy of each of sub bands through interpolation by setting sub band for applying energy smoothing, and the gain is calculated for each of the sub bands.

According to an aspect of another exemplary embodiment, there is provided a coding method including determining a coding mode of an input signal, based on characteristics of the input signal; performing code excited linear prediction (CELP) coding on a low-frequency signal of the input signal when a coding mode of the input signal is determined to be a CELP coding mode; performing time-domain (TD) extension coding on a high-frequency signal of the input signal when CELP coding is performed on the low-frequency signal of the input signal; performing frequency transformation on the input signal when the coding mode of the input signal is determined to be a frequency-domain (FD) mode; and performing FD coding on the transformed input signal.

The performing of the FD coding may include performing energy quantization by sharing a same codebook at different bitrates.

A bitstream according to a result of performing the FD coding on the transformed input signal may include previous frame mode information.

According to an aspect of another exemplary embodiment, there is provided a coding method including determining a coding mode of an input signal, based on characteristics of the input signal; extracting a linear prediction coefficient (LPC) LPC from a low-frequency signal of the input signal, and quantizing the LPC; performing code excited linear prediction (CELP) coding on an LPC excitation signal of a low-frequency signal of the input signal extracted using the LPC when a coding mode of the input signal is determined as a CELP coding mode; performing time-domain (TD) extension coding on a high-frequency signal of the input signal when CELP coding is performed on the LPC excitation signal; performing audio coding on the LPC excitation signal when a coding mode of the input signal is determined as an audio coding mode; and performing frequency-domain (FD) extension coding on the high-frequency signal of the input signal when audio coding is performed on the LPC excitation signal.

The performing of the FD extension coding may include performing energy quantization by sharing a same codebook at different bitrates.

According to an aspect of another exemplary embodiment, there is provided a decoding method including checking mode information of each of a plurality of frames included in a bitstream, performing code excited linear prediction (CELP) decoding on a CELP coded frame, based on a result of the checking; generating a decoded signal of a high-frequency band by using at least one of a result of performing the CELP decoding and an excitation signal of a low-frequency signal; performing frequency-domain (FD) decoding an FD coded frame, based on the result of the checking; and performing inverse frequency transformation on a result of performing the FD decoding.

The performing of the FD decoding may include performing inverse quantization of energy by sharing a same codebook at different bitrates.

The performing of the FD decoding may include performing the FD decoding on an FD coded frame, based on previous frame mode information included in the bitstream.

According to an aspect of another exemplary embodiment, there is provided a decoding method including checking mode information of each of a plurality of frames included in a bitstrearm, performing linear prediction coefficient (LPC) decoding on the plurality of frames included in the bitstream; performing code excited linear prediction (CELP) decoding on a CELP coded frame, based on a result of the checking; generating a decoded signal of a high-frequency band by using at least one of a result of performing the CELP decoding and an excitation signal of a low-frequency signal; performing audio decoding on an audio coded frame, based on the result of the checking; and performing frequency-domain (FD) extension decoding by using a result of performing the audio decoding.

The performing of the FD extension decoding may include performing inverse quantization of energy by sharing a same codebook at different bitrates.

According to an aspect of another exemplary embodiment, there is provided a non-transitory computer readable recording medium having recorded thereon a computer program for executing any one of the methods.

According to aspects of one or more exemplary embodiments, a bandwidth of a high-frequency band may be efficiently extended by extracting a base signal of an input signal, and controlling energy of the input signal by using a tonality of a high-frequency band of the input signal and a tonality of the base signal.

BRIEF DESCRIPTION OF THE DRAWINGS

The above and other features and advantages will become more apparent by describing in detail exemplary embodiments with reference to the attached drawings in which.

DETAILED DESCRIPTION OF EXEMPLARY EMBODIMENTS

Figure 1:
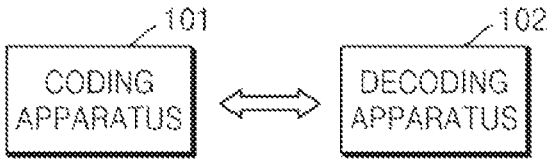
FIG. 1 is a block diagram of a coding apparatus and a decoding apparatus according to an exemplary embodiment.

Hereinafter, certain exemplary embodiments will be described in greater detail with reference to the accompanying drawings, in which like reference numerals correspond to like elements throughout.

FIG. 1 is a block diagram of a coding apparatus 101 and a decoding apparatus 102 according to an exemplary embodiment.

Referring to FIG. 1, the coding apparatus 101 may generate a base signal (or a basic signal) of an input signal and transmit the base signal to the decoding apparatus 102. The base signal is generated based on a low-frequency signal of the input signal. The base signal may be an excitation signal for high-frequency bandwidth extension since the base signal is obtained by whitening envelope information of the low-frequency signal. The decoding apparatus 102 may reconstruct the input signal from the base signal. In other words, the coding apparatus 101 and the decoding apparatus 102 perform super-wide band bandwidth extension (SWB BWE). Through the SWB BWE, a signal corresponding to a high-frequency band of 6.4 to 16 KHz, corresponding to an super-wide band (SWB), may be generated based on a decoded wide-band (WB) signal corresponding to a low-frequency band of 0 to 6.4 KHz. The 16 KHz may vary according to circumstances. The decoded WB signal may be generated by using a speech codec according to code excited linear prediction (CELP) based on a linear prediction domain (LPD) or by performing quantization in a frequency domain. An example of a method of performing quantization in a frequency domain may include advanced audio coding (AAC) based on modified discrete cosine transformation (MDCT).

Operations of the coding apparatus 101 and the decoding apparatus 102 will now be described in greater detail.

Figure 2A:
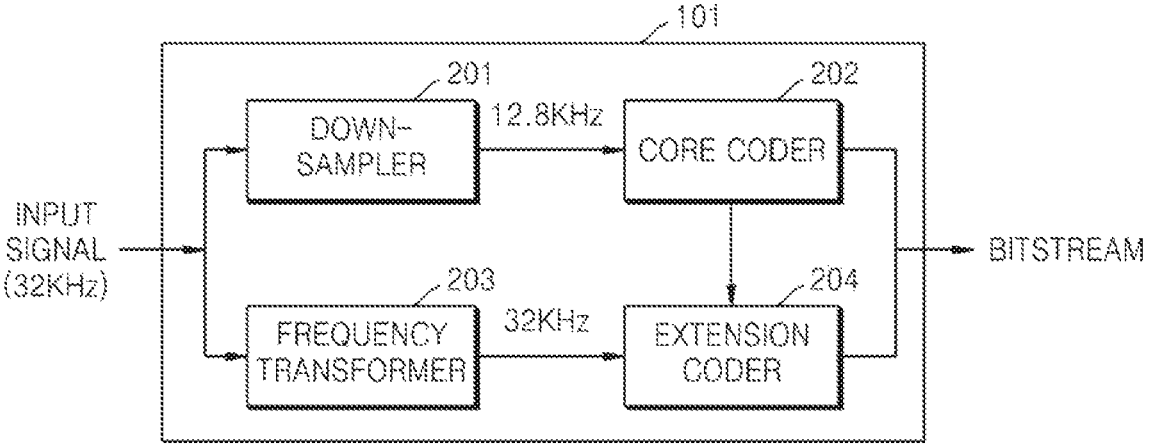
FIG. 2A is a block diagram of the structure of the coding apparatus according to an exemplary embodiment.

FIG. 2A is a block diagram of the structure of a coding apparatus 101 according to an exemplary embodiment.

Referring to FIG. 2A, the coding apparatus 101 may include a down-sampler 201, a core coder 202, a frequency transformer 203, and an extension coder 204.

For WB coding, the down-sampler 201 may down-sample an input signal. In general, the input signal, e.g., a SWB signal, has a sampling rate of 32 KHz, and is converted to a signal having a sampling rate appropriate for WB coding. For example, the down-sampler 201 may down-sample the input signal having, for example, a sampling rate of 32 KHz to a signal having, for example, a sampling rate of 12.8 KHz.

The core coder 202 may perform core coding on the down-sampled input signal. In other words, the core coder 202 may perform WB coding. For example, the core coder 202 may perform WB coding based on a CELP method.

The frequency transformer 203 may perform frequency transformation on the input signal. For example, the frequency transformer 203 may use Fast Fourier Transformation (FFT) or MDCT to perform frequency transformation on the input signal. For purposes of the following description, it is assumed that the MDCT is used.

The extension coder 204 may perform bandwidth extension coding by using a base signal of the input signal in a frequency domain. That is, the extension coder 204 may perform SWB BWE coding based on the input signal in the frequency domain. The extension coder 204 does not receive coding information, as will be described with reference to FIG. 4 below.

Figure 4:
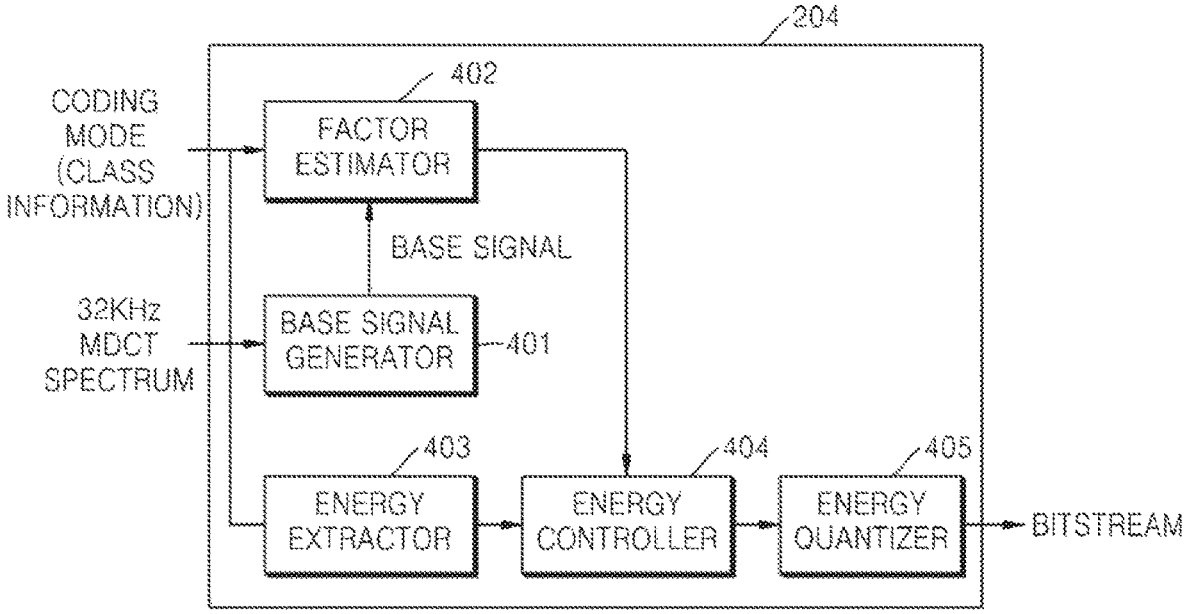
FIG. 4 is a block diagram of an extension coder included in a coding apparatus, according to an exemplary embodiment.
Figure 5:
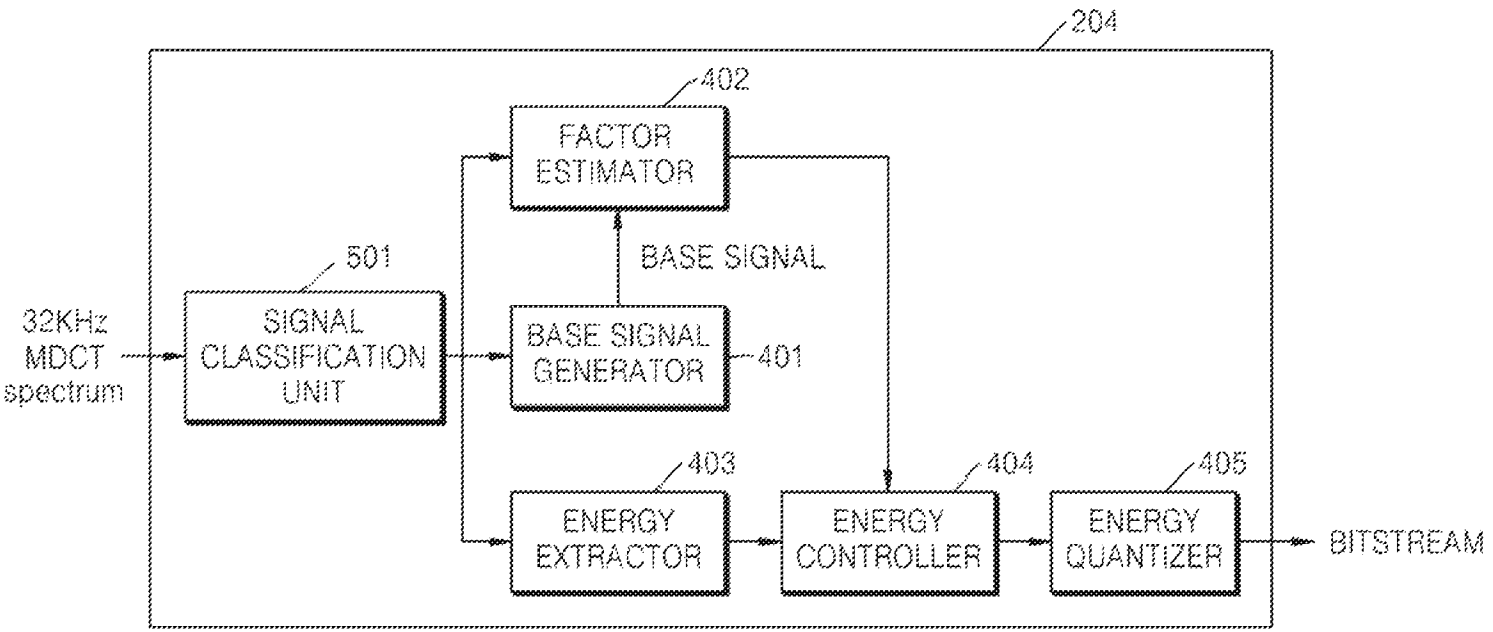
FIG. 5 is a block diagram of an extension coder included in a coding apparatus, according to another exemplary embodiment.

The extension coder 204 may perform bandwidth extension coding, based on the characteristics of the input signal and a base signal of the input signal in the frequency domain. The extension coder 204 may be embodied as illustrated in FIG. 4 or 5 according to a source of the characteristics of the input signal.

An operation of the extension coder 204 will be described in greater detail with reference to FIG. 4 and FIG. 5 below.

An upper path and lower path of FIG. 2A denote a core coding process and a bandwidth extension coding process, respectively. Energy information of the input signal may be transmitted to the decoding apparatus 102 through SWB BWE coding.

Figure 2B:
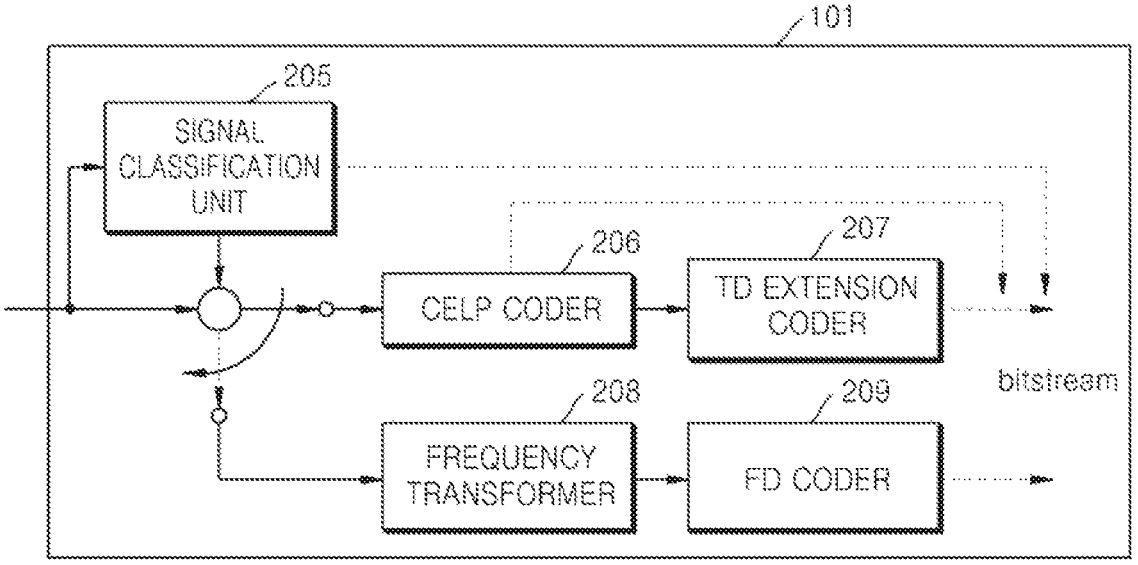
FIG. 2B is a block diagram of the structure of the coding apparatus according to another exemplary embodiment.

FIG. 2B is a block diagram of the structure of a coding apparatus 101 according to another exemplary embodiment.

Referring to FIG. 2B, the coding apparatus 101 may include a signal classification unit 205, a CELP coder 206, a time-domain (TD) extension coder 207, a frequency transformer 208, and a frequency-domain (FD) coder 209.

The signal classification unit 205 determines a coding mode of an input signal, based on the characteristics of the input signal. In the current exemplary embodiment, the coding mode may be a coding method.

For example, the signal classification unit 205 may determine a coding mode of the input signal based on time-domain characteristics and frequency-domain characteristics of the input signal. When the characteristics of the input signal is a speech signal, the signal classification unit 205 determines CELP coding to be performed on the input signal. When the characteristics of the input signal is an audio signal, the signal classification unit 205 determines FD coding to be performed on the input signal.

The input signal supplied to the signal classification unit 205 may be a signal down-sampled by a down-sampler (not shown). For example, according to the current exemplary embodiment, an input signal may be a signal having a sampling rate of 12.8 kHz or 16 kHz by re-sampling a signal having a sampling rate of 32 kHz or 48 kHz. The re-sampling may be down-sampling.

As described above with reference to FIG. 2A, a signal having a sampling rate of 32 kHz may be a SWB signal. The SWB signal may be a full-band (FB) signal. A signal having a sampling rate of 16 kHz may be a WB signal.

The signal classification unit 205 may determine a coding mode of a low-frequency signal corresponding to a low-frequency band of the input signal to be a CELP mode or an FD mode, based on the characteristics of the low-frequency signal.

If the coding mode of the input signal is determined to be the CELP mode, the CELP coder 206 performs CELP coding on the low-frequency signal of the input signal. For example, the CELP coder 206 may extract an excitation signal from the low-frequency signal of the input signal, and quantize the extracted excitation signal based on a fixed codebook contribution and an adaptive codebook contribution corresponding to pitch information.

However, the exemplary embodiments are not limited thereto, and the CELP coder 206 may further extract a linear prediction coefficient (LPC) from the low-frequency signal of the input signal, quantize the extracted LPC, and extract an excitation signal by using the quantized LPC.

According to the current exemplary embodiment, the CELP coder 206 may perform CELP coding on the low-frequency signal of the input signal according to various coding modes according to the characteristics of the low-frequency signal of the input signal. For example, the CELP coder 206 may perform CELP coding on the low-frequency signal of the input signal according to one of a voiced coding mode, an unvoiced coding mode, a transition coding mode, and a generic coding mode.

When CELP coding is performed on the low-frequency signal of the input signal, the TD extension coder 207 performs extension coding on a high-frequency signal of the input signal. For example, the TD extension coder 207 quantizes an LPC of a high-frequency signal corresponding to a high-frequency band of the input signal. The TD extension coder 207 may extract an LPC of the high-frequency signal of the input signal, and quantize the extracted LPC. Otherwise, the TD extension coder 207 may generate an LPC of the high-frequency signal of the input signal by using the excitation signal of the low-frequency signal of the input signal.

The TD extension coder 207 may be a TD high-frequency extension coder but the exemplary embodiments are not limited thereto.

If the coding mode of the input signal is determined to be the FD coding mode, the frequency transformer 208 performs frequency transformation on the input signal. For example, the frequency transformer 208 may perform frequency transformation, which includes overlapping frames (e.g., MDCT), on the input signal, but the exemplary embodiments are not limited thereto.

The FD coder 209 performs FD coding on the frequency-transformed input signal. For example, the FD coder 209 may perform FD coding on a frequency spectrum transformed by the frequency transformer 208. The FD coder 209 will be described in greater detail with reference to FIG. 2C below.

According to the current exemplary embodiment, the coding apparatus 101 may output a bitstream by coding the input signal as described above. For example, the bitstream may include a header and a payload.

The header may include coding mode information indicating the coding mode used to code the input signal. The payload may include information according to the coding mode used to code the input signal. If the input signal is coded according to the CELP mode, the payload may include CELP information and TD high-frequency extension information. If the input signal is coded according to the FD mode, the payload may include prediction data and FD information.

In the bitstream according to the current exemplary embodiment, the header may further include previous frame mode information for fixing a frame error that may occur. For example, if the coding mode of the input signal is determined to be the FD mode, the header may further include the previous frame mode information, as will be described in greater detail with reference to FIG. 25 below.

According to the current exemplary embodiment, the coding apparatus 101 is switched to use the CELP mode or the FD mode according to the characteristics of the input signal, thereby appropriately coding the input signal according to the characteristics of the input signal. The coding apparatus 101 uses the FD mode according to the determination of the signal classification unit 205, thereby appropriately performing coding in a high bitrate environment.

Figure 2C:
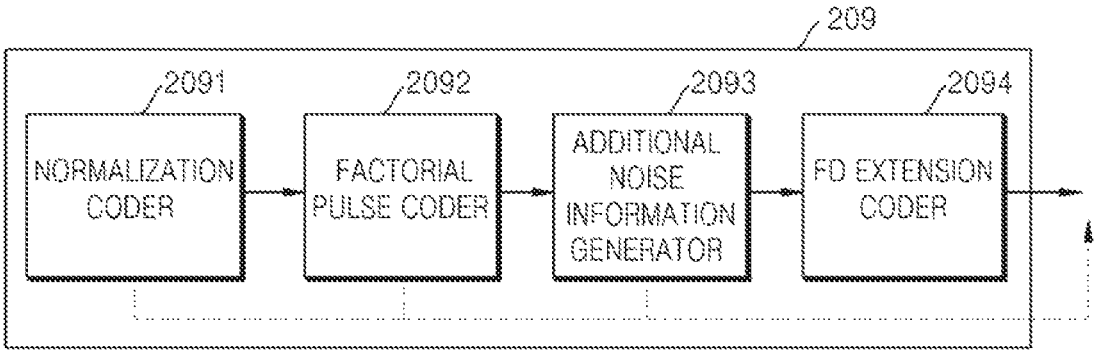
FIG. 2C is a block diagram of a frequency-domain (FD) coder included in a coding apparatus, according to an exemplary embodiment.

FIG. 2C is a block diagram of the FD coder 209 according to an exemplary embodiment.

Referring to FIG. 2C, the FD coder 209 may include a normalization coder 2091, a factorial pulse coder 2092, an additional noise information generator 2093, and an FD extension coder 2094.

The normalization coder 2091 extracts energy from each frequency band of an input signal transformed by the frequency transformer 208, and quantizes the extracted energy. The normalization coder 2091 may also perform scaling based on the extracted energy. The scaled energy value may be quantized. For example, the energy value according to the current exemplary embodiment may be obtained by using a measurement method for measuring energy or power having a proportion relationship with the energy of a frequency band.

Normalized information that is a result of quantization performed by the normalization coder 2091 may be included in a bitstream and transmitted together with the bitstream to the decoding apparatus 102.

For example, the normalization coder 2091 divides a frequency spectrum corresponding to the input signal into a predetermined number of frequency bands, extracts energy from the frequency spectrum for each frequency band, and quantizes the extracted energies. The quantized value may be used to normalize the frequency spectrum.

The normalization coder 2091 may further code the quantized value.

The factorial pulse coder 2092 may perform factorial pulse coding (FPC) on a value obtained by scaling the transformed input signal by using a quantized normalization value. In other words, the factorial pulse coder 2092 may perform FPC on a spectrum value normalized by the normalization coder 2091.

For example, the factorial pulse coder 2092 assigns a number of bits available to each frequency band, and performs FPC on the normalized spectrum value according to the assigned number of bits. The number of bits assigned to each frequency band may be determined according to a target bitrate. The factorial pulse coder 2092 may calculate the number of bits to be assigned to each frequency band by using a normalization coding value quantized by the normalization coder 2091. The factorial pulse coder 2092 may perform FPC on a frequency-transformed spectrum other than a normalized spectrum.

The additional noise information generator 2093 generates additional noise information according to performing of the FPC. For example, the additional noise information generator 2093 generates an appropriate noise level, based on a result of performing FPC on a frequency spectrum by the factorial pulse coder 2092.

The additional noise information generated by the additional noise information generator 2093 may be included in a bitstream so that a decoding side may refer to the additional noise information to perform noise filling.

The FD extension coder 2094 performs extension coding on a high-frequency signal of the input signal. More specifically, the FD extension coder 2094 performs high-frequency extension by using a low-frequency spectrum.

For example, the FD extension coder 2094 quantizes frequency domain energy information of a high-frequency signal corresponding to a high-frequency band of the input signal. The FD extension coder 2094 may divide a frequency spectrum corresponding to the input signal into a predetermined number of frequency bands, obtain an energy value from the frequency spectrum for each frequency band, and perform multi-stage vector quantization (MSVQ) by using the energy value. The MSVQ may be multi-stage vector quantization.

The FD extension coder 2094 may perform vector quantization (VQ) by collecting energy information of odd-numbered frequency bands from among the predetermined number of frequency bands, obtain a predicted error in an even-numbered frequency band, based on a quantized value according to a result of the vector quantization, and perform vector quantization on the obtained predicted error in a next stage.

However, the exemplary embodiments are not limited thereto, and the FD extension coder 2094 may perform vector quantization by collecting energy information of even-numbered frequency bands from among the predetermined number of frequency bands and obtain a predicted error in an odd-numbered frequency band by using a quantized value according to a result of the vector quantization.

The FD extension coder 2094 obtains a predicted error in an $(n+1)^{th}$ frequency band from a quantized value obtained by performing vector quantization on an $n^{th}$ frequency band and a quantized value obtained by performing vector quantization on an $(n+2)^{th}$ frequency band. Here, 'n' denotes a natural number.

In order to perform vector quantization by collecting energy information, the FD extension coder 2094 may simulate a method of generating an excitation signal in a predetermined frequency band, and may control energy when characteristics of the excitation signal according to a result of the simulation is different from characteristics of the original signal in the predetermined frequency band. The characteristics of the excitation signal, according to the result of the simulation, and the characteristics of the original signal may include at least one of a tonality and a noisiness factor, but exemplary embodiments are not limited thereto. Thus, it is possible to prevent noise from increasing when a decoding side decodes actual energy.

The FD extension coder 2094 may use multi-mode bandwidth extension that uses various methods of generating an excitation signal according to characteristics of a high-frequency signal of the input signal. For example, the FD extension coder 2094 may use one of a normal mode, a harmonic mode, and a noise mode for each frame to generate an excitation signal, according to the characteristics of the input signal.

According to the current exemplary embodiment, the FD extension coder 2094 may generate a signal of a frequency band that varies according to a bitrate. That is, a high-frequency band corresponding to a high-frequency signal on which the FD extension coder 2094 performs extension coding may be set differently according to a bitrate.

For example, the FD extension coder 2094 may be used to generate a signal corresponding to a frequency band of about 6.4 to 14.4 kHz, at a bitrate of 16 kbps, and to generate a signal corresponding to a frequency band of about 8 to 16 kHz, at a bitrate that is equal to or greater than 16 kbps. The FD extension coder 2094 may also perform extension coding on a high-frequency signal corresponding to a frequency band of about 6.4 to 14.4 kHz, at a bitrate of 16 kbps, and perform extension coding on a high-frequency signal corresponding to a frequency band of about 8 to 16 kHz, at a bitrate that is equal to or greater than 16 kbps.

According to the current exemplary embodiment, the FD extension coder 2094 may perform energy quantization by sharing the same codebook at different bitrates, as will be described in greater detail with reference to FIG. 26 below.

If a stationary frame is input to the FD coder 209, the normalization coder 2091, the factorial pulse coder 2092, the additional noise information generator 2093, and the FD extension coder 2094 of the FD coder 209 may operate.

However, when a transient frame is input, the FD extension coder 2094 may not operate. The normalization coder 2091 and the factorial pulse coder 2092 may set a higher upper band value Fcore of a frequency band on which FPC is to be performed than when a stationary frame is input. The upper band value Fcore will be described in greater detail with reference to FIG. 27 below.

Figure 2D:
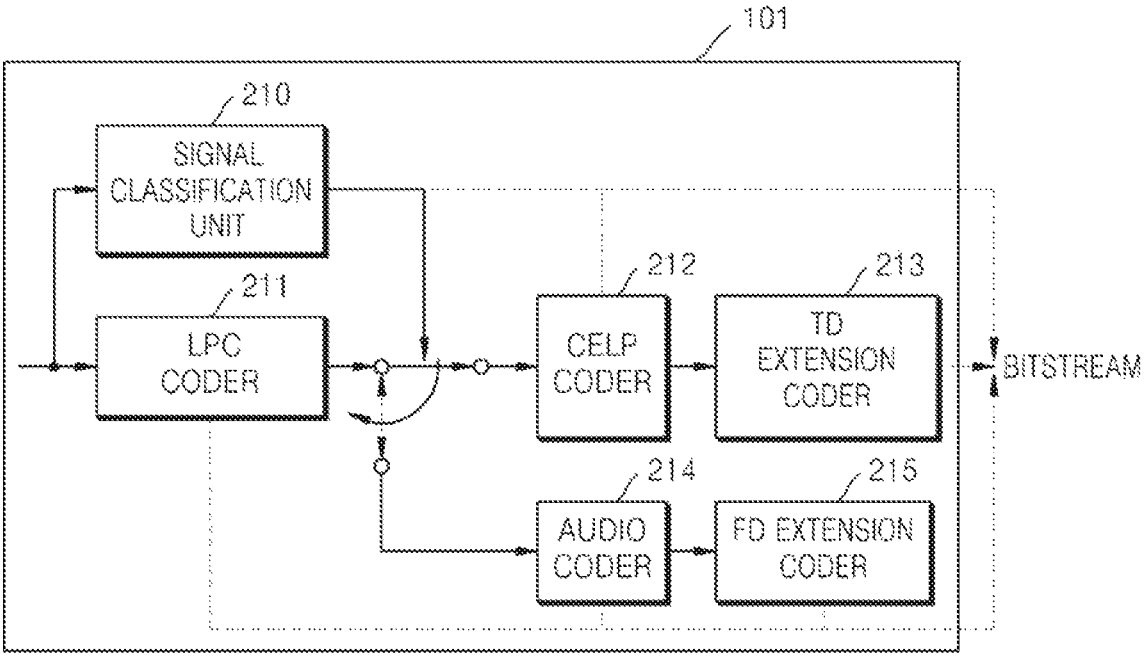
FIG. 2D is a block diagram of the structure of a coding apparatus according to another exemplary embodiment.

FIG. 2D is a block diagram of the structure of a coding apparatus 101 according to another exemplary embodiment.

Referring to FIG. 2D, the coding apparatus 101 may include a signal classification unit 210, an LPC coder 211, a CELP coder 212, a TD extension coder 213, an audio coder 214, and an FD extension coder 215.

The signal classification unit 210 determines a coding mode of an input signal according to the characteristics of the input signal. According to the current exemplary embodiment, the coding mode may be a coding method.

For example, the signal classification unit 210 determines a coding mode of the input signal based on time domain characteristics and frequency domain characteristics of the input signal. The signal classification unit 205 may determine CELP coding to be performed on the input signal when the characteristics of the input signal is a speech signal, and determine audio coding to be performed on the input signal when the characteristics of the input signal is an audio signal.

The LPC coder 211 extracts an LPC from a low-frequency signal of the input signal, and quantizes the LPC. For example, according to the current exemplary embodiment, the LPC coder 211 may use trellis coded quantization (TCQ), MSVQ, or lattice vector quantization (LVQ) to quantize the LPC, but the exemplary embodiments are not limited thereto.

For example, LPC coder 211 may re-sample an input signal having a sampling rate of 32 kHz or 48 kHz to extract an LPC from a low-frequency signal of the input signal having a sampling rate of 12.8 kHz or 16 kHz.

As described above with reference to FIGS. 2A and 2B, a signal having a sampling rate of 32 kHz may be an SWB signal. The SWB signal may be an FB signal. A signal having a sampling rate of 16 kHz may be a WB signal.

The LPC coder 211 may further extract an LPC excitation signal by using the quantized LPC, but the exemplary embodiments are not limited thereto.

If the coding mode of the input signal is determined to be the CELP mode, the CELP coder 212 performs CELP coding on the LPC excitation signal extracted using the LPC. For example, the CELP coder 212 may quantize the LPC excitation signal based on a fixed codebook contribution and an adaptive codebook contribution corresponding to pitch information. The LPC excitation signal may be generated by at least one of the CELP coder 212 and the LPC coder 211.

According to the current exemplary embodiment, the CELP coder 212 may also perform CELP coding according to various coding modes according to the characteristics of the low-frequency signal of the input signal. For example, the CELP coder 206 may perform CELP coding on the low-frequency signal of the input signal by using one of the voiced coding mode, the unvoiced coding mode, the transition coding mode, or the generic coding mode.

The TD extension coder 213 performs extension coding on the high-frequency signal of the input signal when CELP coding is performed on the LPC excitation signal of low-frequency signal of the input signal.

For example, the TD extension coder 213 quantizes an LPC of the high-frequency signal of the input signal. The TD extension coder 213 may extract an LPC of the high-frequency signal of the input signal by using the LPC excitation signal of the low-frequency signal of the input signal.

The TD extension coder 213 may be a TD high-frequency extension coder, but the exemplary embodiments are not limited thereto.

If the coding mode of the input signal is determined to be an audio coding mode, the audio coder 214 performs audio coding on the LPC excitation signal extracted using the LPC.

For example, the audio coder 214 may perform frequency transformation on the LPC excitation signal and quantize the transformed LPC excitation signal.

When the audio coder 214 performs the frequency transformation, the audio coder 214 may use a frequency transformation method which does not include overlapping frames (e.g., a discrete cosine transformation (DCT)). The audio coder 214 may also perform quantization on a frequency-transformed excitation signal spectrum according to FPC or lattice VQ (LVQ).

If the audio coder 214 has spare bits to perform quantization on the LPC excitation signal, the audio coder 214 may further quantize the LPC excitation signal based on TD coding information of a fixed codebook contribution and an adaptive codebook contribution.

When audio coding is performed on the LPC excitation signal of the low-frequency signal of the input signal, the FD extension coder 215 performs extension coding on the high-frequency signal of the input signal. In other words, the FD extension coder 215 may perform high-frequency extension by using a low-frequency spectrum, For example, the FD extension coder 215 performs quantization on frequency domain energy information of a high-frequency signal corresponding to a high-frequency band of the input signal. The FD extension coder 215 may generate a frequency spectrum by using a frequency transformation method, e.g., MDCT, divide the frequency spectrum into a predetermined number of frequency bands, obtain energy of the frequency spectrum for each frequency band, and perform MSVQ by using the energy. Here, MSVQ may be multi-stage vector quantization.

The FD extension coder 215 may perform vector quantization by collecting energy information of odd-numbered frequency bands from among the predetermined number of frequency bands, obtain a predicted error in an even-numbered frequency band, based on a quantized value according to a result of the vector quantization, and perform vector quantization on a predicted error in a next stage.

However, the exemplary embodiments are not limited thereto, and the FD extension coder 215 may perform vector quantization by collecting energy information of even-numbered frequency bands from among the predetermined number of frequency bands and obtain a predicted error in an odd-numbered frequency band by using a quantized value according to a result of the vector quantization.

The FD extension coder 215 obtains a predicted error in an $(n+1)^{th}$ frequency band by using a quantized value obtained by performing vector quantization on an $n^{th}$ frequency band and a quantized value obtained by performing vector quantization on an $(n^{+}2)^{th}$ frequency band. Here, 'n' denotes a natural number.

In order to perform vector quantization by collecting energy information, the FD extension coder 215 may simulate a method of generating an excitation signal in a predetermined frequency band, and may control energy when characteristics of the excitation signal according to a result of the simulation is different from characteristics of the original signal in the predetermined frequency band. The characteristics of the excitation signal according to the result of the simulation and the characteristics of the original signal may include at least one of a tonality and a noisiness factor, but the exemplary embodiments are not limited thereto. Thus, it is possible to prevent noise from increasing when a decoding side decodes actual energy.

The FD extension coder 215 may use multi-mode bandwidth extension that uses various methods of generating an excitation signal according to the characteristics of the high-frequency signal of the input signal. For example, the FD extension coder 215 may generate an excitation signal by using one of the normal mode, the harmonic mode, the transient mode, or the noise mode for each frame according to the characteristics of the input signal. In the transient mode, temporal envelope information may also be quantized.

According to the current exemplary embodiment, the FD extension coder 215 may generate a signal of a frequency band that varies according to a bitrate. In other words, a high-frequency band corresponding to a high-frequency signal on which the FD extension coder 215 performs extension coding may be set differently according to a bitrate.

For example, the FD extension coder 215 may be used to generate a signal corresponding to a frequency band of about 6.4 to 14.4 kHz, at a bitrate of 16 kbps, and to generate a signal corresponding to a frequency band of about 8 to 16 kHz, at a bitrate that is equal to or greater than 16 kbps. The FD extension coder 215 may also perform extension coding on a high-frequency signal corresponding to a frequency band of about 6.4 to 14.4 kHz, at a bitrate of 16 kbps, and perform extension coding on a high-frequency signal corresponding to a frequency band of about 8 to 16 kHz, at a bitrate that is equal to or greater than 16 kbps.

According to the current exemplary embodiment, the FD extension coder 215 may perform energy quantization by sharing the same codebook at different bitrates, as will be described in greater detail with reference to FIG. 26 below.

In the current exemplary embodiment, the coding apparatus 101 may code the input signal as described above and output the input signal in the form of a coded bitstream. For example, the bitstream includes a header and a payload.

The header may include coding mode information indicating a coding mode used to code the input signal. The payload may include CELP information and TD high-frequency extension information when the input signal is coded by using the CELP mode. The payload may include prediction data, audio coding information, and FD high-frequency extension information when the input signal is coded by using the audio coding mode.

The coding apparatus 101 may be switched to use the CELP mode or the audio coding mode according to the characteristics of the input signal. Thus, an appropriate coding mode may be performed according to the characteristics of the input signal. Furthermore, the coding apparatus 101 may use the FD mode according to the determination of the signal classification unit 210, thereby appropriately performing coding in a low bitrate environment.

Figure 3:
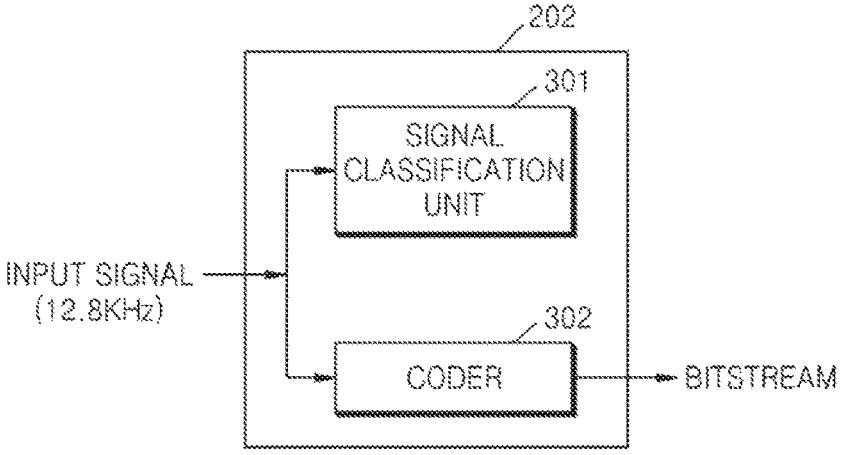
FIG. 3 is a block diagram of a core coder included in a coding apparatus, according to an exemplary embodiment.

FIG. 3 is a block diagram of the core coder 202 of the coding apparatus 101 according to an exemplary embodiment.

Referring to FIG. 3, the core coder 202 may include a signal classification unit 301 and a coder 302.

The signal classification unit 301 may classify characteristics of a down-sampled input signal, for example, 12.8 KHz. In other words, the signal classification unit 301 may classify coding modes of an input signal as various coding modes, according to the characteristics of the input signal. For example, according to an ITU-T G.718 codec, the signal classification unit 301 may classify coding modes of speech signals as the voiced coding mode, the unvoiced coding mode, the transition coding mode, and the generic coding mode. The unvoiced coding mode is designed to code unvoiced frames and most inactive frames.

The coder 302 may perform coding optimized to the characteristics of the input signal classified by the signal classification unit 301.

FIG. 4 is a block diagram of the extension coder 204 of the coding apparatus 101, according to an exemplary embodiment.

Referring to FIG. 4, the extension coder 204 may include a base signal generator 401, a factor estimator 402, an energy extractor 403, an energy controller 404, and an energy quantizer 405. The extension coder 204 may estimate an energy control factor without receiving information about a coding mode. The extension coder 204 may also estimate an energy control factor by using a coding mode. The information about the coding mode may be received from the core coder 202.

The base signal generator 401 may generate a base signal of an input signal by using a frequency spectrum of the input signal in a frequency domain. The base signal indicates a signal for performing SWB BWE, based on a WB signal. In other words, the base signal indicates a signal that constitutes a fine structure of a low-frequency band. A process of generating the base signal will be described in greater detail with reference to FIG. 6 below.

The factor estimator 402 may estimate an energy control factor by using the base signal. That is, the coding apparatus 101 transmits energy information of the input signal to generate a signal of an SWB region in the decoding apparatus 102. The factor estimator 402 may estimate an energy control factor which is a parameter for controlling energy information from a perceptual viewpoint. A process of estimating the energy control factor will be described in greater detail with reference to FIG. 7 below.

The factor estimator 402 may estimate the energy control factor by using the characteristics of the base signal and the input signal. The characteristics of the input signal may be received from the core coder 202.

The energy extractor 403 may extract energy from an input signal in a frequency band. The extracted energy is transmitted to the decoding apparatus 102. Energy may be extracted in each frequency band.

The energy controller 404 may control the energy extracted from the input signal, by using the energy control factor. In other words, the energy controller 404 may control energy by applying the energy control factor to energy extracted in each frequency band.

The energy quantizer 405 may quantize the controlled energy. Energy may be converted to a dB scale and then be quantized. Specifically, the energy quantizer 405 may calculate a global energy, which is a total energy, and scalar-quantize the global energy and the differences between the global energy and the energy extracted in each frequency band. Alternatively, energy extracted from a first frequency band is directly quantized, and then the difference between energy extracted in each of the frequency bands, other than the first frequency band, and energy extracted in a preceding frequency band may be quantized. Otherwise, the energy quantizer 405 may directly quantize the energy extracted in each frequency band without using the differences between energies extracted in frequency bands. When the energy extracted in each frequency band is directly quantized, scalar or vector quantization may be used. The energy quantizer 405 will be described in greater detail with reference to FIGS. 8 and 9 below.

FIG. 5 is a block diagram of the extension coder 204 of the coding apparatus 101, according to another exemplary embodiment.

Referring to FIG. 5, the extension coder 204 may further include a signal classification unit 501, as compared to the extension coder 204 of FIG. 4. A factor estimator 402 may estimate an energy control factor by using characteristics of a base signal and an input signal. The characteristics of the input signal may be received from the signal classification unit 501 rather than from the core coder 202.

The signal classification unit 501 may classify an input signal (e.g., 32 KHz and an MDCT spectrum), according to the characteristics of the input signal. The signal classification unit 501 may classify coding modes of the input signal as various coding modes, based on the characteristics of the input signals.

By classifying the input signal according to characteristics of the input signal, the energy control factor may be estimated only from signals appropriate for performing an energy control factor estimation process, and may control energy. For example, it may not be appropriate to perform the energy control factor estimation process on a signal containing no tonal component, e.g., a noise signal or an unvoiced signal. If a coding mode of an input signal is classified as the unvoiced coding mode, the extension coder 204 may perform bandwidth extension coding without performing energy control factor estimation.

The base signal generator 401, the factor estimator 402, the energy extractor 403, the energy controller 404, and the energy quantizer 405 illustrated in FIG. 5 are as described above with reference to FIG. 4.

Figure 6:
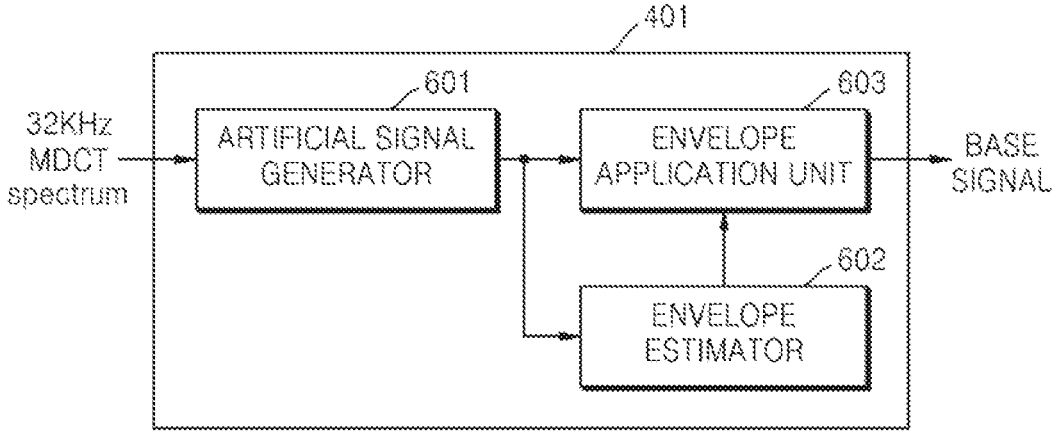
FIG. 6 is a block diagram of a base signal generator included in the extension coder, according to an exemplary embodiment.

FIG. 6 is a block diagram of the base signal generator 401 included in the extension coder 204, according to an exemplary embodiment.

Referring to FIG. 6, the base signal generator 401 may include an artificial signal generator 601, an envelope estimator 602, and an envelope application unit 603.

The artificial signal generator 601 may generate an artificial signal corresponding to a high-frequency band by copying and folding a low-frequency band of an input signal in a frequency band. In other words, the artificial signal generator 601 may generate an artificial signal in an SWB domain region by copying a low-frequency spectrum of the input signal in the frequency domain. A process of generating the artificial signal will be described in greater detail with reference to FIG. 6 below.

The envelope estimator 602 may estimate an envelope of a base signal by using a window. The envelope of the base signal may be used to eliminate envelope information about a low-frequency band included in a frequency spectrum of the artificial signal in the SWB region. An envelope of a particular frequency index may be determined by using frequency spectrums before and after the particular frequency. The envelope of the base signal may also be estimated through a moving average. For example, if MDCT is used for frequency transformation, the envelope of the base signal may be estimated through an absolute value of the frequency spectrum which is MDCT transformed.

The envelope estimator 602 may form whitening bands, calculate an average of frequency magnitudes in each of the whitening bands, and estimate the average of frequency magnitudes of a whitening band as an envelope of frequencies belonging to the whitening band. A number of frequency spectrums belonging to the whitening band may be set to be less than a number of bands from which energy is extracted.

If the average of frequency magnitudes calculated in each of the whitening bands are estimated as an envelope of a frequency belonging to the whitening band, the envelope estimator 602 may transmit information indicating whether the number of frequency spectrums belonging to the whitening bands is large or small so as to control a degree of flatness of the base signal. For example, the envelope estimator 602 may transmit such information depending on if the number of frequency spectrums is eight or three. If the number of frequency spectrums is three, the degree of flatness of the base signal may be higher than when the number of frequency spectrums is eight.

Otherwise, the envelope estimator 602 may not transmit the information indicating whether the number of frequency spectrums belonging to the whitening bands is large or small, and may determine the degree of flatness of the base signal according to a coding mode employed by the core coder 202. The core coder 202 may classify a coding mode of an input signal as the voiced coding mode, the unvoiced coding mode, the transient coding mode, or the generic coding mode based on the characteristics of the input signal, and may code the input signal.

The envelope estimator 602 may control a number of frequency spectrums belonging to the whitening bands, based on a coding mode according to the characteristics of the input signal. For example, if the input signal is coded according to the voiced coding mode, the envelope estimator 602 may estimate an envelope of the base signal by forming three frequency spectrums in the whitening band. If the input signal is coded according to a coding mode other than the voiced coding mode, the envelope estimator 602 may estimate an envelope of the base signal by forming three frequency spectrums in the whitening band.

The envelope application unit 603 may apply the estimated envelope to the artificial signal. This process corresponds to to a whitening process. The artificial signal may be flattened by the envelope. The envelope application unit 603 may generate a base signal by dividing the artificial signal according to envelope of each of frequency indexes.

Figure 7:
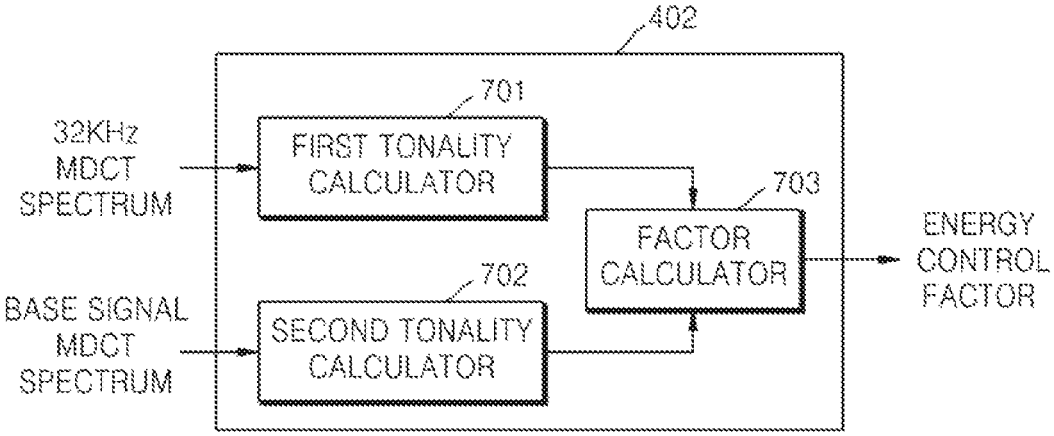
FIG. 7 is a block diagram of a factor estimator included in the extension coder, according to an exemplary embodiment.

FIG. 7 is a block diagram of the factor estimator 402 included in the extension coder 204, according to an exemplary embodiment.

Referring to FIG. 7, the factor estimator 402 may include a first tonality calculator 701, a second tonality calculator 702, and a factor calculator 703.

The first tonality calculator 701 may calculate a tonality of a high-frequency band of an input signal in a frequency domain. In other words, the first tonality calculator 701 may calculate a tonality of an SWB region, which is a high-frequency band of an input signal in a frequency domain.

The second tonality calculator 702 may calculate a tonality of a base signal.

The tonalities may be calculated by measuring spectral flatness. The tonalities may be calculated by using Equation (1) below. The spectral flatness may be measured using the relation between a geometric mean and arithmetic mean of the frequency spectrum.

$$T = \min\left(10 \times \log 10\left(\frac{\prod_{k=0}^{N-1} |S(k)|^{\frac{1}{N}}}{\frac{1}{N}\sum_{k=0}^{N-1} |S(k)|}\right) / r,\ 0.999\right)$$

T: tonality, S(k): spectrum,

N: length of spectral coefficients, r: constant

The factor calculator 703 may calculate an energy control factor by using the tonality of the high-frequency band of the input signal and the tonality of the base signal. The energy control factor may be calculated by using Equation (2):

$$\alpha = \frac{N_0}{N_b} = \frac{(1 - T_0)}{(1 - T_b)}$$

$T_0$: tonality of original spectrum, $T_b$: tonality of base spectrum, $N_0$: noisiness factor of original spectrum, $N_b$: noisiness factor of base spectrum, where 'α' denotes the energy control factor, 'To' denotes the tonality of the input signal, and 'Tb' denotes the tonality of the base signal. 'Nb' denotes a noisiness factor that indicates a degree of containing a noise component in a signal.

The energy control factor may be calculated by using Equation (3):

$$\alpha = \frac{T_b}{T_o}$$

The factor calculator 703 may calculate an energy control factor for each frequency band. The calculated energy control factor may be applied to the energy of the input signal. The energy control factor may be applied to the energy of the input signal when the energy control factor is less than a predetermined threshold energy control factor.

Figure 8:
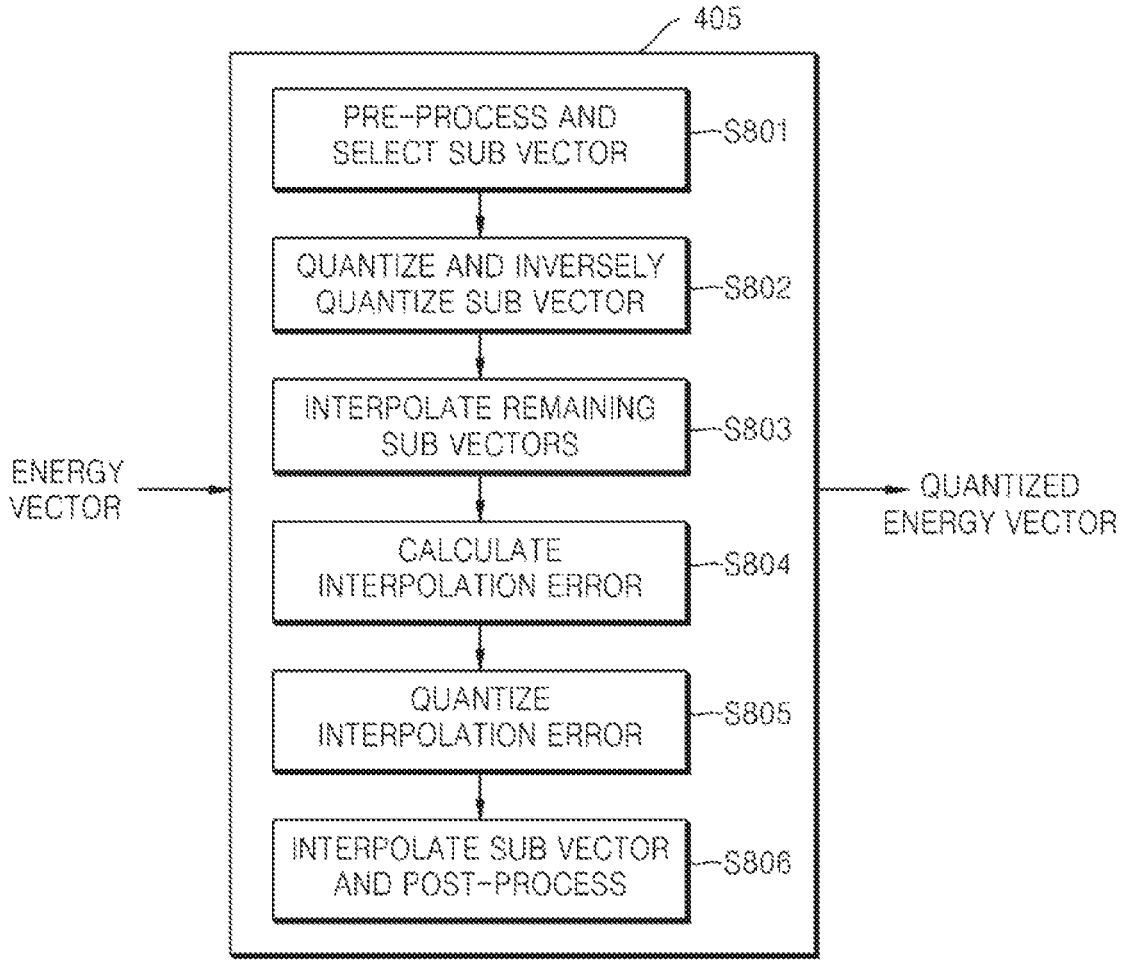
FIG. 8 is a flowchart illustrating an operation of an energy quantizer according to an exemplary embodiment.

FIG. 8 is a flowchart illustrating an operation of the energy quantizer 405 according to an exemplary embodiment.

In operation S801, the energy quantizer 405 may pre-process energy vectors by using an energy control factor and select a sub vector of the pre-processed energy vector. For example, the energy quantizer 405 may subtract an average of the energy vectors from each of the energy vectors or calculate a weight regarding importance of each of the energy vectors. The weight may be calculated in such a manner that the quality of a synthetic sound may be maximized.

The energy quantizer 405 may also select an appropriate sub vector of the energy vector based on coding efficiency. The energy quantizer 405 may also select a sub vector at the same time interval to improve interpolation efficiency.

For example, the energy quantizer 405 may select the sub vector according to Equation (4) below.

$$k \times n (n=0, \ldots, N), k \geq 2, N \text{ denotes a largest integer that is less than a vector dimension} \quad (4)$$

If k=2, then only even numbers are selected.

In operation S802, the energy quantizer 405 quantizes and inversely quantizes the selected sub vector. The energy quantizer 405 may quantize the sub vector by selecting a quantization index for minimizing a mean square error (MSE) calculated by using Equation (5) below.

$$MSE: d[x, y] = \frac{1}{N}\sum_{k=1}^{N}[x_k - y_k]^2$$

The energy quantizer 405 may quantize the sub vector by using scalar quantization, vector quantization, TCQ, or LVQ. In vector quantization, MSVQ or split VQ may be performed or split VQ and multi-stage VQ may be simultaneously performed. The quantization index is transmitted to the decoding apparatus 102.

When the weights are calculated during the pre-processing, the energy quantizer 405 may calculate an optimized quantization index by using a weighted MSE (WMSE). The WMSE may be calculated by using Equation (6) below:

$$WMSE: d[x, y] = \frac{1}{N}\sum_{k=1}^{N} w_k[x_k - y_k]^2$$

In operation S803, the energy quantizer 405 may interpolate the remaining sub vectors which are not selected.

In operation S804, the energy quantizer 405 may calculate interpolation errors that are the differences between the interpolated remaining sub vectors and the original sub vectors that match the energy vectors.

In operation S805, the energy quantizer 405 quantizes and inversely quantizes the interpolation error. The energy quantizer 405 may quantize the interpolation error by using the quantization index for minimizing the MSE. The energy quantizer 405 may quantize the interpolation error by using scalar quantization, vector quantization, TCQ, or LVQ. In vector quantization, MSVQ or split VQ may be performed or split VQ and MSVQ may be simultaneously performed. If the weights are calculated during the pre-processing, the energy quantizer 405 may calculate an optimized quantization index by using a WMSE.

In operation S806, the energy quantizer 405 may calculate the remaining sub vectors which are not selected by interpolating the quantized sub vectors which are selected, and calculate a quantized energy value by adding the quantized interpolation errors calculated in operation S805. The energy quantizer 405 may calculate a final quantized energy by re-adding the average, which is subtracted in the pre-processing, during the pre-processing.

In MSVQ, the energy quantizer 405 performs quantization by using K sub vector candidates to improve the performance of quantization based on the same codebook. If 'K' is equal to or greater than '2', the energy quantizer 405 may determine optimum sub vector candidates by performing distortion measurement. Distortion measurement may be determined according to one of the following two methods.

First, the energy quantizer 405 may generate an index set to minimize MSEs or WMSEs for each of the sub vector candidates in each of the stages, and select a sub vector candidate having a smallest sum of MSEs or WMSEs in all of the stages from among the sub vector candidates. The amount of calculation is small.

Second, the energy quantizer 405 may generate an index set to minimize MSEs or WMSEs for each of sub vector candidates in each of the stages, reconstruct an energy vector through inverse quantization, and select a sub vector candidate to minimize MSE or WMSE between the reconstructed energy vector and the original energy vector. The amount of calculation is increased due to the reconstruction of the energy vector, but the performance is better since the MSEs are calculated using actually quantized values.

Figure 9:
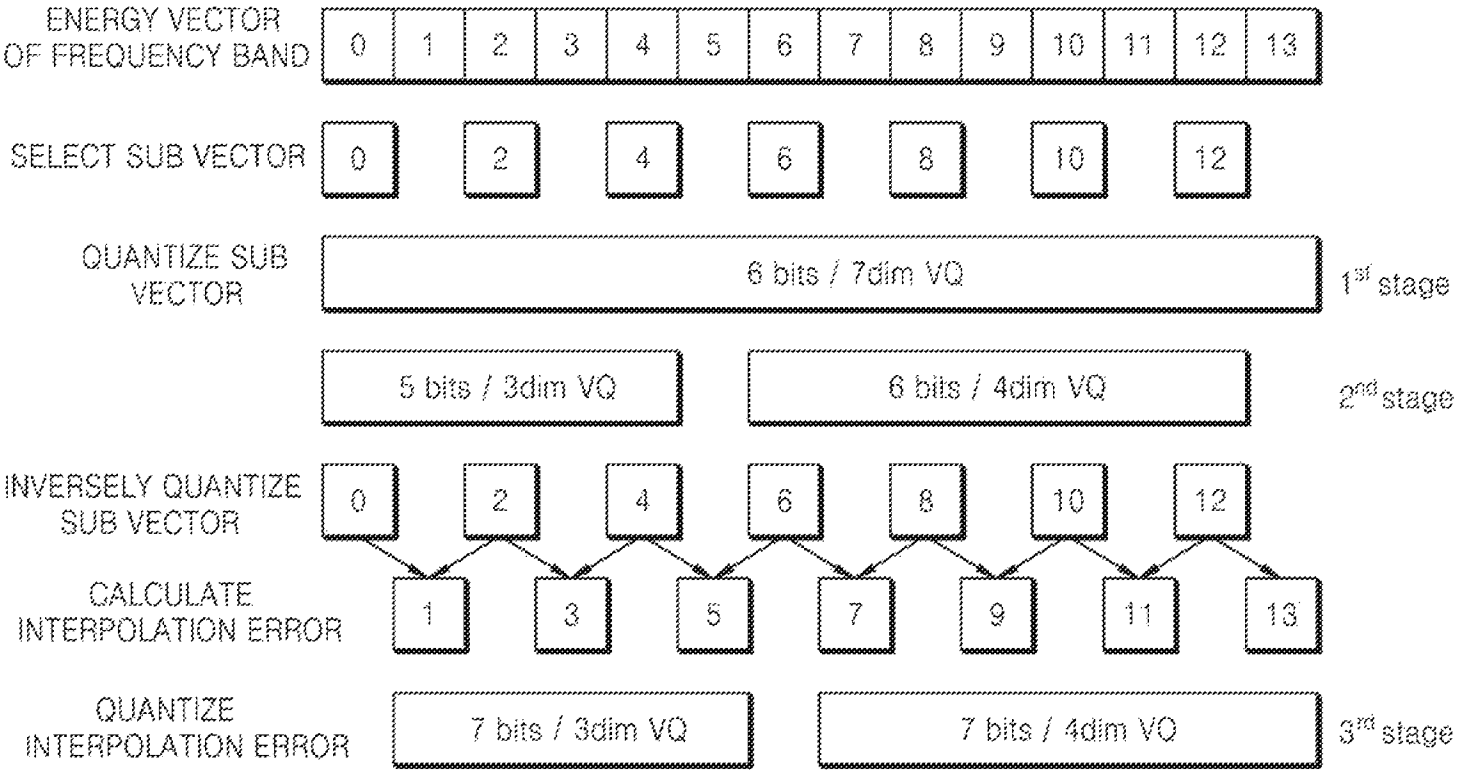
FIG. 9 is a diagram illustrating a method of quantizing energy, according to an exemplary embodiment.

FIG. 9 is a diagram illustrating a process of quantizing energy, according to an exemplary embodiment.

Referring to FIG. 9, an energy vector represents 14 dimensions. In a first stage, the energy quantizer 405 selects sub vectors corresponding to 7 dimensions by selecting even-numbered sub vectors of the energy vector. In the first stage, the energy quantizer 405 uses second stage vector quantization split into two, to improve the performance.

The energy quantizer 405 performs quantization in the second stage by using an error signal of the first stage. The energy quantizer 405 calculates an interpolation error by inversely quantizing the selected sub vectors, and quantizes the interpolation error through third stage vector quantization split into two.

Figure 10:
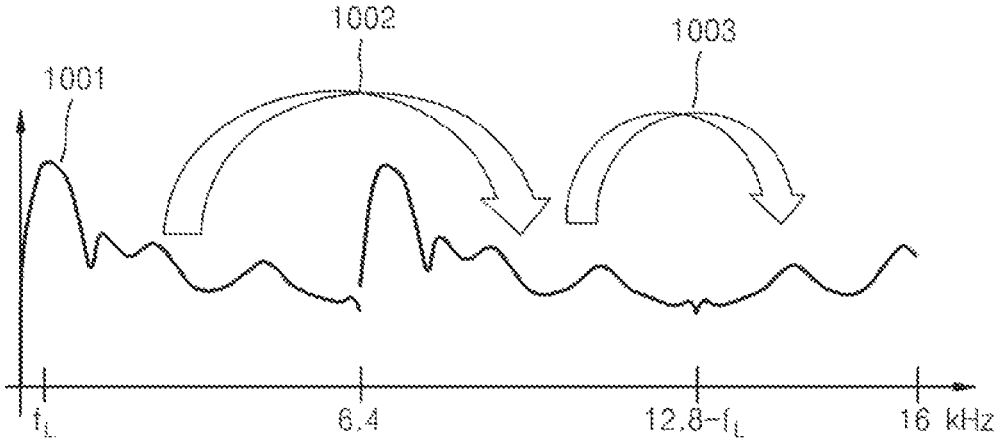
FIG. 10 is a diagram illustrating a process of generating an artificial signal, according to an exemplary embodiment.

FIG. 10 is a diagram illustrating a process of generating an artificial signal, according to an exemplary embodiment.

Referring to FIG. 10, the artificial signal generator 601 may copy a frequency spectrum 1001 corresponding to a low-frequency band from $f_L$ to 6.4 KHz of an entire frequency band. The copied frequency spectrum 1001 is shifted to a frequency band from 6.4 to 12.8-$f_L$ KHz. A frequency spectrum corresponding to the frequency band from 12.8-$f_L$ to 16 KHz may be generated by folding a frequency spectrum corresponding to the frequency band from 6.4 to 12.8-$f_L$ KHz. In other words, an artificial signal corresponding to an SWB region which is a high-frequency band is generated from 6.4 to 16 KHz.

If MDCT is performed to generate the frequency spectrum, then a correlation is present between $f_L$ and 6.4 kHz. When an MDCT frequency index corresponding to 6.4 kHz is an even number, a frequency index of $f_L$ is also an even number. In contrast, if the MDCT frequency index corresponding to 4 kHz is an odd number, the frequency index of $f_L$ is also an odd number.

For example, when MDCT is applied to extract 640 frequency spectrums from the original input signal, an index corresponding to 6.4 kHz is a $256^{th}$ (i.e., 6400/16000*640) index, that is an even number. $f_L$ is also selected as an even number. In other words, 2(50 Hz) or 4(100 Hz) may be used for $f_L$. This process may also be used during a decoding process.

Figure 11A:
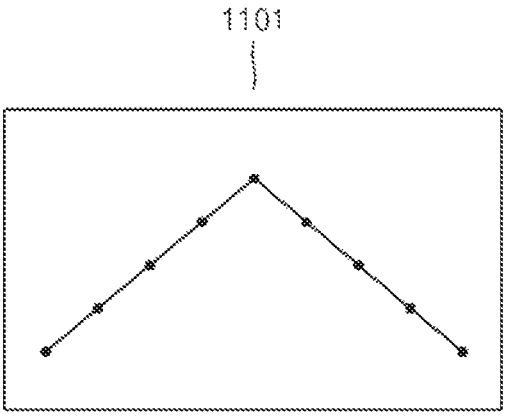
FIGS. 11A and 11B respectively illustrate windows for estimating an envelope, according to exemplary embodiments.
Figure 11B:
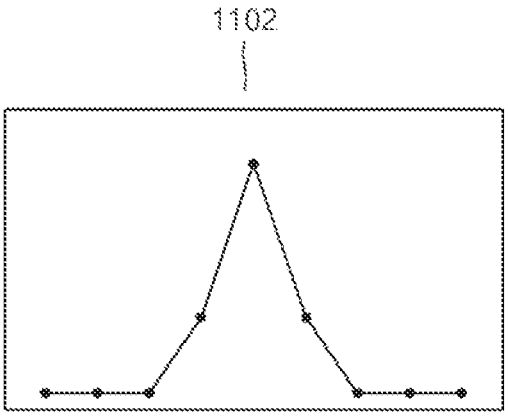

FIGS. 11A and 11B respectively illustrate windows 1101 and 1102 for estimating an envelope, according to one or more exemplary embodiments.

Referring to FIGS. 11A and 11B, a peak point on each of the windows 1101 and 1102 denotes a frequency index for estimating a current envelope. The current envelope of the base signal may be estimated by using Equation (7) below:

$$\mathrm{Env}(n)=\Sigma_{k=n-d}^{n+d} w(k-n+d)\times S(k)$$

Env(n): Envelope, w(k):window, S(k):Spectrum, n:frequency index, 2d+1: window length Referring to FIGS. 11A and 11B, the windows 1101 and 1102 may be fixedly used, wherein no additional bits need to be transmitted. If the window 1101 or 1102 is selectively used, information indicating whether the window 1101 or 1102 was used to estimate the envelope needs to be expressed with bits and be additionally transmitted to the decoding apparatus 102. The bits may be transmitted for each frequency band or may be transmitted at once in a single frame.

A weight is further added to a frequency spectrum corresponding to a current frequency index to estimate an envelope when the window 1102 is used, compared to when the window 1101 is used. Thus, the base signal generated using the window 1102 is more flat than that generated using the window 1101. The type of window from among the windows 1101 and 1102 may be selected by comparing each of the base signals generated by the window 1101 and the window 1102 with a frequency spectrum of an input signal. Alternatively, a window having a tonality that is more approximate to a tonality of a high-frequency band may be selected from among the windows 1101 and 1102 through comparison of the tonality of the high-frequency band. Otherwise, a window having a higher correlation with the high-frequency band may be selected from among the windows 1101 and 1102 through comparison of correlation.

Figure 12A:
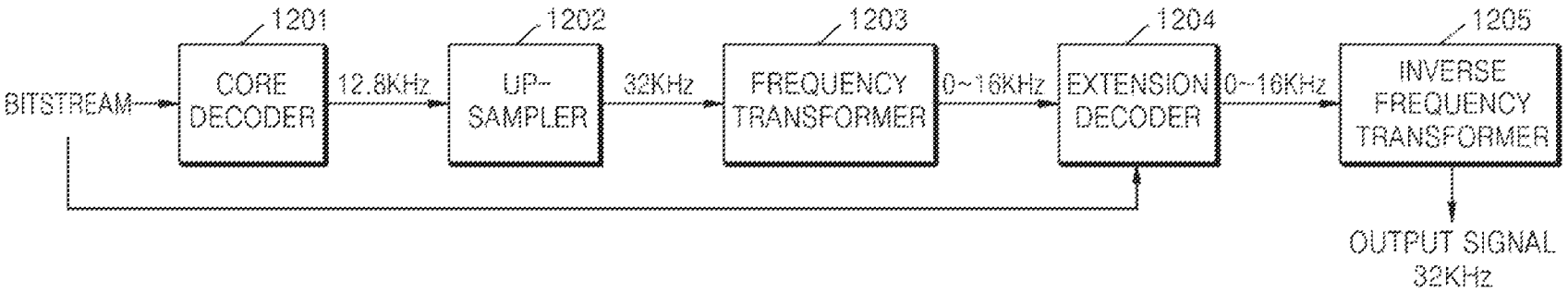
FIG. 12A is a block diagram of a decoding apparatus according to an exemplary embodiment.

FIG. 12A is a block diagram of the decoding apparatus 102 according to an exemplary embodiment.

A decoding process performed by the decoding apparatus 102 of FIG. 12A is an inverse process of the process performed by the coding apparatus 101 of FIG. 2A. Referring to FIG. 12A, the decoding apparatus 102 may include a core decoder 1201, an up-sampler 1202, a frequency transformer 1203, an extension decoder 1204, and an inverse frequency transformer 1205.

The core decoder 1201 may perform core decoding on a core-coded input signal contained in a bitstream. Through the core decoding, a signal having a sampling rate of 12.8 KHz may be extracted.

The up-sampler 1202 may up-sample the core-decoded input signal. Through the up-sampling, a signal having a sampling rate of 32 KHz may be extracted.

The frequency transformer 1203 may perform frequency transformation on the up-sampled input signal. The same frequency transformation that was used in the coding apparatus 101 may be used. For example, MDCT may be used.

The extension decoder 1204 may perform bandwidth extension decoding by using the input signal in the frequency band and energy of the input signal contained in the bitstream. An operation of the extension decoder 1204 will be described in greater detail with reference to FIG. 9 below.

The inverse frequency transformer 1205 may perform inverse frequency transformation on a result of performing bandwidth extension decoding. In other words, the inverse frequency transformation may be an inverse operation of the frequency transformation performed by the frequency transformer 1203. For example, the inverse frequency transformation may be Inverse Modified Discrete Cosine Transformation (IMDCT).

Figure 12B:
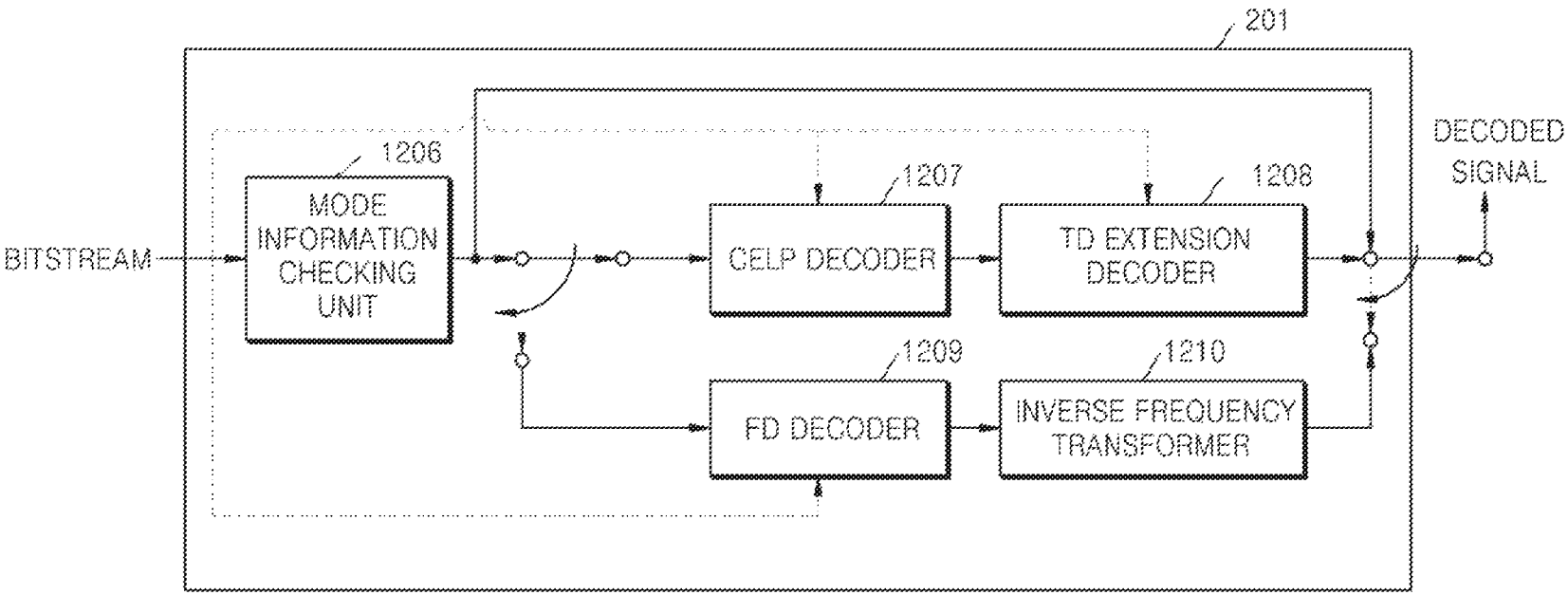
FIG. 12B is a block diagram of a decoding apparatus according to another exemplary embodiment.

FIG. 12B is a block diagram of the decoding apparatus 102 according to another exemplary embodiment.

A decoding process performed by the decoding apparatus 102 of FIG. 12B is an inverse process of the process of FIG. 12A. Referring to FIG. 12B, the decoding apparatus 102 may include a mode information checking unit 1206, a CELP decoder 1207, a TD extension decoder 1208, an FD decoder 1209, and an inverse frequency transformer 1210.

The mode information checking unit 1206 checks mode information of each of the frames included in a bitstream. The bitstream may be a signal corresponding to a bitstream according to a result of coding performed by the coding apparatus 101 transmitted to the decoding apparatus 102.

For example, the mode information checking unit 1206 parses mode information from the bitstream, and performs switching operation to one of a CELP decoding mode or an FD decoding mode according to a coding mode of a current frame according to a result of parsing.

The mode information checking unit 1206 may switch, with regard to each of frames included in the bitstream, in such a manner that a frame coded according to the CELP mode may be CELP decoded and a frame coded according to the FD mode may be FD decoded.

The CELP decoder 1207 performs CELP decoding on the frame coded according to the CELP mode, based on the result of checking. For example, the CELP decoder 1207 decodes an LPC included in the bitstream, decodes adaptive and fixed codebook contributions, combines results of decoding, and generates a low-frequency signal corresponding to a decoded signal for low-frequency band.

The TD extension decoder 1208 generates a decoded signal for high-frequency band by using at least one of the result of performing CELP decoding and an excitation signal of the low-frequency signal. The excitation signal of the low-frequency signal may be included in the bitstream. The TD extension decoder 1208 may also use LPC information about the high-frequency signal included in the bitstream to generate the high-frequency signal corresponding to a decoded signal for the high-frequency band.

According to the current exemplary embodiment, the TD extension decoder 1208 may also generate a decoded signal by combining the high-frequency signal with the low-frequency signal generated by the CELP decoder 1207. To generate the decoded signal, the TD extension decoder 1208 may further convert the sampling rates of the low-frequency signal and the high-frequency signal to be same.

The FD decoder 1209 performs FD decoding on the FD coded frame. The FD decoder 1209 may generate a frequency spectrum by decoding the bitstream. According to the current exemplary embodiment, the FD decoder 1209 may also perform decoding on the bitstream, based on mode information of a previous frame included in the bitstream. In other words, the FD decoder 1209 may perform FD decoding on the FD coded frames, based on the mode information of the previous frame included in the bitstream, as will be described in greater detail with reference to FIG. 25 below. The FD decoder 1209 will be described in greater detail with reference to FIG. 12C below.

The inverse frequency transformer 1210 performs inverse frequency transformation on the result of performing the FD decoding. The inverse frequency transformer 1210 generates a decoded signal by performing inverse frequency transformation on an FD decoded frequency spectrum. For example, the inverse frequency transformer 1210 may perform Inverse MDCT but the present invention is not limited thereto.

Accordingly, the decoding apparatus 102 may perform decoding on the bitstream, based on the coding modes of each of the frames of the bitstream.

Figure 12C:
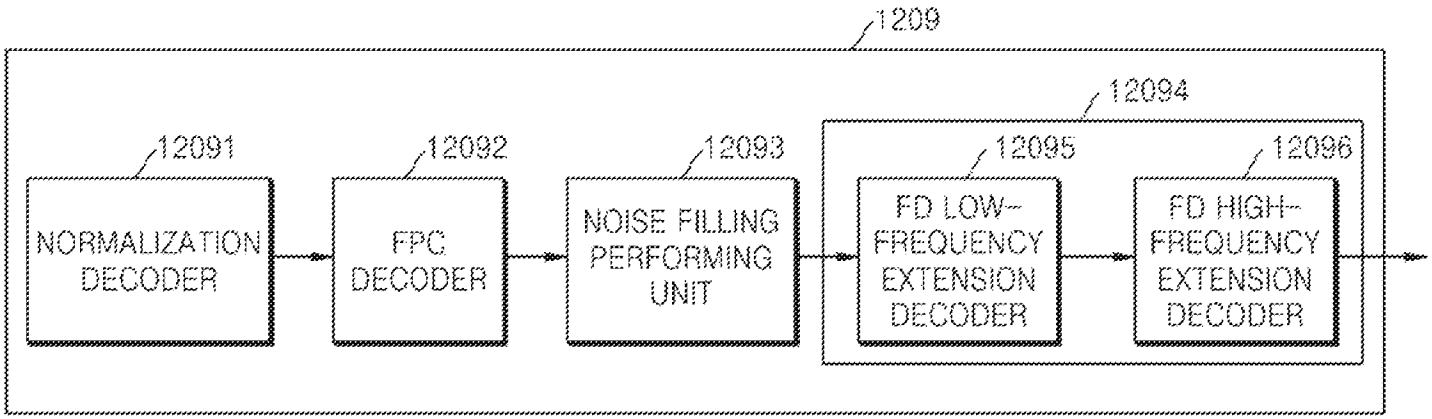
FIG. 12C is a block diagram of an FD decoder included in a decoding apparatus, according to an exemplary embodiment.

FIG. 12C is a block diagram of the FD decoder 1209 included in the decoding apparatus 102, according to an exemplary embodiment.

A decoding process performed by the FD decoder 1209 of FIG. 12C is an inverse process of the process of FIG. 12B. Referring to FIG. 12C, the FD decoder 1209 may include a normalization decoder 12091, an FPC decoder 12092, a noise filling performing unit 12093, and an FD extension decoder 12094. The FD extension decoder 12094 may include an FD low-frequency extension decoder 12095 and an FD high-frequency extension decoder 12096.

The normalization decoder 12091 performs normalization decoding based on normalization information of a bitstream. The normalization information may be information according to a result of coding by the normalization coder 2091 of FIG. 2C.

The FPC decoder 12092 performs FPC decoding based on FPC information of the bitstream. The FPC information may be information according to a result of coding by the factorial pulse coder 209 of FIG. 2C.

For example, the FPC decoder 12092 performs FPC decoding by assigning a number of bits available in each frequency band, similar to the coding performed by the factorial pulse coder 2092 of FIG. 2C.

The noise filling performing unit 12093 performs noise filling on a result of performing the FPC decoding. For example, the noise filling performing unit 12093 adds noise to frequency bands on which FPC decoding is performed. The noise filling performing unit 12093 adds noise up to last frequency bands of frequency bands on which FPC decoding is performed, as will be described with reference to FIG. 27 below.

The FD extension decoder 12094 may include an FD low-frequency extension decoder 12095 and an FD high-frequency extension decoder 12096.

If an upper band value Ffpc of frequency bands performing FPC decoding is less than an upper band value Fcore of frequency bands performing FPC coding, the FD low-frequency extension decoder 12095 performs extension coding on a result of performing FPC decoding and a result of performing noise filling.

Thus, the FD low-frequency extension decoder 12095 generates frequency spectrums up to the upper band value Fcore of frequency bands performing FPC coding, by using frequency spectrums generated by FPC decoding and noise filling.

As described above, decoded low-frequency spectrums may be generated by multiplying the frequency spectrums generated by the FD low-frequency extension decoder 12095 by a normalization value decoded by the normalization decoder 12091.

When the FD low-frequency extension decoder 12095 does not operate, decoded low-frequency spectrums may be generated by multiplying the frequency spectrums generated by performing FPC decoding and performing noise filling by the normalization value decoded by the normalization decoder 12091.

The FD high-frequency extension decoder 12096 performs high-frequency extension decoding by using the results of performing FPC decoding and performing noise filling. In the current exemplary embodiment, the FD high-frequency extension decoder 12096 operates to correspond to the FD extension coder 2094 of FIG. 2C.

For example, the FD high-frequency extension decoder 12096 may inversely quantize high-frequency energy based on high-frequency energy information of bitstream, generate an excitation signal of a high-frequency signal by using a low-frequency signal according to various high-frequency bandwidth extension modes, and generate a decoded high-frequency signal according to applying a gain so that the energy of the excitation signal may be symmetry to inversely quantized energy. For example, the various high-frequency bandwidth extension modes may include the normal mode, the harmonic mode, or the noise mode.

The FD high-frequency extension decoder 12096 may perform inverse quantization of energy by sharing the same codebook with respect to different bitrates, as will be described in greater detail with reference to FIG. 26 below.

If a frame that is to be decoded is a stationary frame, the normalization decoder 12091, the FPC decoder 12092, the noise filling performing unit 12093, and the FD extension decoder 12094 included in the FD decoder 1209 may operate.

However, if a frame that is to be decoded is a transient frame, the FD extension decoder 12094 may not operate.

Figure 12D:
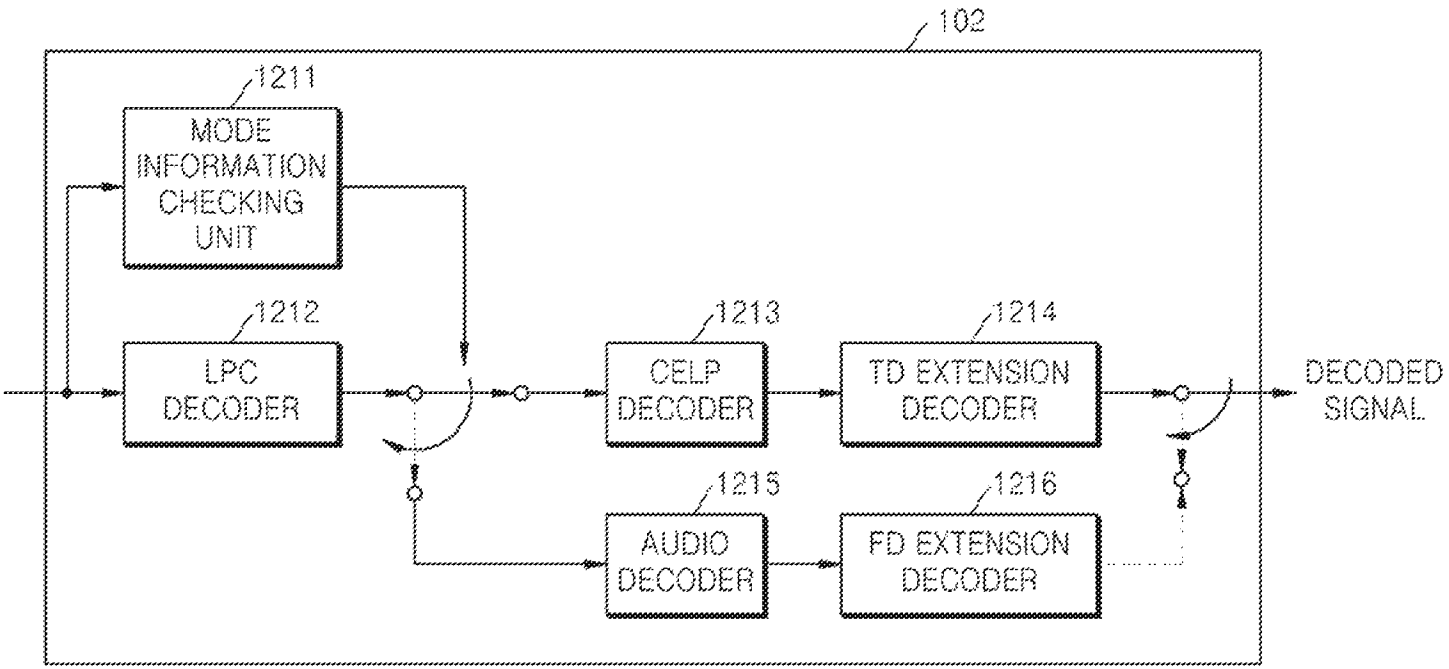
FIG. 12D is a block diagram of a decoding apparatus according to another exemplary embodiment.

FIG. 12D is a block diagram of the decoding apparatus 102 according to another exemplary embodiment.

A decoding process performed by the decoding apparatus 102 of FIG. 12D is an inverse process of the process of FIG. 2D. Referring to FIG. 12D, the decoding apparatus 102 may include a mode information checking unit 1211, an LPC decoder 1212, a CELP decoder 1213, a TD extension decoder 1214, an audio decoder 1215, and an FD extension decoder 1216.

The mode information checking unit 1211 checks mode information of each of frames included in a bitstream. The bitstream may be a signal corresponding to a bitstream according to a result of coding performed by the coding apparatus 101 transmitted to the decoding apparatus 102.

For example, the mode information checking unit 1211 parses mode information from the bitstream, and performs switching operation to one of a CELP decoding mode or an FD decoding mode according to a coding mode of a current frame according to a result of parsing.

The mode information checking unit 1211 may switch, with regard to each of frames included in the bitstream, in such a manner that a frame coded according to the CELP mode may be CELP decoded and a frame coded according to the FD mode may be FD decoded.

The LPC decoder 1212 performs LPC decoding on the frames included in the bitstream.

The CELP decoder 1213 performs CELP decoding on the frame coded according to the CELP mode, based on the result of checking. For example, the CELP decoder 1213 decodes adaptive and fixed codebook contributions, combines results of decoding, and generates a low-frequency signal corresponding to a decoded signal for low-frequency band.

The TD extension decoder 1214 generates a decoded signal for high-frequency band by using at least one of the result of performing CELP decoding and an excitation signal of the low-frequency signal. The excitation signal of the low-frequency signal may be included in the bitstream. The TD extension decoder 1208 may also use LPC information decoded by the LPC decoder 1212 to generate the high-frequency signal corresponding to a decoded signal for the high-frequency band.

According to the current exemplary embodiment, the TD extension decoder 1214 may also generate a decoded signal by combining the high-frequency signal with the low-frequency signal generated by the CELP decoder 1214. To generate the decoded signal, the TD extension decoder 1214 may further perform converting operation on the sampling rates of the low-frequency signal and the high-frequency signal to be the same.

The audio decoder 1215 performs audio decoding on coded frame audio coded, based on the result of checking. For example, the audio decoder 1215 refers to the bitstream, and performs decoding based on a time domain contribution and a frequency domain contribution when the time domain contribution is present. When the time domain contribution is not present, the audio decoder 1215 performs decoding based on the frequency domain contribution. The audio decoder 1215 may also generate a decoded low-frequency excitation signal by performing inverse frequency transformation, e.g., IDCT, on a signal quantized according to FPC or LVQ, and generate a decoded low-frequency signal by combining the excitation signal with an inversely quantized LPC.

The FD decoder 1216 performs extension decoding by using a result of performing audio decoding. For example, the FD decoder 1216 converts the decoded low-frequency signal to a sampling rate appropriate for performing high-frequency extension decoding, and performs frequency transformation, e.g., MDCT, on the converted signal. The FD extension decoder 1216 may inversely quantize quantized high-frequency energy, generate an excitation signal of a high-frequency signal by using the low-frequency signal according to various high-frequency bandwidth extension modes, and generate a decoded high-frequency signal according to applying a gain in such a manner that energy of the excitation signal may be symmetric to the inversely quantized energy. For example, the various high-frequency bandwidth extension modes may include the normal mode, the harmonic mode, the transient mode, or the noise mode.

The FD extension decoder 1216 may also generate a decoded signal by performing inverse frequency transformation, e.g., inverse MDCT, on the decoded high-frequency signal and the low-frequency signal.

In addition, if the transient mode is used for high-frequency bandwidth extension, the FD extension decoder 1216 may apply a gain calculated in a time domain so that the signal decoded after performing inverse frequency transformation may match a decoded temporal envelope, and combine the signal to which the gain is applied.

Accordingly, the decoding apparatus 102 may perform decoding on the bitstream, based on the coding mode of each of the frames included in the bitstream.

Figure 13:
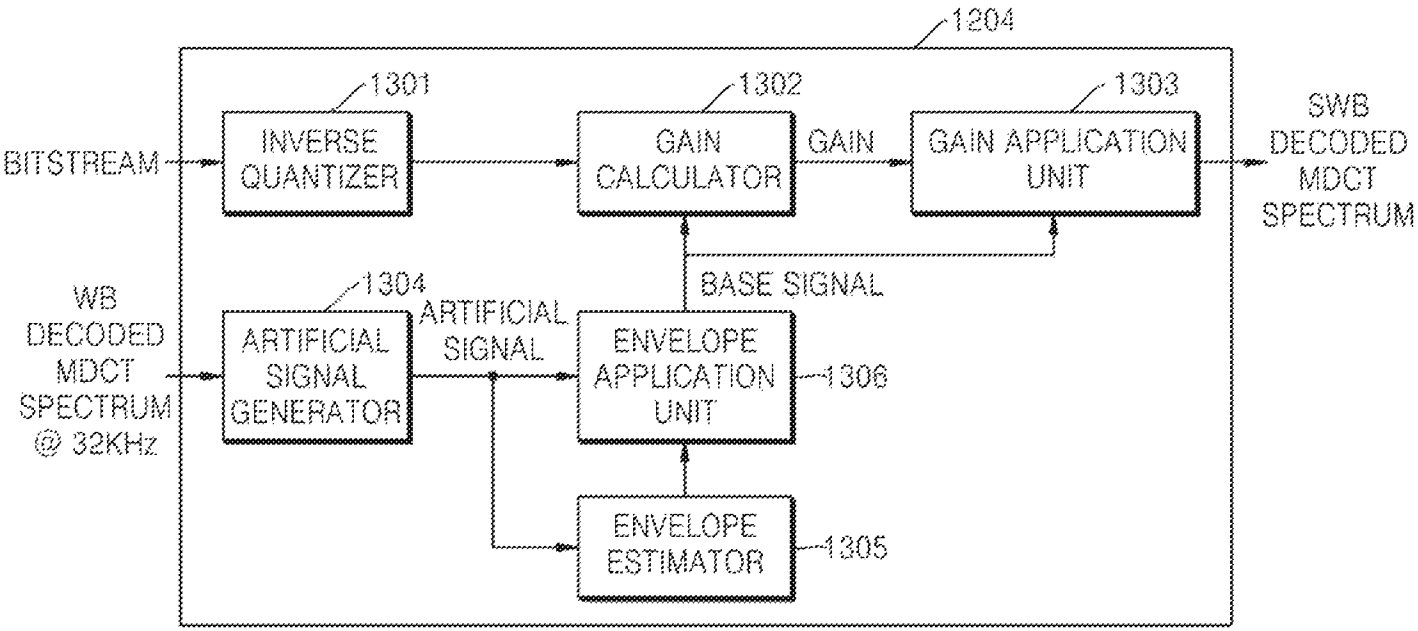
FIG. 13 is a block diagram of an extension decoder included in a decoding apparatus, according to an exemplary embodiment.

FIG. 13 is a block diagram of an extension decoder 1304 included in the decoding apparatus 102, according to an exemplary embodiment.

Referring to FIG. 13, the extension decoder 1204 may include an inverse quantizer 1301, a gain calculator 1302, a gain application unit 1303, an artificial signal generator 1304, an envelope estimator 1305, and an envelope application unit 1306.

The inverse quantizer 1301 may inversely quantize energy of an input signal. A process of inversely quantizing the energy of the input signal will be described in greater detail with reference to FIG. 14 below.

The gain calculator 1302 may calculate a gain to be applied to a base signal, based on the inversely quantized energy and energy of the base signal. The gain may be determined by a ratio between the inversely quantized energy and energy of the base signal. In general, energy is determined by using the sum of squares of amplitude of frequency spectrum. Thus, a square root of the ratio between the inversely quantized energy and energy of the base signal may be used.

The gain application unit 1303 may apply the gain for each frequency band to determine a frequency spectrum of an SWB.

For example, the gain calculation and the gain application may be performed by equalizing a band with a frequency band used to transmit energy as described above. According to another exemplary embodiment, the gain calculation and the gain application may be performed by dividing entire frequency bands into sub bands to prevent a dramatic change of energy. Energies at the borders of band may be smoothed by interpolating inversely quantized energies of neighboring bands. For example, the gain calculation and the gain application may be performed by dividing each band into three sub bands, assigning inversely quantized energy of a current band to the middle sub band from among the three sub bands of each band, and using energy assigned to a middle band of a previous or subsequent band and newly smoothed energy through interpolation. That is, the gain may be calculated and applied in units of sub bands.

Such an energy smoothing method may be applied as a fixed type. The energy smoothing method may also be applied to only required frames by transmitting information indicating that energy smoothing is required from the extension coder 204. The information indicating that energy smoothing is required may be set if a quantization error in the entire energy when energy smoothing is performed is lower than a quantization error in the entire energy when energy smoothing is not performed.

The base signal may be generated by using an input signal in a frequency domain. A process of generating the base signal may be performed as described below.

The artificial signal generator 1304 may generate an artificial signal corresponding to a high-frequency band by copying and folding a low-frequency band of the input signal in the frequency domain. The input signal in the frequency domain may be a decoded wide-band(WB) signal having a sampling rate of 32 KHz.

The envelope estimator 1305 may estimate an envelope of the base signal by using a window included in the bitstream. The window used by the coding apparatus 101 to estimate an envelope, and information about the type of the window may be included in the bitstream as a bit type and transmitted to the decoding apparatus 102.

The envelope application unit 1306 may generate the base signal by applying the estimated envelope to the artificial signal.

When the envelope estimator 602, included in the coding apparatus 101, estimates an average of a frequency magnitude for each whitening band to be an envelope of a frequency belonging to the whitening band, information indicating whether a number of frequency spectrums belonging to the whitening band is large or small is transmitted to the decoding apparatus 102. The envelope estimator 1305 of the decoding apparatus 102 may then estimate the envelope based on the transmitted information. The envelope application unit 1306 may then apply the estimated envelope to the artificial signal. Alternatively, the envelope may be determined according to a core coding mode used by a wide-band (WB) core decoder without having to transmit the information.

The core decoder 1201 may decode signals by classifying coding modes of the signals as the voiced coding mode, the unvoiced coding mode, the transient coding mode, and the generic coding mode, based on characteristics of the signals. The envelope estimator 602 may control a number of frequency spectrums belonging to the whitening band, based on a decoding mode according to the characteristics of an input signal. For example, if the input signal is decoded according to the voiced decoding mode, the envelope estimator 1305 may estimate the envelope by forming three frequency spectrums in the whitening band. If the input signal is decoded in a decoding mode other than the voiced decoding mode, the envelope estimator 1305 may estimate the envelope by forming three frequency spectrums in the whitening band.

Figure 14:
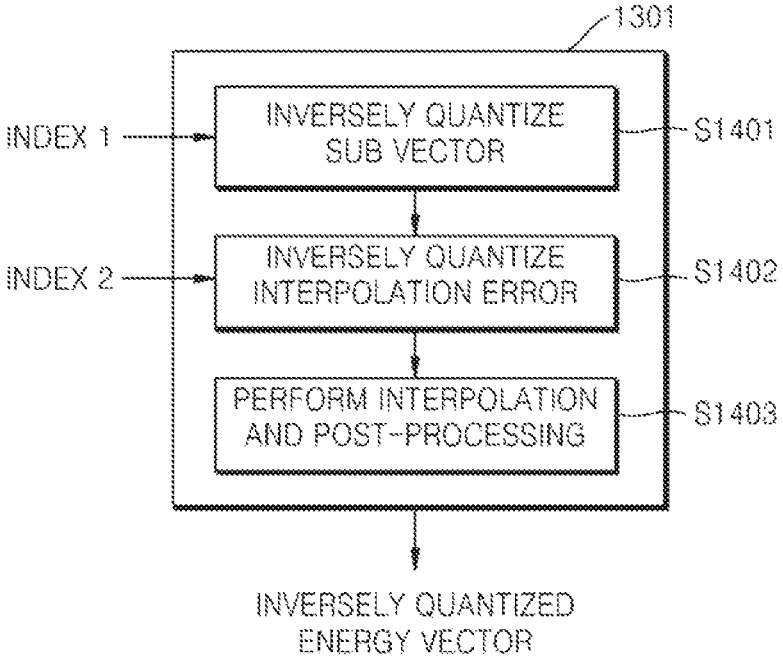
FIG. 14 is a flowchart illustrating an operation of an inverse quantizer included in the extension decoder, according to an exemplary embodiment.

FIG. 14 is a flowchart illustrating an operation of the inverse quantizer 1301 included in the extension decoder 1204, according to an exemplary embodiment.

In operation S1401, the inverse quantizer 1301 may inversely quantize a selected sub vector of energy vector, based on an index received from the coding apparatus 101.

In operation S1402, the inverse quantizer 1301 may inversely quantize interpolation errors corresponding to the remaining sub vectors which are not selected, based on the received index.

In operation S1403, the inverse quantizer 1301 may calculate the remaining sub vectors by interpolating the inversely quantized sub vector. The inverse quantizer 1301 may then add the inversely quantized interpolation errors to the remaining sub vectors. The inverse quantizer 1301 may also calculate an inversely quantized energy by adding an average which was subtracted during a pre-processing operation, through a post-processing operation.

Figure 15A:
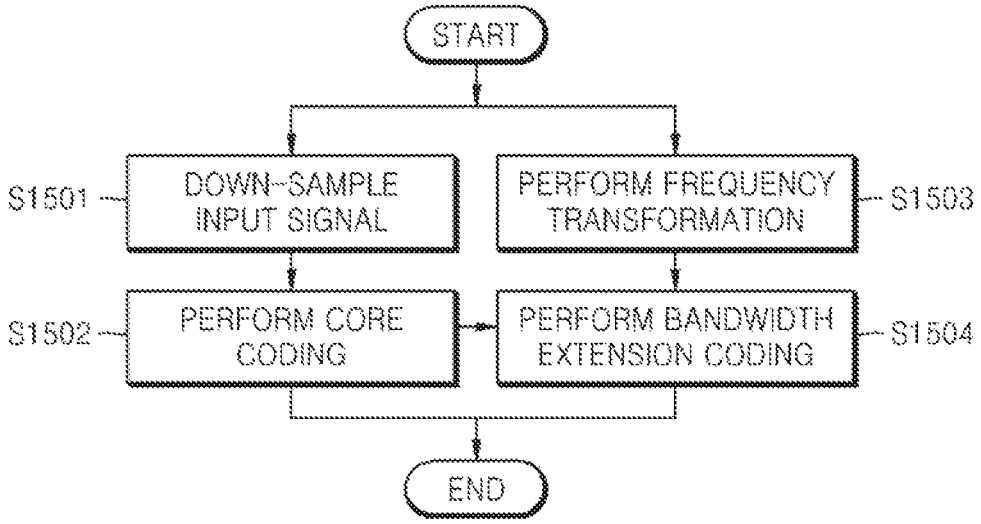
FIG. 15A is a flowchart illustrating a coding method according to an exemplary embodiment.

FIG. 15A is a flowchart illustrating a coding method according to an exemplary embodiment.

In operation S1501, the coding apparatus 101 may down-sample an input signal.

In operation S1502, the coding apparatus 101 may perform core coding on the down-sampled input signal.

In operation S1503, the coding apparatus 101 may perform frequency transformation on the input signal.

In operation S1504, the coding apparatus 101 may perform bandwidth extension coding on the input signal in a frequency domain. For example, the coding apparatus 101 may perform bandwidth extension coding by using coding information determined through core coding. The coding information may include a coding mode classified according to the characteristics of the input signal when core coding is performed.

For example, the coding apparatus 101 may perform bandwidth extension coding as described below.

The coding apparatus 101 may generate a base signal of the input signal in the frequency domain by using frequency spectrums of the input signal in the frequency domain. Alternatively, the coding apparatus 101 may generate a base signal of the input signal in the frequency domain, based on the characteristics and the frequency spectrums of the input signal. The characteristics of the input signal may be derived by through core coding or through additional signal classification. The coding apparatus 101 may estimate an energy control factor by using the base signal. The coding apparatus 101 may extract energy from the input signal in the frequency domain. The coding apparatus 101 may then control the extracted energy by using the energy control factor. The coding apparatus 101 may quantize the controlled energy.

The base signal may be generated as described below.

The coding apparatus 101 may generate an artificial signal corresponding to a high-frequency band by copying and folding a low-frequency band of the input signal in the frequency domain. The coding apparatus 101 may then estimate an envelope of the base signal by using a window. The coding apparatus 101 may estimate an envelope of the base signal by selecting a window through a tonality or correlation comparison. For example, the coding apparatus 101 may estimate an average of frequency magnitudes of each of the whitening bands as an envelope of a frequency belonging to each of the whitening bands. The coding apparatus 101 may estimate the envelope of the base signal by controlling a number of frequency spectrums belonging to the whitening band according to a core coding mode.

The coding apparatus 101 may then apply the estimated envelope to the artificial signal so as to generate the base signal.

The energy control factor may be estimated as described below.

The coding apparatus 101 may calculate a tonality of the high-frequency band of the input signal in the frequency domain. The coding apparatus 101 may calculate a tonality of the base signal. The coding apparatus 101 may then calculate the energy control factor by using the tonality of the high-frequency band of the input signal and the tonality of the base signal.

The quantizing of the controlled energy may be performed as described below.

The coding apparatus 101 may select and quantize a sub vector, and quantize the remaining sub vectors by using an interpolation error. The coding apparatus 101 may select a sub vector at the same time interval.

For example, the coding apparatus 101 may perform MSVQ using at least two stages by selecting sub vector candidates. The coding apparatus 101 may generate an index set to minimize MSEs or WMSEs for each of the sub vector candidates in each of the stages, and select a sub vector candidate having a least sum of MSEs or WMSEs in all the stages from among the sub vector candidates. Alternatively, the coding apparatus 101 may generate an index set to minimize MSEs or WMSEs for each of the sub vector candidates in each of the stages, reconstruct energy vector through inverse quantization, and select a sub vector candidate to satisfy MSE or WMSE between the reconstructed energy vector and the original energy vector.

Figure 15B:
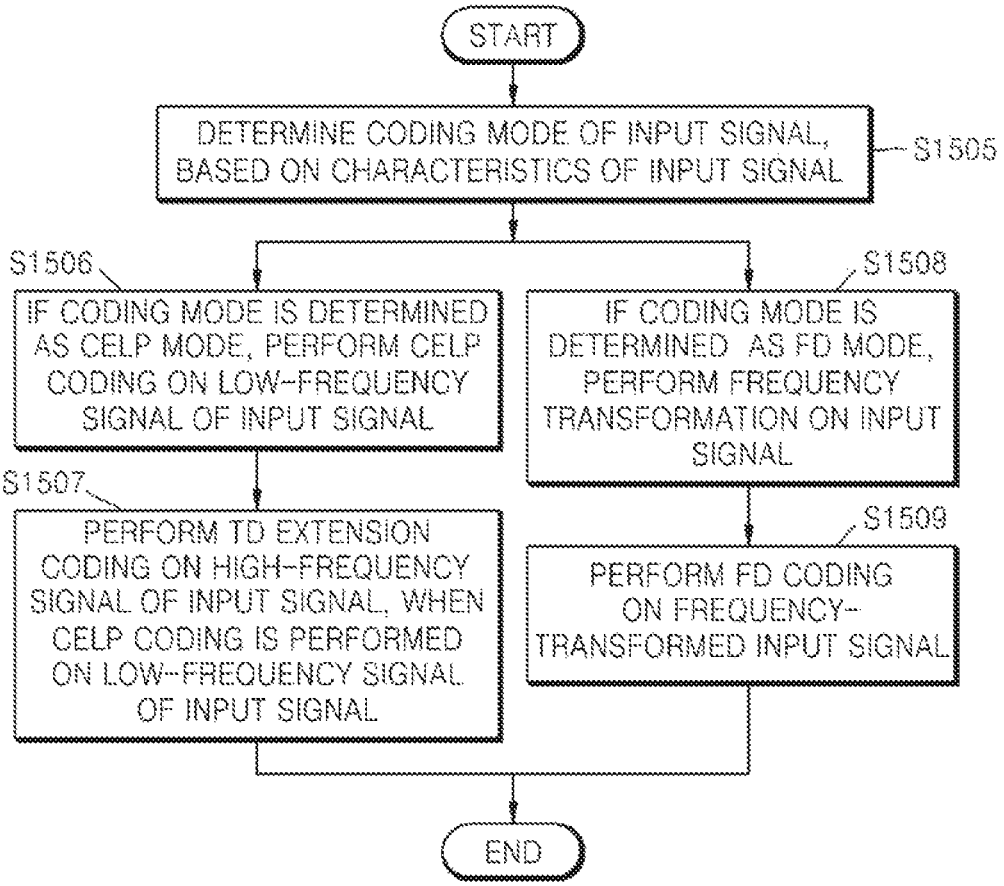
FIG. 15B is a flowchart illustrating a coding method according to another exemplary embodiment.

FIG. 15B is a flowchart illustrating a coding method according to another exemplary embodiment. The coding method of FIG. 15B may include operations that are sequentially performed by the coding apparatus 101 of one of FIGS. 2A to 2C. Thus, although not described here, the above descriptions of the coding apparatus 101 with reference to FIGS. 2A to 2C may also be applied to the coding method of FIG. 15B.

In operation S1505, the signal classification unit 205 determines a coding mode of an input signal, based on characteristics of the input signal.

In operation S1506, if the coding mode of an input signal is determined to be the CELP mode, the CELP coder 206 performs CELP coding on a low-frequency signal of the input signal.

In operation S1507, if CELP coding is performed on the low-frequency signal of the input signal, the TD extension coder 207 performs TD extension coding on a high-frequency signal of the input signal.

In operation S1508, if the coding mode of an input signal is determined to be the FD mode, the frequency transformer 208 performs frequency transformation on the input signal.

In operation S1509, the FD coder 209 performs FD coding on the frequency-transformed input signal.

Figure 15C:
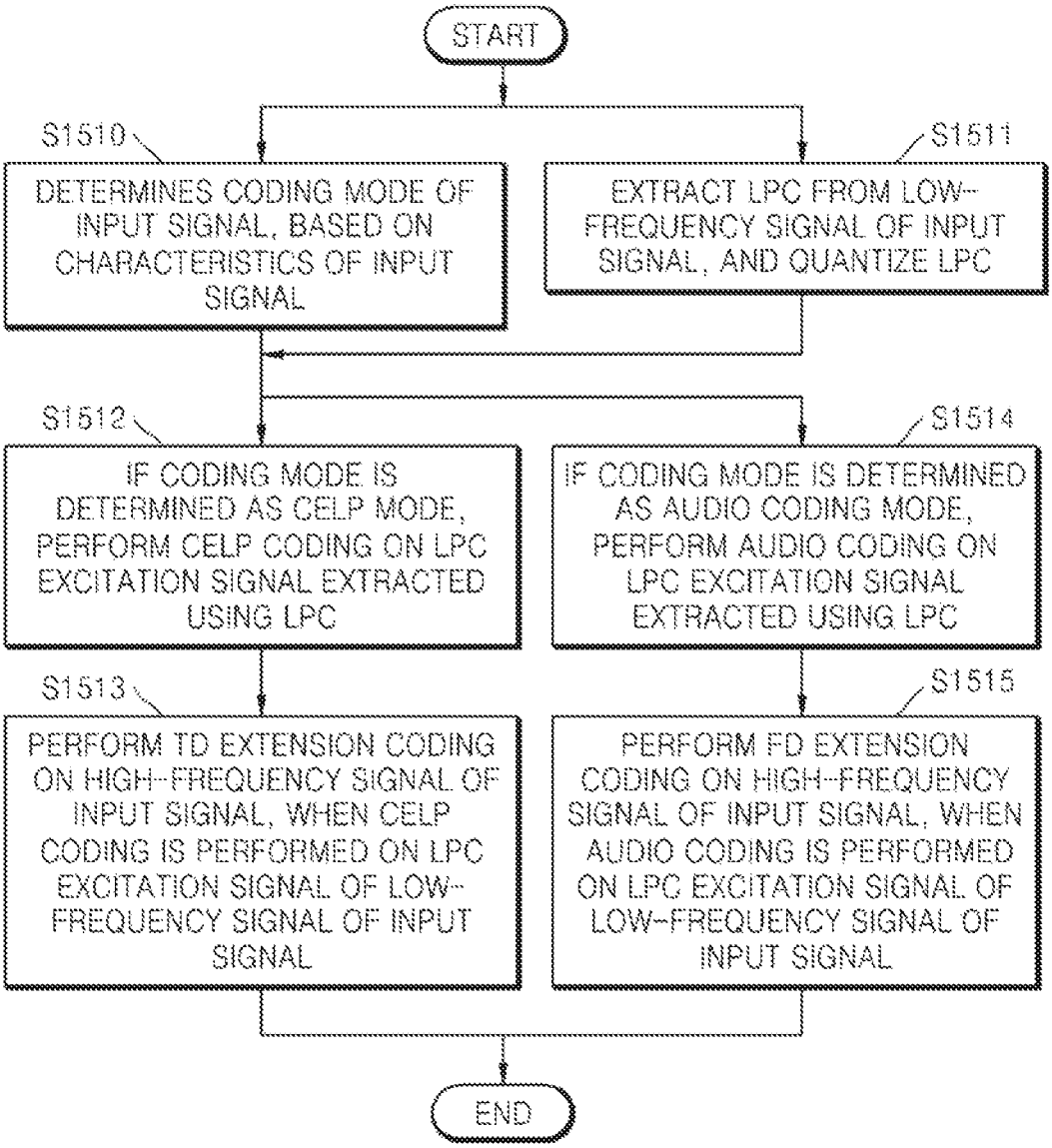
FIG. 15C is a flowchart illustrating a coding method according to another exemplary embodiment.

FIG. 15C is a flowchart illustrating a coding method according to another exemplary embodiment. The coding method of FIG. 15C may include operations that are sequentially performed by the coding apparatus 101 of one of FIGS. 2A to 2C. Thus, although not described here, the above descriptions of the coding apparatus 101 with reference to FIGS. 2A to 2C may also be applied to the coding method of FIG. 15C.

In operation S1510, the signal classification unit 210 determines a coding mode of an input signal, based on characteristics of the input signal.

In operation S1511, the LPC coder 211 extracts an LPC from a low-frequency signal of the input signal, and quantizes the LPC.

In operation S1512, if the coding mode of an input signal is determined to be the CELP mode, the CELP coder 212 performs CELP coding on an LPC excitation signal extracted using the LPC.

In operation S1513, if CELP coding is performed on the LPC excitation signal of the low-frequency signal of the input signal, the TD extension coder 213 performs TD extension coding on a high-frequency signal of the input signal.

In operation S1514, if the coding mode of an input signal is determined to be the audio coding mode, the audio coder 214 performs audio coding on the LPC excitation signal extracted using the LPC.

In operation S1515, if FD coding is performed on the LPC excitation signal of the low-frequency signal of the input signal, the FD extension coder 215 performs FD extension coding on the high-frequency signal of the input signal.

Figure 16A:
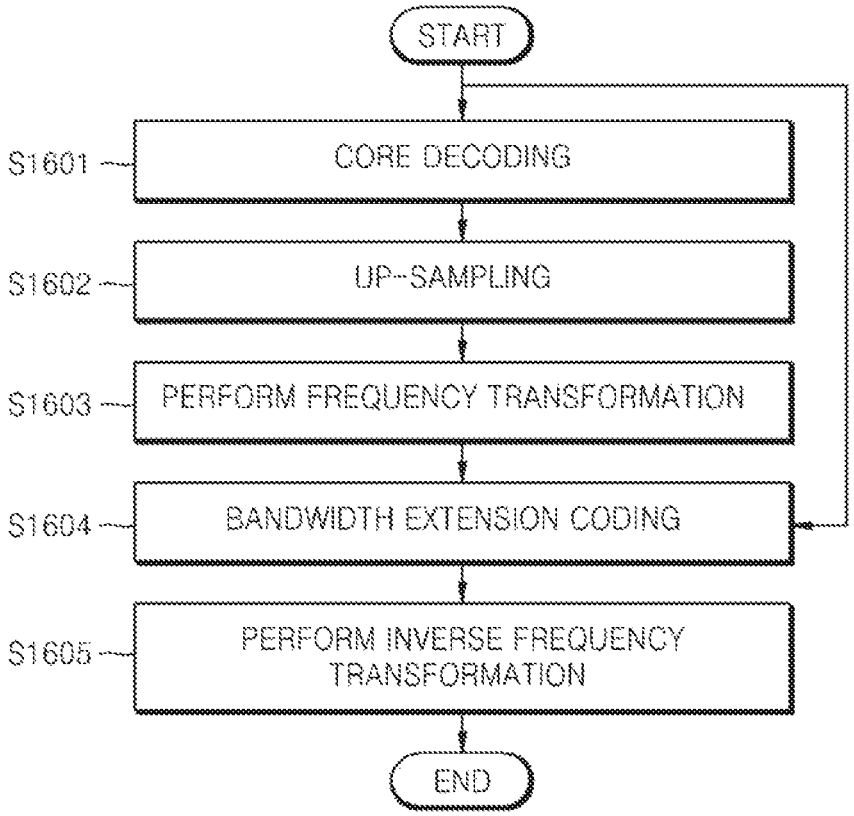
FIG. 16A is a flowchart illustrating a decoding method according to an exemplary embodiment.

FIG. 16A is a flowchart illustrating a decoding method according to an exemplary embodiment.

In operation S1601, the decoding apparatus 102 may perform core decoding on a core coded input signal included in a bitstream.

In operation S1602, the decoding apparatus 102 may up-sample the core decoded input signal.

In operation S1603, the decoding apparatus 102 may perform frequency transformation on the up-sampled input signal.

In operation S1604, the decoding apparatus 102 may perform bandwidth extension decoding by using an input signal in a frequency domain and information about energy of the input signal included in the bitstream.

More specifically, bandwidth extension may be performed as described below.

The decoding apparatus 102 may inversely quantize the energy of the input signal. The decoding apparatus 101 may select and inversely quantize a sub vector, interpolate the inversely quantized sub vector, and add an interpolation error to the interpolated sub vector, thereby inversely quantizing the energy.

The decoding apparatus 102 may also generate a base signal of the input signal in the frequency domain. The decoding apparatus 102 may then calculate a gain to be applied to the base signal by using the inversely quantized energy and energy of the base signal. Thereafter, the decoding apparatus 102 may apply the gain for each frequency band.

The base signal may be generated as described below.

The decoding apparatus 102 may generate an artificial signal corresponding to a high-frequency band of the input signal by copying and folding a low-frequency band of the input signal in the frequency domain. The decoding apparatus 102 then may estimate an envelope of the base signal by using window information included in the bitstream. If window information is set to be the same, no window information is included in the bitstream. Thereafter, the decoding apparatus 102 may apply the estimated envelope to the artificial signal.

Figure 16B:
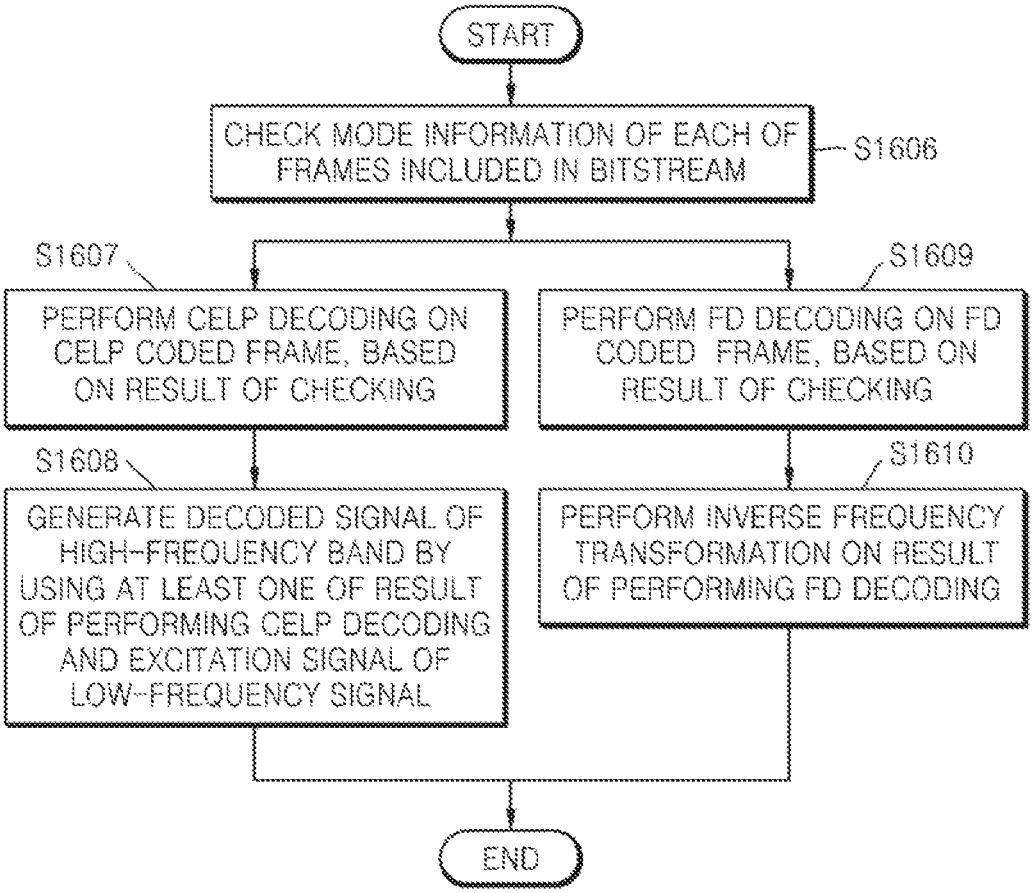
FIG. 16B is a flowchart illustrating a decoding method according to another exemplary embodiment.

FIG. 16B is a flowchart illustrating a decoding method according to another exemplary embodiment. The coding method of FIG. 16B may include operations that are sequentially performed by the decoding apparatus 102 of one of FIGS. 12A to 12C. Thus, although not described here, the above descriptions of the decoding apparatus 102 with reference to FIGS. 12A to 12C may also be applied to the decoding method of FIG. 16B.

In operation S1606, the mode information checking unit 1206 checks mode information of each of frames included in a bitstream.

In operation S1607, the CELP decoder 1207 performs CELP decoding on the CELP coded frame, based on a result of the checking.

In operation S1608, the TD extension decoder 1208 generates a decoded signal of a high-frequency band by using at least one of a result of performing CELP decoding and an excitation signal of a low-frequency signal.

In operation S1609, the FD decoder 1209 performs FD decoding on the FD coded frame, based on a result of the checking.

The inverse frequency transformer 1210 performs inverse frequency transformation on a result of performing the FD decoding.

Figure 16C:
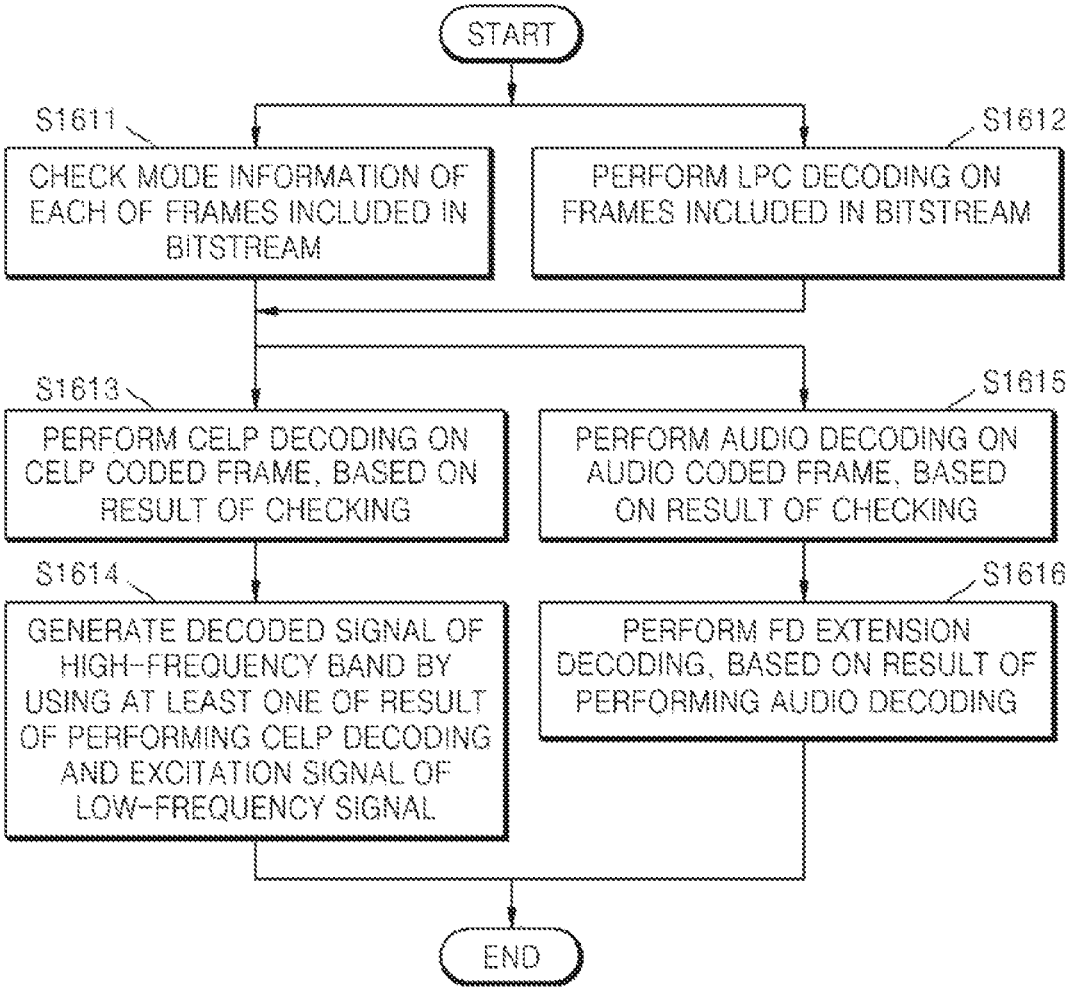
FIG. 16C is a flowchart illustrating a decoding method according to another exemplary embodiment.

FIG. 16C is a flowchart illustrating a decoding method according to another exemplary embodiment. The coding method of FIG. 16C may include operations that are sequentially performed by the decoding apparatus 102 of one of FIGS. 12A to 12C. Thus, although not described here, the above descriptions of the decoding apparatus 102 with reference to FIGS. 12A to 12C may also be applied to the decoding method of FIG. 16C.

In operation S1611, the mode information checking unit 1211 checks mode information of each of frames included in a bitstream.

In operation S1612, the LPC decoder 1212 performs LPC decoding on the frames included in the bitstream.

In operation S1613, the CELP decoder 1213 performs CELP decoding on the CELP coded frame, based on a result of the checking.

In operation S1614, the TD extension decoder 1214 generates a decoded signal of a high-frequency band by using at least one of a result of performing CELP decoding and an excitation signal of a low-frequency signal.

In operation S1615, the audio decoder 1215 performs audio decoding on the audio coded frame, based on the result of the checking.

In operation S1616, the FD extension decoder 1216 performs FD extension decoding by using a result of performing audio decoding.

Regarding other aspects of the coding and decoding methods, which are not described with reference to FIGS. 15 to 16, the description with reference to FIGS. 1 to 14 should be referred to.

Figure 17:
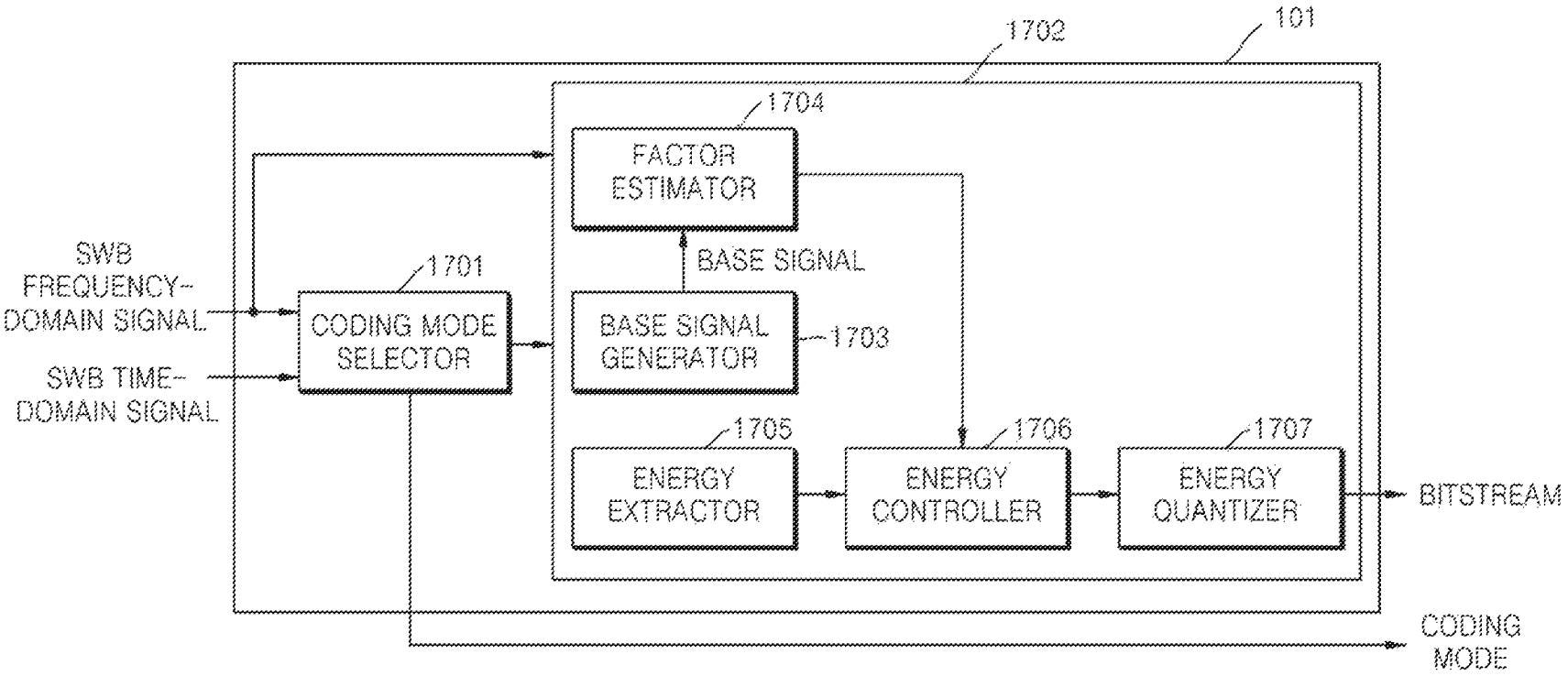
FIG. 17 is a block diagram of the structure of a coding apparatus according to another exemplary embodiment.

FIG. 17 is a block diagram of the structure of a coding apparatus 101 according to another exemplary embodiment.

Referring to FIG. 17, the coding apparatus 101 may include a coding mode selector 1701 and an extension coder 1702.

The coding mode selector 1701 may determine a coding mode of bandwidth extension coding by using an input signal in a frequency domain and an input signal in a time domain.

More specifically, the coding mode selector 1701 may classify the input signal in the frequency domain by using the input signal in the frequency domain and the input signal in the time domain, and determine the coding mode of bandwidth extension coding and a number of frequency bands according to the coding mode, based on a result of the classifying. The coding mode may be set as a new set of coding modes that are different than a coding mode determined when core coding is performed, for improving the performance of the extension coder 1702.

For example, the coding modes may be classified into the normal mode, the harmonic node, the transient mode, and the noise mode. First, the coding mode selector 1701 determines whether a current frame is a transient frame, based on a ratio between long-term energy of the input signal in the time domain and energy of a high-frequency band of the current frame. A section of a transient signal is a section where a dramatic change of energy occurs in the time domain and may thus be a section in which energy of a high-frequency band dramatically changes.

A process of determining the other three coding modes will now be described. First, global energies of a previous frame and a current frame are obtained, the ratio between the global energies and a signal in a frequency domain are divided into predetermined frequency bands, and then the three coding modes are determined based on average energy and peak energy of each of the frequency bands. In general, in the harmonic mode, the difference between peak energy and average energy of a signal in a frequency domain is the largest. In the noise mode, the degree of a change of energy of a signal is small overall. Coding modes of other signals (i.e., signals that are not determined to be the harmonic mode or the noise mode), are determined to be the normal mode.

According to an exemplary embodiment, a number of frequency bands may be determined as sixteen in the normal mode and the harmonic mode, may be determined as five in the transient mode, and may be determined as twelve in the normal mode.

The extension coder 1702 may select the coding mode of bandwidth extension coding by using the input signal in the frequency domain and the input signal in the time domain. Referring to FIG. 17, the extension coder 1702 may include a base signal generator 1703, a factor estimator 1704, an energy extractor 1705, an energy controller 1706, and an energy quantizer 1707. The base signal generator 1703 and the factor estimator 1704 are as described above with reference to FIG. 5.

The energy extractor 1705 may extract energy corresponding to each of the frequency bands according to the number of frequency bands determined according to the coding modes. Based on the coding mode, the base signal generator 1703, the factor estimator 1704, and the energy controller 1706 may or may not be used. For example, these elements may be used in the normal mode and the harmonic mode, but may not be used in the transient mode and the noise mode. The base signal generator 1703, the factor estimator 1704, and the energy controller 1706 are as described above with reference to FIG. 5. The energy of bands on which energy control is performed may be quantized by the energy quantizer 1707.

Figure 18:
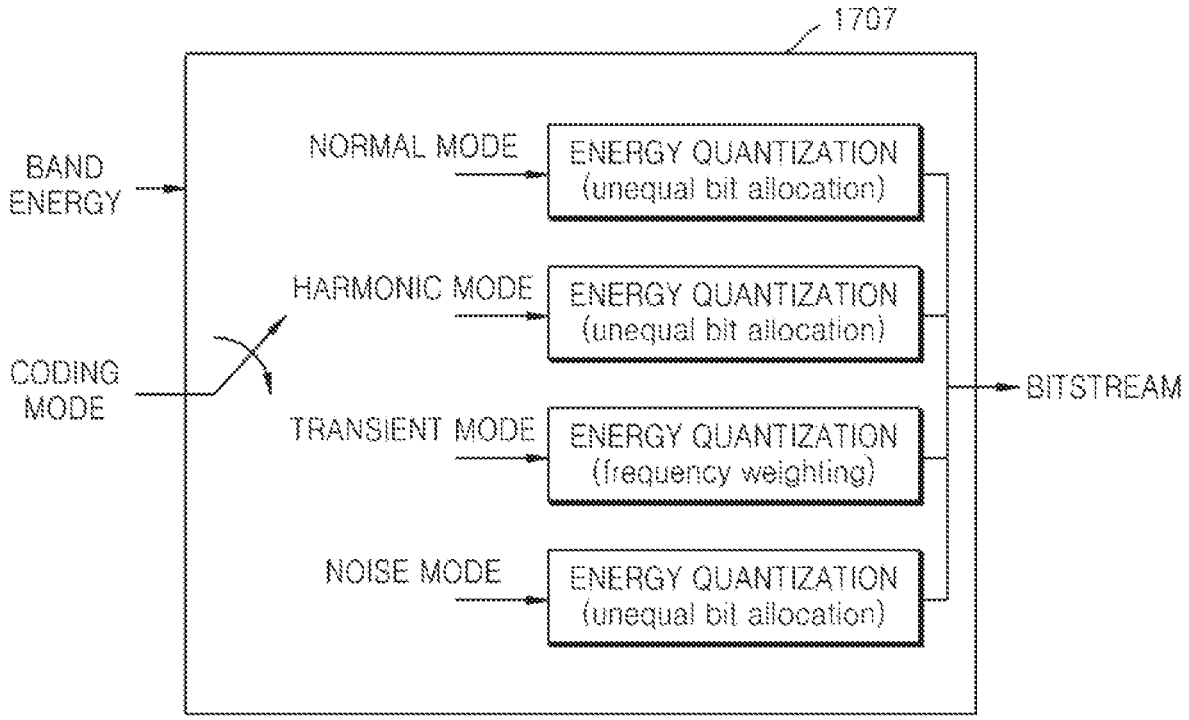
FIG. 18 is a flowchart illustrating an operation of an energy quantizer included in a coding apparatus, according to another exemplary embodiment.

FIG. 18 is a flowchart illustrating an operation of the energy quantizer 1707 according to another exemplary embodiment.

The energy quantizer 1707 may quantize energy extracted from an input signal according to a coding mode. The energy quantizer 1707 may quantize energy of band to be optimized for the input signal based on a number of band energies and perceptual characteristics of the input signal according to the coding mode.

For example, if the coding mode is the transient mode, the energy quantizer 1707 may quantize, with regard to five band energies, band energy by using a frequency weighting method based on the perceptual characteristics of an input signal. If the coding mode is the normal mode or the harmonic mode, the energy quantizer 1707 may quantize, with regard to sixteen band energies, band energy by using an unequal bit allocation method based on the perceptual characteristics of an input signal. If the characteristics of the input signal are not definite, the energy quantizer 1707 may perform quantization according to a general method, rather than in consideration of the perceptual characteristics of the input signal.

Figure 19:
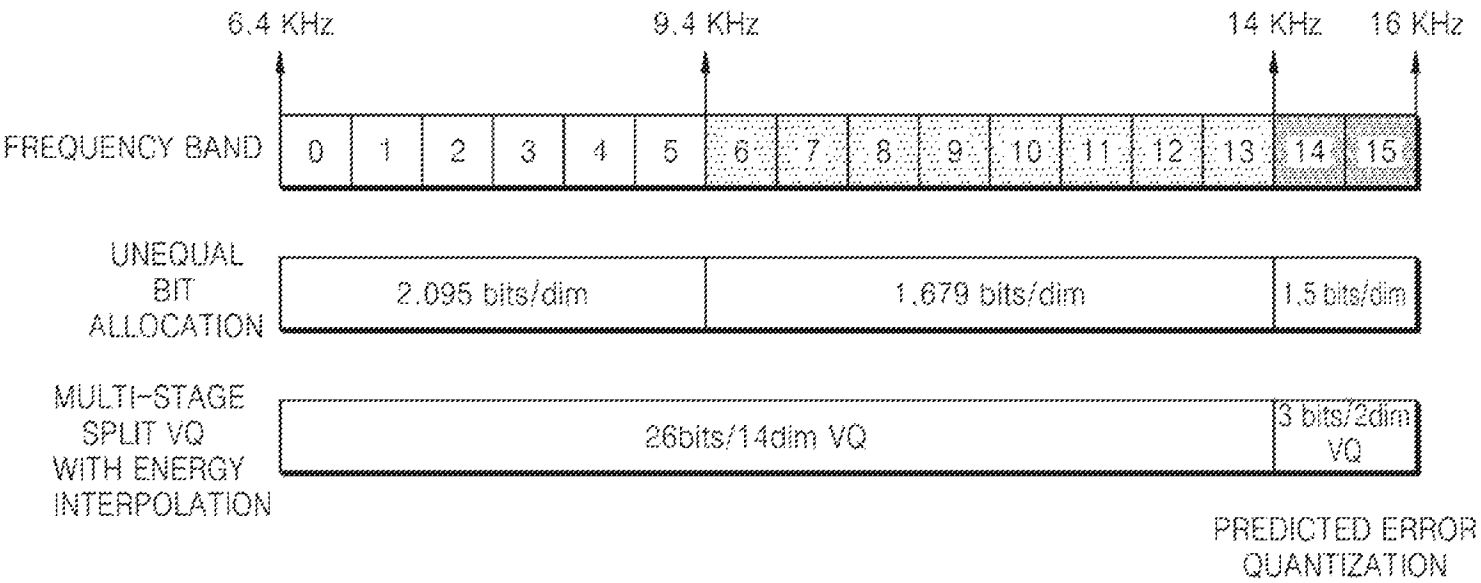
FIG. 19 is a diagram illustrating a process of quantizing energy by using an unequal bit allocation method, according to an exemplary embodiment.

FIG. 19 is a diagram illustrating a process of quantizing energy by using the unequal bit allocation method, according to an exemplary embodiment.

In the unequal bit allocation method, perceptual characteristics of an input signal, which is a target of extension coding, are considered. Thus, relatively low frequency bands of perceptually high importance may be more precisely quantized according to the unequal bit allocation method. To this end, the energy quantizer 1707 may classify perceptual importance by allocating the same number of bits or larger number of bits to the relatively low frequency bands, compared to numbers of bits allocated to the other frequency bands.

For example, the energy quantizer 1707 allocates a larger number of bits to relatively low frequency bands assigned numbers '0' to '5'. The numbers of bits allocated to the relatively low frequency bands assigning numbers '0' to '5' may be the same. The higher a frequency band, the smaller the number of bits allocated to the frequency band by the energy quantizer 1707. Accordingly, frequency bands assigned numbers '0' to '13' may be quantized as illustrated in FIG. 19, according to the bit allocation as described above. Other frequency bands assigned numbers '14' and '15' may be quantized as illustrated in FIG. 20.

Figure 20:
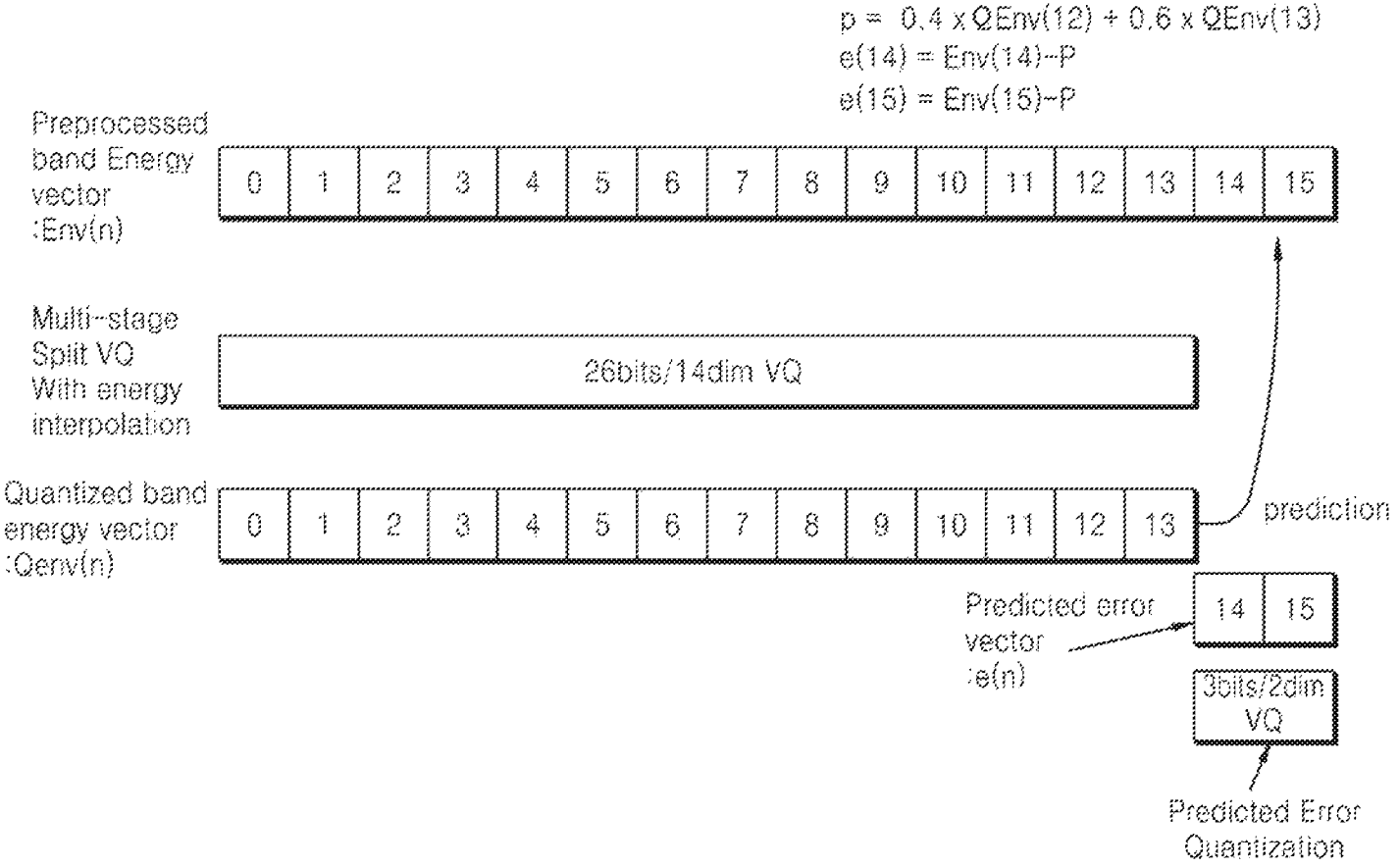
FIG. 20 is a diagram illustrating vector quantization using intra frame prediction, according to an exemplary embodiment.

FIG. 20 is a diagram illustrating vector quantization using intra frame prediction, according to an exemplary embodiment.

The energy quantizer 1707 predicts a representative value of a quantization target vector that has at least two elements, and may then perform vector quantization on an error signal between the each of elements of the quantization target vector and the predicted representative value.

FIG. 20 illustrates such an intra frame prediction method. A method of predicting representative value of the quantization target vector and deriving the error signal are as follows in Equation (8):

$$p=0.4*Q\mathrm{Env}(12)+0.6*Q\mathrm{Env}(13)$$

$$e(14)=\mathrm{Env}(14)-p$$

$$e(15)=\mathrm{Env}(15)-p \quad (8)$$

wherein 'Env(n)' denotes band energy that is not quantized, 'QEnv(n)' denotes the band energy that is quantized, 'p' denotes the predicted representative value of the quantization target vector, 'e(n)' denotes error energy. In Equation (8), 'e(14)' and 'e(15)' are vector quantized.

Figure 21:
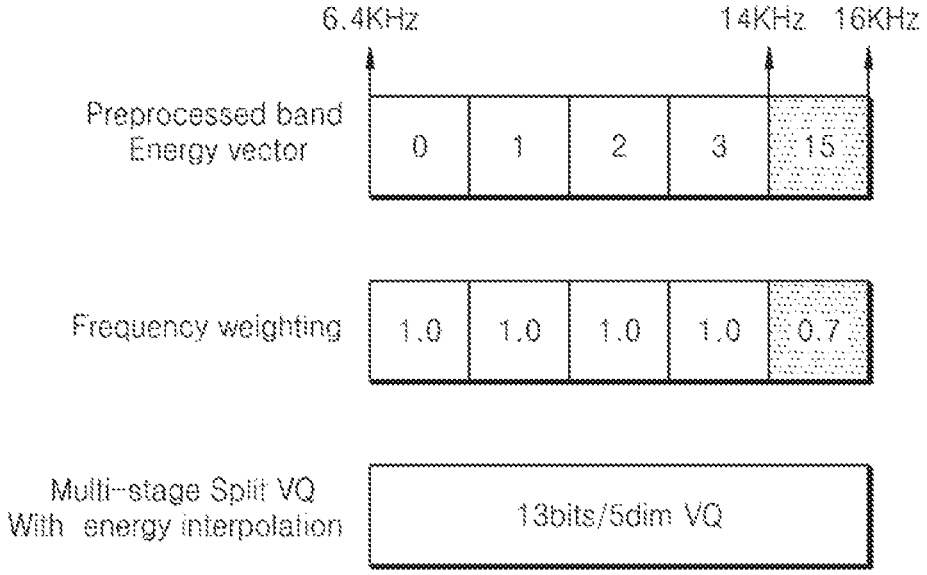
FIG. 21 is a diagram illustrating a process of quantizing energy by using a frequency weighting method, according to another exemplary embodiment.

FIG. 21 is a diagram illustrating a process of quantizing energy by using a frequency weighting method, according to another exemplary embodiment.

In the frequency weighting method, relatively low frequency bands of perceptually high importance may be more precisely quantized by considering perceptual characteristics of an input signal that is a target of extension coding, as in the unequal bit allocation method. To this end, perceptual importance is classified by allocating the same weight or a higher weight to the relatively low frequency bands, compared to those allocated to the other frequency bands.

For example, referring to FIG. 21, the energy quantizer 1707 may perform quantization by allocating a higher weight, e.g., 1.0, to relatively low frequency bands assigned numbers '0' to '3' and allocating a lower weight, e.g., 0.7, to a frequency band assigned number '15'. To use the allocated weights, the energy quantizer 1707 may calculate an optimum index by using a WMSE.

Figure 22:
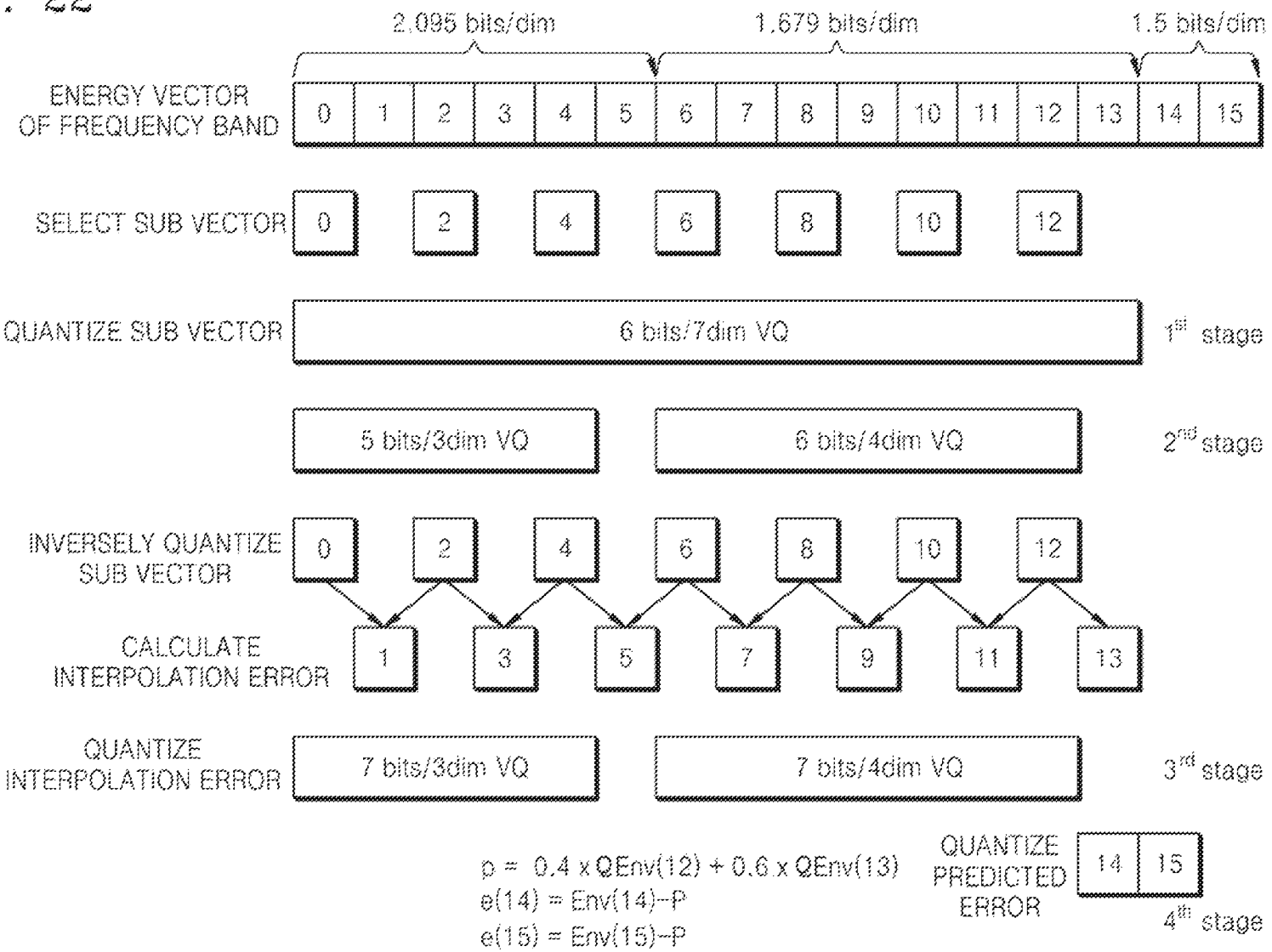
FIG. 22 is a diagram illustrating vector quantization using multi-stage split vector quantization and intra frame prediction, according to an exemplary embodiment.

FIG. 22 is a diagram illustrating vector quantization of multi-stage split and vector quantization by using intra frame prediction, according to an exemplary embodiment.

The energy quantizer 1707 may perform vector quantization in the normal mode in which a number of band energy is sixteen, as illustrated in FIG. 22. Here, the energy quantizer 1707 may perform vector quantization by using the unequal bit allocation method, intra frame prediction, and multi-stage split VQ with energy interpolation.

Figure 23:
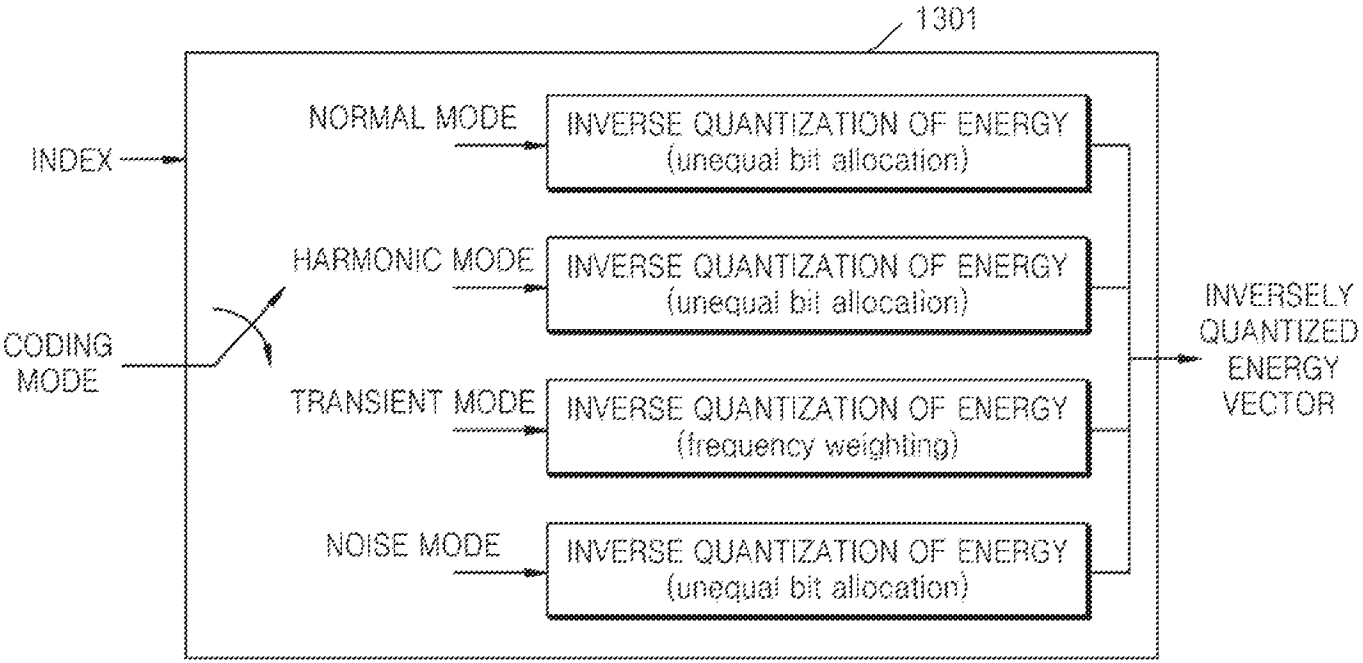
FIG. 23 is a diagram illustrating an operation of an inverse quantizer included in a decoding apparatus, according to another exemplary embodiment.

FIG. 23 is a diagram illustrating an operation of an inverse quantizer 1301 included in the decoding apparatus 102, according to an exemplary embodiment.

The operation of an inverse quantizer 1301 of FIG. 23 may be an inverse operation of the operation of the energy quantizer 1710 of FIG. 18. When coding modes are used to perform extension coding as described above with reference to FIG. 17, the inverse quantizer 1301 may decode information of the coding modes.

First, the inverse quantizer 1301 decodes the information of coding modes by using a received index. Then, the inverse quantizer 1301 performs inverse quantization according to the decoded information of coding mode. Referring to FIG. 23, according to the coding modes, blocks that are targets of inverse quantization are inversely quantized in a reverse order in which quantization is performed.

A part which was quantized according to multi-stage split VQ with energy interpolation may be inversely quantized as illustrated in FIG. 14. The inverse quantizer 1301 may perform inverse quantization using intra frame prediction by using Equation (9) below:

$$p=0.4*Q\mathrm{Env}(12)+0.6*Q\mathrm{Env}(13)$$

$$Q\mathrm{Env}(14)=\hat{e}(14)+p$$

$$Q\mathrm{Env}(15)=\hat{e}(15)+p \quad (9),$$

wherein 'Env(n)' denotes band energy that is not quantized and 'QEnv(n)' denotes band energy that is quantized. 'p' denotes a representative value of a quantization target vector, and 'e^(n)' denotes quantized error energy.

Figure 24:
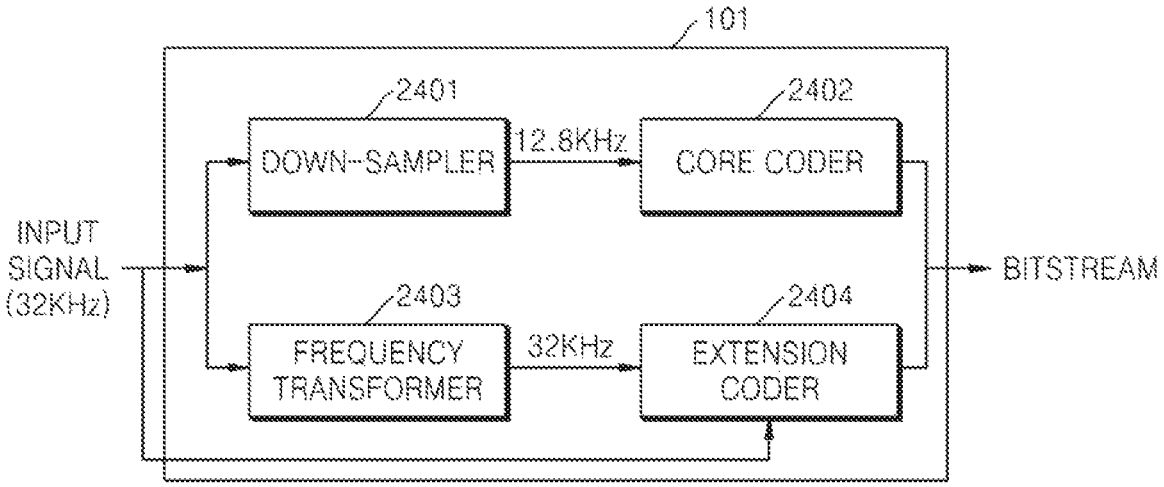
FIG. 24 is a block diagram of the structure of a coding apparatus according to another exemplary embodiment.

FIG. 24 is a block diagram of a coding apparatus 101 according to another exemplary embodiment.

Basic operations of elements of the coding apparatus 101 illustrated in FIG. 24 are the same as those of the elements of the coding apparatus 101 illustrated in FIG. 2A, except that an extension coder 2404 does not receive any information from a core coder 2402. Instead, the extension coder 2404 may directly receive an input signal in a time domain.

Figure 25:
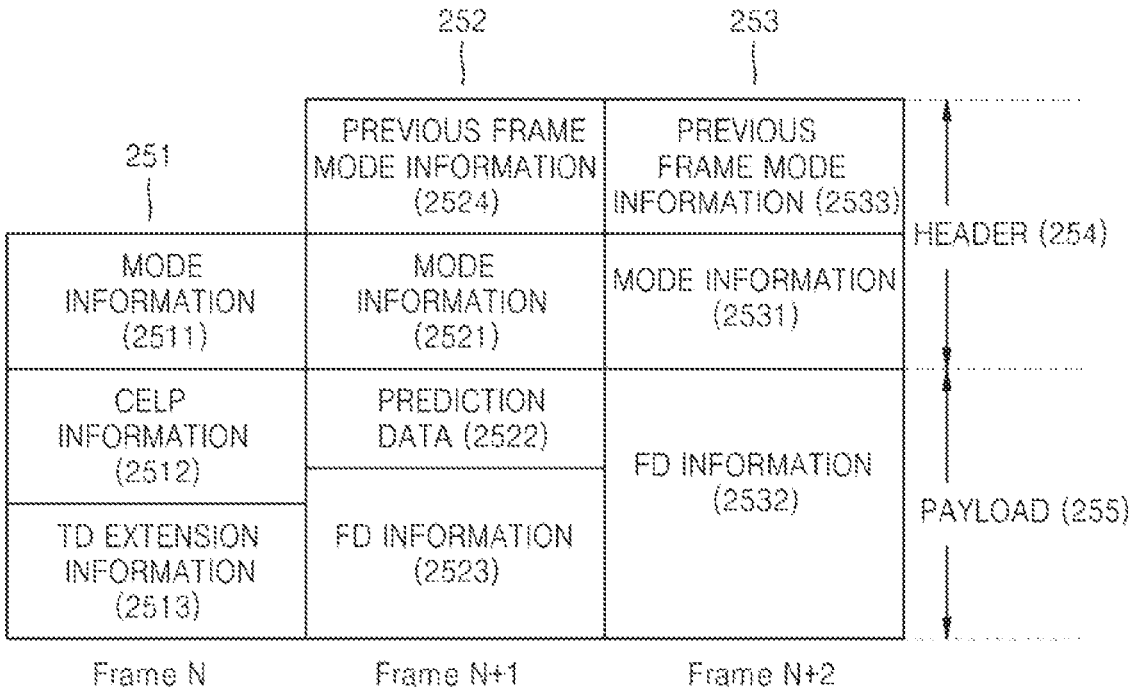
FIG. 25 is a diagram illustrating bitstreams according to an exemplary embodiment.

FIG. 25 is a diagram illustrating bitstreams according to an exemplary embodiment.

Referring to FIG. 25, a bitstream 251, a bitstream 252, and a bitstream 253 correspond to an $N^{th}$ frame, an $(N+1)^{th}$ frame, and an $(N+2)^{th}$ frame, respectively.

Referring to FIG. 25, the bitstreams 251, 252, and 253 include a header 254 and a payload 255.

The header 254 may include mode information 2511, 2521, and 2531. The mode information 2511, 2521, and 2531 are coding mode information of the $N^{th}$ frame, the $(N+1)^{th}$ frame, and the $(N+2)^{th}$ frame, respectively. For example, the mode information 2511 represents a coding mode used to code the $N^{th}$ frame, the mode information 2512 represents a coding mode used to code the $(N+1)^{th}$ frame, and the mode information 2513 represents a coding mode used to code the $(N^{+}2)^{th}$ frame. For example, the coding modes may include at least one from among the CELP mode, the FD mode, and the audio coding mode, but the present invention is not limited thereto.

The payload 255 includes information about core data according to the coding modes of these frames.

For example, in the case of the $N^{th}$ frame coded in the CELP mode, the payload 255 may include CELP information 2512 and TD extension information 2513.

In the case of the $(N+1)^{th}$ frame coded in the FD mode, the payload 255 may include FD information 2523. In the case of the $(N+2)^{th}$ frame coded in the FD mode, the payload 255 may include FD information 2532.

The payload 255 of the bitstream 252 corresponding to the $(N+1)^{th}$ frame may further include prediction data 2522. In other words, coding mode between adjacent frames is switched from the CELP mode to the FD mode, the bitstream 252 according to a result of performing of coding according to the FD mode may include the prediction data 2522.

More specifically, as illustrated in FIG. 2B, when the coding apparatus 101 that is capable of switching between the CELP mode and the FD mode performs coding according to the FD mode, frequency transformation, e.g., MDCT, which includes overlapping frames, is used.

Thus, if the $N^{th}$ frame and the $(N+1)^{th}$ frame of the input signal are coded according to the CELP mode and the FD mode, respectively, then the $(N+1)^{th}$ frame cannot be decoded only by using a result of coding according to the FD mode. For this reason, if coding mode between adjacent frames is switched from the CELP mode to the FD mode, the bitstream 252 according to the result of performing of coding according to the FD mode may thus include the prediction data 2522 representing information corresponding to prediction.

Accordingly, a decoding side may decode the bitstream 252 coded according to the FD mode through a prediction by using decoded time domain information of a current frame, e.g., the $(N+1)^{th}$ frame and a result of decoding a previous frame, e.g., the $N^{th}$ frame, based on the prediction data 2522 included in the bitstream 252. For example, the time-domain information may be time-domain aliasing, but the present exemplary embodiment is not limited thereto.

The header 254 of the bitstream 252 corresponding to the $(N+1)^{th}$ frame may further include previous frame mode information 2524, and the header 254 of the bitstream 253 corresponding to the $(N+2)^{th}$ frame may further include previous frame mode information 2533.

More specifically, the bitstreams 252 and 253 coded according to the FD mode may further include the previous frame mode information 2524 and 2533, respectively.

For example, the previous frame mode information 2524 included in the bitstream 252 corresponding to the $(N+1)^{th}$ frame may include information about the mode information 2511 of the $N^{th}$ frame, and the previous frame mode information 2533 included in the bitstream 253 corresponding to the $(N+2)^{th}$ frame may include information about the mode information 2524 of the $(N+1)^{th}$ frame.

Thus, even if an error occurs in one of a plurality of frames, the decoding side may exactly detect a mode transient.

Figure 26:
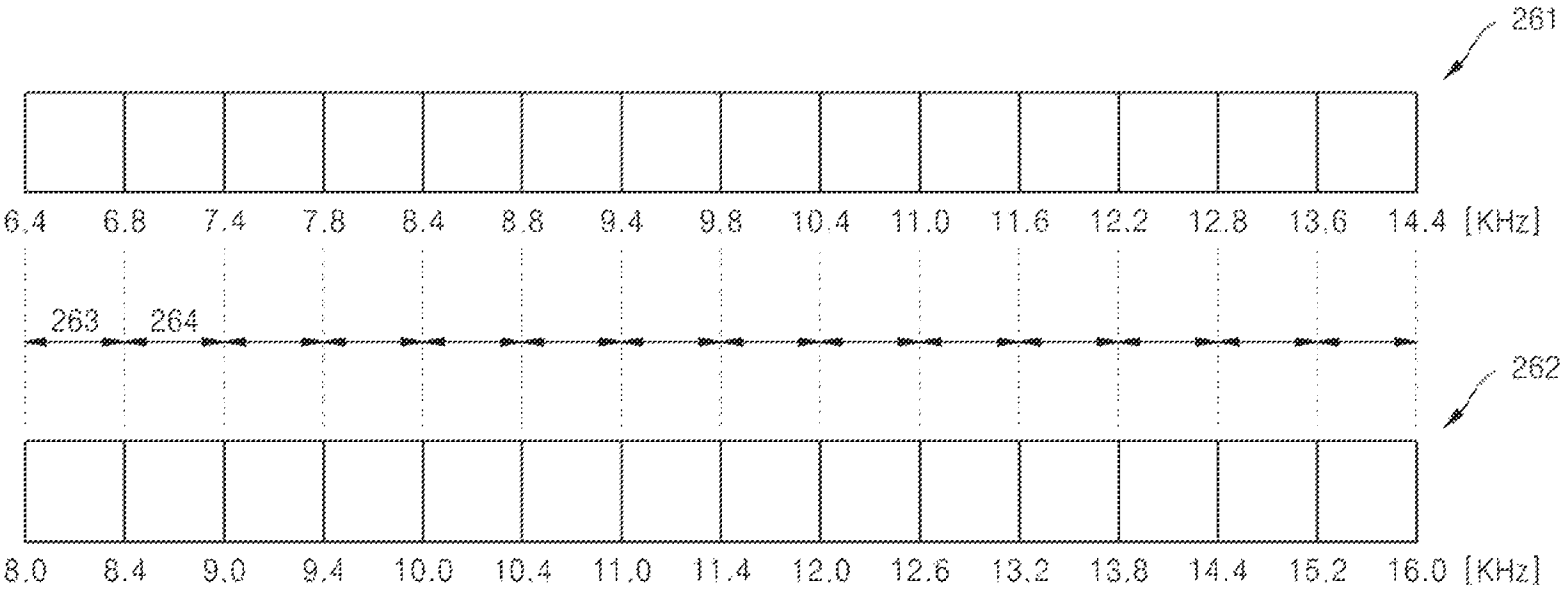
FIG. 26 is a diagram illustrating a method of performing frequency allocation for each frequency band, according to an exemplary embodiment.

FIG. 26 is a diagram illustrating a method of performing frequency allocation for each frequency band, according to an exemplary embodiment.

As described above, the FD extension coder 2094 of FIG. 2C or the FD extension coder 215 of FIG. 2D may perform energy quantization by sharing the same codebook even at different bitrates. Thus, when a frequency spectrum corresponding to an input signal is divided into a predetermined number of frequency bands, the FD extension coder 2094 or the FD extension coder 215 may allocate the same bandwidth to each of the frequency bands even at different bitrates.

A case 261 where a frequency band of about 6.4 to 14.4 kHz is divided at a bitrate of 16 kbps and a case 262 where a frequency band of about 8 to 16 kHz is divided at a bitrate that is equal to or greater than 16 kbps will now be described. In these cases, the bandwidth of each of the frequency bands is the same even at different bitrates.

That is, a bandwidth 263 of a first frequency band may be 0.4 kHz at both a bitrate of 16 kbps and a bitrate that is equal to or greater than 16 kbps, and a bandwidth 264 of a second frequency band may be 0.6 kHz at both a bitrate of 16 kbps and a bitrate that is equal to or greater than 16 kbps.

As described above, since the bandwidth of each of the frequency bands is set to be the same even at different bitrates, the FD extension coder 2094 or the FD extension coder 215, according to the current exemplary embodiment, may perform energy quantization by sharing the same codebook at different bitrates.

Thus, in a configuration in which switching is performed between the CELP mode and the FD mode or between the CELP mode and the audio coding mode, multi-mode bandwidth extension may be performed and codebook sharing is performed to support various bitrates, thereby reducing the size of, for example, a read-only memory (ROM), and simplifying a implementation.

Figure 27:
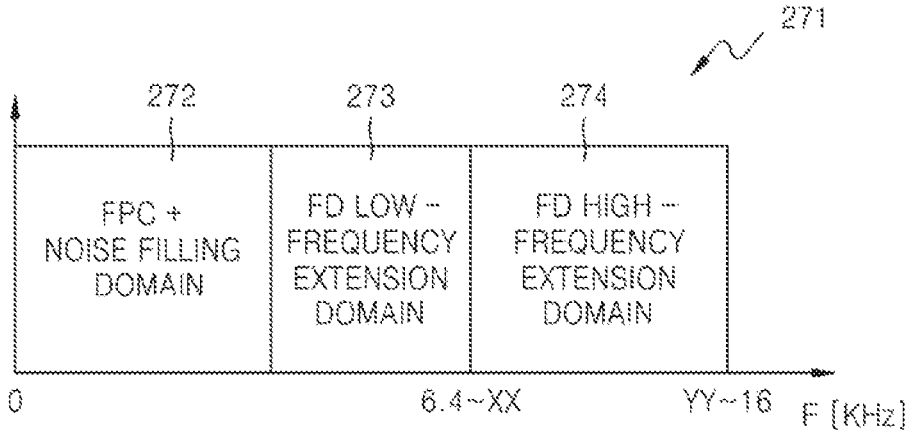
FIG. 27 is a diagram illustrating frequency bands used in an FD coder or an FD decoder, according to an exemplary embodiment.

FIG. 27 is a diagram illustrating a frequency band 271 used in an FD coder or an FD decoder, according to an exemplary embodiment.

Referring to FIG. 27, the frequency band 271 is an example of a frequency band that may be used in, for example, the FD coder 209 of FIG. 2B and the FD decoder 1209 of FIG. 12B.

More specifically, the factorial pulse coder 2092 of the FD coder 209 limits a frequency band for performing FPC coding, according to bitrate. For example, a frequency band Fcore for performing FPC coding may be 6.4 kHz, 8 kHz, or 9.6 kHz according to a bitrate, but the exemplary embodiments are not limited thereto.

A factorial pulse coded frequency band Ffpc 272 may be determined by performing FPC in the frequency band limited by the factorial pulse coder 2092. The noise filling performing unit 12093 of the FD decoder 1209 performs noise filling in the factorial pulse coded frequency band Ffpc 272.

If an upper band value of the factorial pulse coded frequency band Ffpc 272 is less than upper band value of the frequency band Fcore for performing FPC, the FD low-frequency extension decoder 12095 of the FD decoder 1209 may perform low-frequency extension decoding.

Referring to FIG. 27, the FD low-frequency extension decoder 12095 may perform FD low-frequency extension decoding in a remaining frequency band 273 of the frequency band Fcore, excluding the factorial pulse coded frequency band Ffpc. However, if the frequency band Fcore is the same as the factorial pulse coded frequency band Ffpc 272, FD low-frequency extension decoding may not be performed.

The FD high-frequency extension decoder 12096 of the FD decoder 1209 may perform FD high-frequency extension decoding in a frequency band 274 between an upper band value of the frequency band Fcore and an upper band value of a frequency band Fend according to a bitrate. For example, the upper band value of the frequency band Fend may be 14 kHz, 14.4 kHz, or 16 kHz, but the exemplary embodiments are not limited thereto. Thus, by using the coding apparatus 101 and the decoding apparatus 102 according to an exemplary embodiment, voice and music may be efficiently coded at various bitrates through various switching systems. FD extension coding and FD extension decoding may also be performed by sharing a codebook. Thus, high-quality audio may be implemented in a less complicated manner even when various configurations are present. In addition, since mode information about a previous frame is included in a bitstream when FD coding is performed, decoding may be more exactly performed even when a frame error occurs. Accordingly, with the coding apparatus 101 and the decoding apparatus 102, it is possible to perform coding and decoding with low complexity and low delay.

Accordingly, a speech signal and a music signal according to a 3GPP enhanced voiced service (EVS) may be appropriately coded and decoded.

The above methods according to one or more exemplary embodiments may be embodied as a computer program that may be run by various types of computer means and be recorded on a computer readable recording medium. The computer readable recording medium may store program commands, data files, data structures, or a combination thereof. The program commands may be specially designed or constructed according to the present invention or may be well known in the field of computer software.

While the exemplary embodiments have been particularly shown and described, it will be understood by those of ordinary skill in the art that various changes in form and details may be made therein without departing from the spirit and scope of the inventive concept as defined by the appended claims.

The invention claimed is:

1. A decoding apparatus comprising:

a mode checking unit to check mode information of each of frames included in a bitstream;

a first core decoding unit to perform code excited linear prediction (CELP) decoding on a CELP coded frame, when a core coding mode of a low-frequency signal indicates a CELP coding mode, based on a result of the checking;

a first extension decoding unit to generate a decoded signal of a high-frequency band by using at least one of a result of the performing the CELP decoding and an excitation signal of the low-frequency signal;

a second core decoding unit to perform audio decoding on an audio coded frame, when the core coding mode of the low-frequency signal indicates an audio coding mode, based on the result of the checking; and a second extension decoding unit to generate a decoded signal of the high-frequency band by performing frequency-domain (FD) extension decoding by using a result of the performing the audio decoding.

2. The decoding apparatus of claim 1, wherein the second extension decoding unit is configured to inverse-quantize an energy of a time domain input signal, generate a base excitation signal using a frequency domain input signal, calculate a gain using the inverse-quantized energy and an energy of the base excitation signal, and apply the calculated gain to the base excitation signal for each frequency band.

3. The decoding apparatus of claim 2, wherein the second extension decoding unit is configured to inverse-quantize the energy by sharing a same codebook at different bitrates.

4. The decoding apparatus of claim 2, wherein the second extension decoding unit is configured to inverse-quantize the energy by selecting a sub-vector of an energy vector, inverse-quantizing the selected sub-vector, interpolating the inverse-quantized sub-vector, and adding an interpolation error value to the interpolated sub-vector.

5. The decoding apparatus of claim 2, wherein the gain is calculated by setting a sub-band used to apply energy smoothing, and generating an energy for each sub-band through an interpolation, and wherein the gain is calculated for each sub-band.

6. A coding method of encoding a high band signal, the coding method comprising:

dividing an input signal into a low band signal and the high band signal; and encoding the high band signal in a time domain or a frequency domain, based on characteristic of the input signal, wherein the encoding of the high band signal in the frequency domain comprises:

generating a base excitation signal for the high band, based on the input signal;

obtaining an energy from the input signal;

obtaining an energy control factor based on a ratio between tonality of the input signal and tonality of the base excitation signal;

controlling the obtained energy, based on the energy control factor; and quantizing the controlled energy.

7. The coding method of claim 6, wherein the quantizing of the controlled energy comprises quantizing the controlled energy based on a weighted mean square error (WMSE).

8. The coding method of claim 6, wherein the quantizing of the controlled energy comprises quantizing the controlled energy based on an interpolation process.

9. The coding method of claim 6, wherein the quantizing of the controlled energy comprises quantizing the controlled energy by using a multi-stage vector quantization.

10. The coding method of claim 6, wherein the quantizing of the controlled energy comprises:

selecting a plurality of vectors from among energy vectors; and quantizing the selected vectors and an error obtained by interpolating the selected vectors.

* * * * *